US011234564B2

(12) United States Patent
Albert et al.

(10) Patent No.: US 11,234,564 B2
(45) Date of Patent: Feb. 1, 2022

(54) PERSONAL CLEANING SYSTEM

(71) Applicant: Tactopack, Inc., Pelham, NY (US)

(72) Inventors: Jonathan D. Albert, Philadelphia, PA (US); Steven Bank, Pelham, NY (US)

(73) Assignee: TACTOPACK, INC., Pelham, NY (US)

( * ) Notice: Subject to any disclaimer, the term of this patent is extended or adjusted under 35 U.S.C. 154(b) by 0 days.

(21) Appl. No.: 16/291,147

(22) Filed: Mar. 4, 2019

(65) Prior Publication Data

US 2019/0261819 A1 Aug. 29, 2019

Related U.S. Application Data

(63) Continuation-in-part of application No. 15/449,265, filed on Mar. 3, 2017, now Pat. No. 10,219,657, which is a continuation-in-part of application No. 15/294,204, filed on Oct. 14, 2016, now Pat. No. 10,039,424, which is a continuation-in-part of application No. 15/084,174, filed on Mar. 29, 2016, now Pat. No. 9,808,130, which is a continuation of application No. 14/677,532, filed on Apr. 2, 2015, now Pat. No. 9,326,645.

(60) Provisional application No. 62/242,195, filed on Oct. 15, 2015.

(51) Int. Cl.
*A47K 7/03* (2006.01)

(52) U.S. Cl.
CPC ..... *A47K 7/03* (2013.01)

(58) Field of Classification Search
CPC ..... A46B 5/04; A47K 7/03
See application file for complete search history.

(56) References Cited

U.S. PATENT DOCUMENTS

| | | | |
|---|---|---|---|
| 19,188 | A | 1/1858 | Evans |
| 674,913 | A | 5/1901 | Fike |
| 685,574 | A | 10/1901 | Conboie |
| 722,863 | A | 3/1903 | Lodge |
| 836,181 | A | 11/1906 | Cray |
| 1,161,719 | A | 11/1915 | Norton |
| 1,438,485 | A | 12/1922 | Goldberg |
| 1,481,772 | A | 1/1924 | Zell |
| 1,533,732 | A | 4/1925 | Livingstone |
| 1,558,930 | A | 10/1925 | Schuck |
| 1,619,180 | A | 3/1927 | Andrew |
| 1,713,065 | A | 5/1929 | Williams |
| 1,941,320 | A | 12/1933 | Pamplin |
| 2,075,413 | A | 3/1937 | Logue |
| 2,405,154 | A | 8/1946 | Logan |
| 2,562,418 | A | 7/1951 | Enrico et al. |
| 2,651,071 | A | 9/1953 | Frances et al. |
| 2,722,706 | A | 11/1955 | Joan |

(Continued)

FOREIGN PATENT DOCUMENTS

| | | | |
|---|---|---|---|
| CH | 303374 | A | 11/1954 |
| EP | 2676544 | A1 | 12/2013 |

(Continued)

*Primary Examiner* — David P Angwin
*Assistant Examiner* — Bradley S Oliver
(74) *Attorney, Agent, or Firm* — Leason Ellis LLP

(57) ABSTRACT

A hand-held applicator is formed with a pocket that is configured to receive one hand of a user. The pocket partitions the hand-held applicator into a rear portion and a front portion. A dispensing outlet in the form of a laminated structure of at least two layers is formed as defines an outflow pathway for directing fluid away from the applicator under action of a pump.

12 Claims, 33 Drawing Sheets

(56) References Cited

U.S. PATENT DOCUMENTS

| | | | |
|---|---|---|---|
| 2,795,806 | A | 6/1957 | Omar |
| 2,831,206 | A | 4/1958 | Curtis |
| 3,116,732 | A | 1/1964 | Cahill |
| 3,485,562 | A | 12/1969 | Hidden et al. |
| 3,589,819 | A | 6/1971 | Bryant |
| 3,701,604 | A | 10/1972 | Holroyd |
| 3,778,172 | A | 12/1973 | Myren |
| 3,883,897 | A | 5/1975 | Lefkowitz et al. |
| 3,885,249 | A | 5/1975 | De Brabander |
| 4,037,790 | A | 7/1977 | Reiser et al. |
| 4,457,640 | A | 7/1984 | Anderson |
| 4,602,650 | A | 7/1986 | Pipkin |
| 4,645,251 | A | 2/1987 | Jacobs |
| 4,766,914 | A | 8/1988 | Briggs |
| 4,953,998 | A | 9/1990 | McCartherens |
| 4,959,881 | A | 10/1990 | Murray |
| 5,094,559 | A | 3/1992 | Rivera et al. |
| 5,111,934 | A | 5/1992 | Morin |
| 5,120,304 | A | 6/1992 | Sasaki |
| 5,169,251 | A | 12/1992 | Davis |
| 5,441,355 | A | 8/1995 | Moore |
| 5,456,354 | A | 10/1995 | Wood |
| 5,473,789 | A | 12/1995 | Oster |
| 5,542,566 | A | 8/1996 | Glaug et al. |
| 5,722,349 | A | 3/1998 | Wolgamuth |
| 5,867,829 | A | 2/1999 | Hegoas et al. |
| 5,947,275 | A | 9/1999 | Hess |
| 5,956,770 | A | 9/1999 | Dennis |
| 6,098,234 | A | 8/2000 | Jackson, Jr. |
| 6,145,155 | A | 11/2000 | James et al. |
| 6,257,785 | B1 | 7/2001 | Otten |
| 6,305,044 | B1 | 10/2001 | James et al. |
| 6,508,602 | B1 | 1/2003 | Gruenbacher et al. |
| 6,513,998 | B1 | 2/2003 | Barry |
| 6,539,549 | B1 | 4/2003 | Peters, Jr. |
| 6,547,468 | B2 | 4/2003 | Gruenbacher et al. |
| 6,588,961 | B2 | 7/2003 | Lafosse-marin et al. |
| 6,604,244 | B1 | 8/2003 | Leach |
| 6,669,387 | B2 | 12/2003 | Gruenbacher et al. |
| 6,726,386 | B1 | 4/2004 | Gruenbacher et al. |
| 6,811,338 | B1 | 11/2004 | Manske, Jr. et al. |
| 6,817,801 | B1 | 11/2004 | Colburn et al. |
| 6,834,619 | B1 | 12/2004 | Rampersad |
| 7,021,848 | B1 | 4/2006 | Gruenbacher et al. |
| 7,033,100 | B2 | 4/2006 | Barton et al. |
| 7,108,440 | B1 | 9/2006 | Gruenbacher et al. |
| 7,179,007 | B2 | 2/2007 | Wong et al. |
| 7,255,506 | B2 | 8/2007 | Gruenbacher et al. |
| 7,478,768 | B2 | 1/2009 | Yip |
| 7,604,623 | B2 | 10/2009 | Brunner et al. |
| 7,730,574 | B1 | 6/2010 | Cox, Sr. |
| 7,731,056 | B2 | 6/2010 | Tramontina |
| 7,823,245 | B2 | 11/2010 | Firouzman |
| 7,874,020 | B1 | 1/2011 | Franklin |
| 7,904,969 | B2 | 3/2011 | Greenfield |
| 8,061,558 | B2 | 11/2011 | Jordan et al. |
| 8,069,526 | B2 | 12/2011 | Malaska |
| 8,167,177 | B1 | 5/2012 | Galgano |
| 8,196,746 | B2 | 6/2012 | Storandt |
| 8,230,523 | B2 | 7/2012 | Chareyron |
| 8,262,305 | B2 | 9/2012 | Lam et al. |
| 8,356,378 | B1 | 1/2013 | Crooms |
| 8,661,601 | B2 | 3/2014 | Klingbeil |
| 8,689,387 | B2 | 4/2014 | Gundersen |
| 8,794,189 | B1 | 8/2014 | Dahlquist et al. |
| 8,826,467 | B2 | 9/2014 | Chew et al. |
| 9,326,645 | B1 | 5/2016 | Bank et al. |
| 9,808,130 | B2 | 11/2017 | Bank et al. |
| 10,039,424 | B2 | 8/2018 | Bank et al. |
| 2002/0118993 | A1 | 8/2002 | Lafosse-Marin et al. |
| 2003/0192105 | A1 | 10/2003 | Lin |
| 2005/0217045 | A1 | 10/2005 | Minkler et al. |
| 2006/0288954 | A1 | 12/2006 | Graunstadt |
| 2007/0094766 | A1 | 5/2007 | Liu |
| 2007/0130707 | A1 | 6/2007 | Cohen et al. |
| 2007/0192975 | A1 | 8/2007 | Aseff |
| 2007/0206984 | A1 | 9/2007 | Fagel et al. |
| 2008/0078046 | A1 | 4/2008 | Reed |
| 2008/0276395 | A1 | 11/2008 | Powell et al. |
| 2010/0037413 | A1 | 2/2010 | Tyler |
| 2010/0218326 | A1 | 9/2010 | Yamaguchi |
| 2010/0257681 | A1 | 10/2010 | Lin |
| 2011/0113528 | A1 | 5/2011 | Chew et al. |
| 2011/0240760 | A1 | 10/2011 | Tucker |
| 2011/0274377 | A1 | 11/2011 | Lin |
| 2012/0051828 | A1 | 3/2012 | Gundersen |
| 2012/0090121 | A1 | 4/2012 | Phillips, Sr. et al. |
| 2012/0189371 | A1 | 7/2012 | Morelli |
| 2013/0341212 | A1 | 12/2013 | Perelli |
| 2017/0202422 | A1 | 7/2017 | Hagen |
| 2017/0238770 | A1 | 8/2017 | Albert et al. |

FOREIGN PATENT DOCUMENTS

| | | | |
|---|---|---|---|
| FR | 1127965 | A | 12/1956 |
| FR | 1539481 | A | 9/1968 |
| GB | 924503 | A | 4/1963 |
| JP | 200222 | A | 10/2001 |
| WO | WO 2004/100735 | | 11/2004 |
| WO | WO 2006120330 | | 11/2006 |
| WO | WO 2007122594 | | 11/2007 |
| WO | WO 2008096135 | | 8/2008 |
| WO | WO 2018/071558 | | 4/2018 |

PERSONAL CLEANING SYSTEM

CROSS-REFERENCE TO RELATED APPLICATIONS

The present application is a continuation-in-part of U.S. patent application Ser. No. 15/449,265, filed Mar. 3, 2017, which is a continuation-in-part of U.S. patent application Ser. No. 15/294,204, filed Oct. 14, 2016, now U.S. Pat. No. 10,039,424, issued on Aug. 7, 2018, which claims the benefit of U.S. patent application Ser. No. 62/242,195, filed Oct. 15, 2015 and which is a continuation-in-part of U.S. patent application Ser. No. 15/084,174, filed Mar. 29, 2016, now U.S. Pat. No. 9,808,130, issued on Nov. 7, 2017, which is a continuation of U.S. patent application Ser. No. 14/677,532, filed Apr. 2, 2015, issued as U.S. Pat. No. 9,326,645, issued on May 3, 2016, each of which is hereby incorporated by reference in its entirety.

TECHNICAL FIELD

The present invention relates to the area of products used in the act of personal cleaning. It also relates to the area of mitts or gloves used in a cleaning process. More particularly, it relates to a method of manufacturing hand-worn articles in which a material is supplied in a fluid state to assist in a cleaning operation. The present invention additionally relates to the packaging, display, and storage of such articles.

BACKGROUND

The convenience of combining a hand-mounted device with a brushing, cleaning, wiping, polishing, or material application function may be generally appreciated as such wearable products free the user from the necessity of actively gripping a cloth, sponge, or other loose material.

A number of attempts have been made to produce such hand-mounted devices. For example, U.S. Pat. No. 19,188 to Evans shows a flexible hand-mounted curry comb for use in the grooming of livestock. U.S. Pat. No. 674,913 to Fike shows a hand-mounted glove with an internal pocket devised to hold soap or medicated material, so that the glove may be dipped in water to activate the enclosed material. U.S. Pat. No. 722,863 to Lodge discloses a cleaning mitt in which a stack of facing layers may be successively exposed.

U.S. Pat. No. 836,181 to Cray reveals a washing glove with an external fluid supply line and an integral fluid reservoir. U.S. Pat. No. 1,161,719 to Norton details a hand-worn device with integrated, perforated reservoirs from which fluid materials may be actively and electively expressed. U.S. Pat. No. 3,116,732 to Cahill describes a disposable glove with rupturable reservoirs carrying lotion, liquid or balm. U.S. Pat. No. 4,959,881 to Murray provides for a disposable cleaning mitt with an initially sealed container holding a pad permeated with a cleaning solution.

U.S. Pat. No. 3,778,172 to Myren illustrates a cleaning glove with a reservoir refillable through a valve. U.S. Pat. No. 5,169,251 to Davis shows a hand-worn dispenser with fingertip applicators that may be individually opened or capped to regulate the dispensing pattern. U.S. Pat. No. 6,145,155 discloses a sealed disposable mitt with a moistened face and a drying face. U.S. Pat. No. 6,257,785 to Otten et al. depicts a glove with a plurality of individual reservoirs arranged in a dimpled relief pattern so that a degree of user control is allowed over the amount and location of the encapsulated agent that is released.

By reference to the examples above, it may be generally understood that there has been a longstanding interest in systems which integrate a hand-worn article with consumable cleaning materials. It may also be appreciated that the inclusion of a fluid carrier within a hand-worn article, whether for water of other liquid formulation, can enhance the utility and convenience of such a device.

SUMMARY

The invention describes a method for manufacturing a portable fluid dispensing device that comprises a hand-held applicator that includes a pocket that is configured to receive one hand of a user. The pocket partitions the hand-held applicator into a rear portion and a front portion. The method comprising the steps of: (a) superimposing a first layer and a second layer of the rear portion, wherein the second layer includes a plurality of peripheral notches formed therein along a peripheral edge thereof; (b) selectively bonding the first layer to the second layer so as to form a fluid reservoir defined therebetween; (c) superimposing a third layer, that comprises the front portion, onto the second layer, whereby the first layer is exposed through the peripheral notches; (d) selectively bonding the third layer to the first layer at locations that lie within the peripheral notches to form a joined three-ply structure; and (e) incorporating a fluid dispensing mechanism into the three-ply structure, the fluid dispensing mechanism being in fluid communication with the fluid reservoir and being configured to selectively deliver the fluid from the fluid reservoir to at least one fluid dispensing outlet through which the fluid is dispensed.

BRIEF DESCRIPTION OF THE DRAWING FIGURES

Additional features of the invention will become evident in the following detailed description of a system formed in accordance with the invention, in which.

Figure 15B:
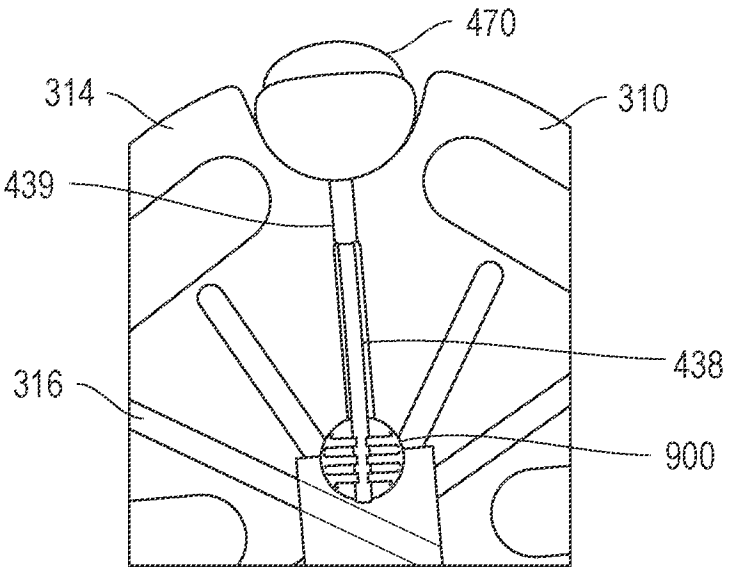
Figure 15C:
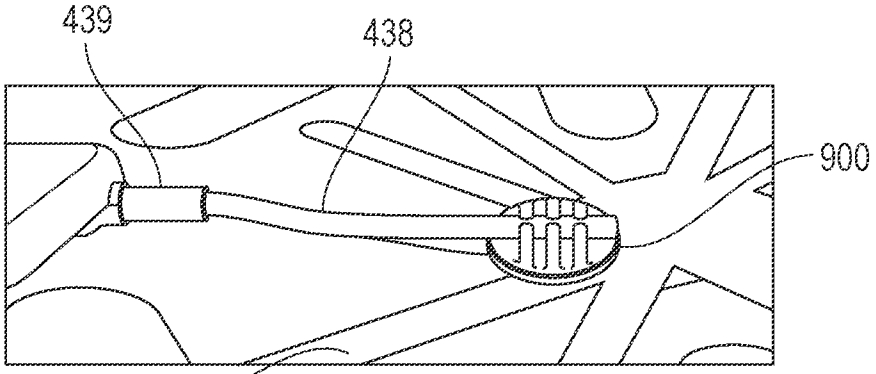
Figure 15A:
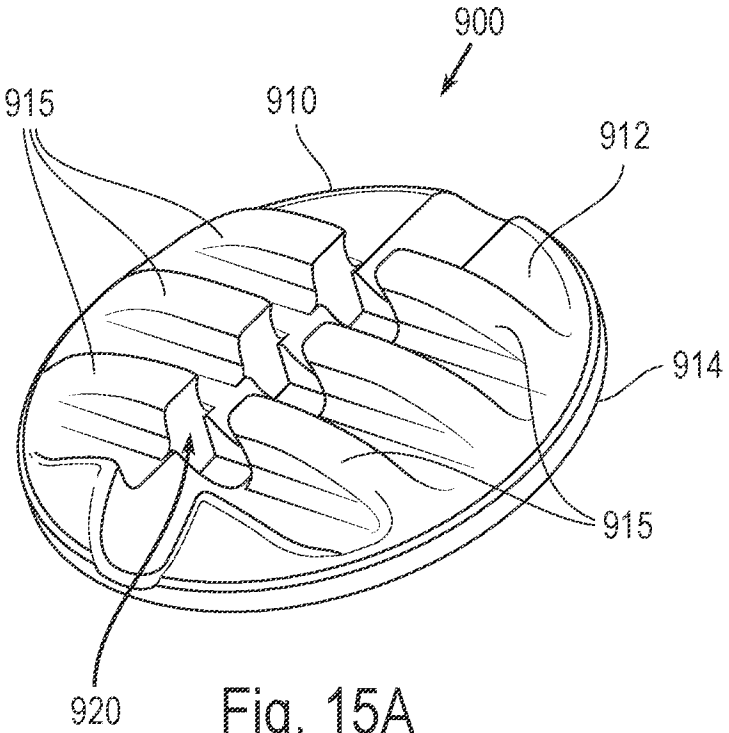
Figure 16:
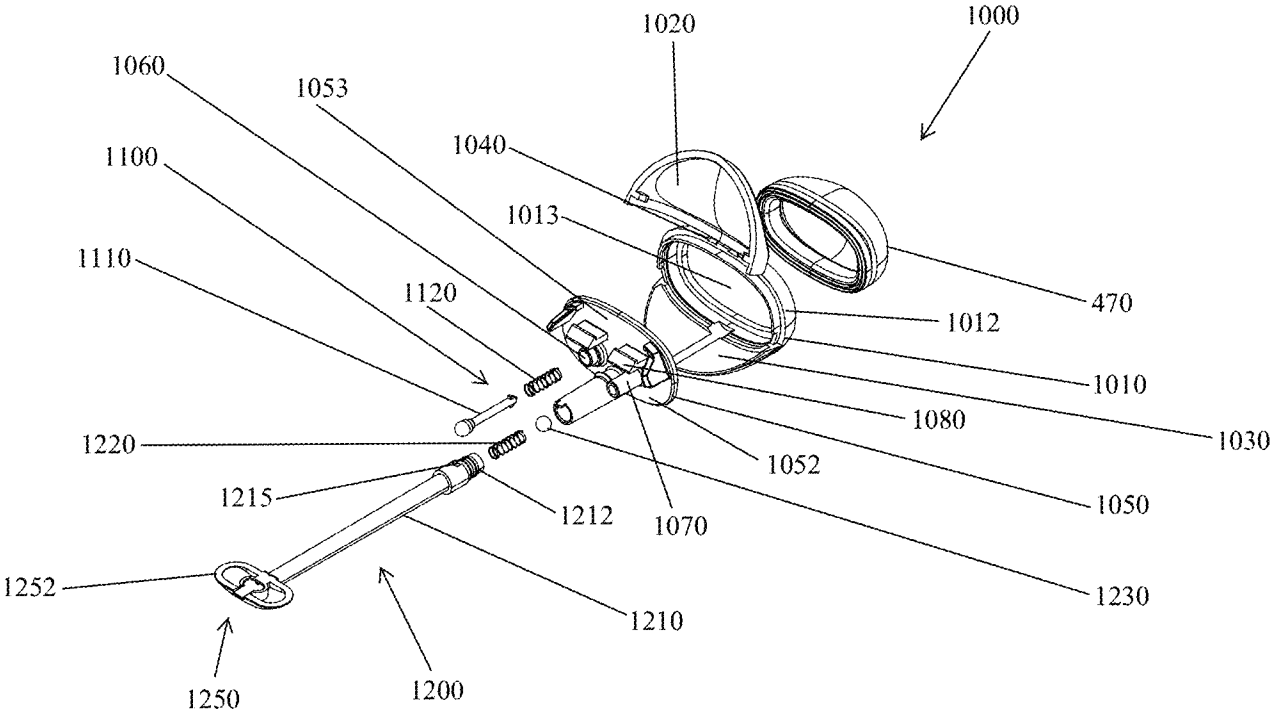
Figure 19:
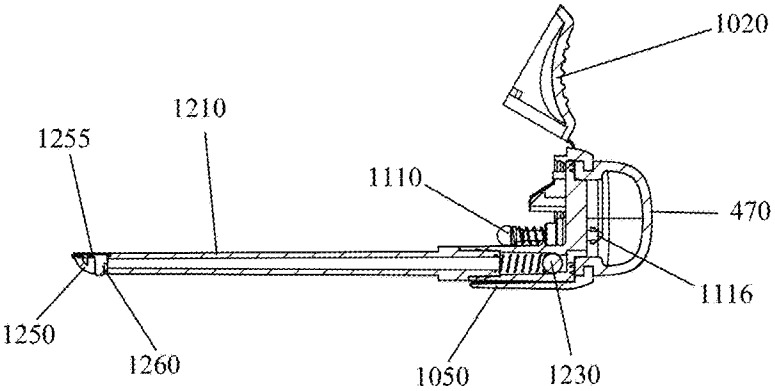
Figure 18:
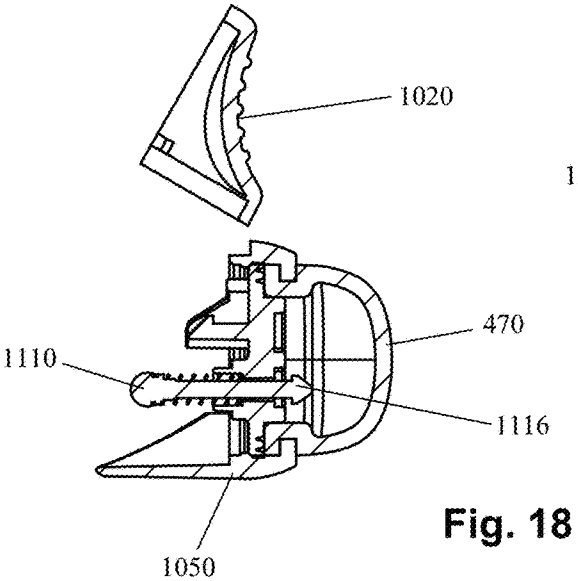
Figure 17:
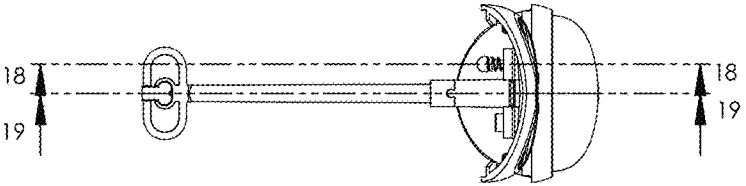
Figure 20:
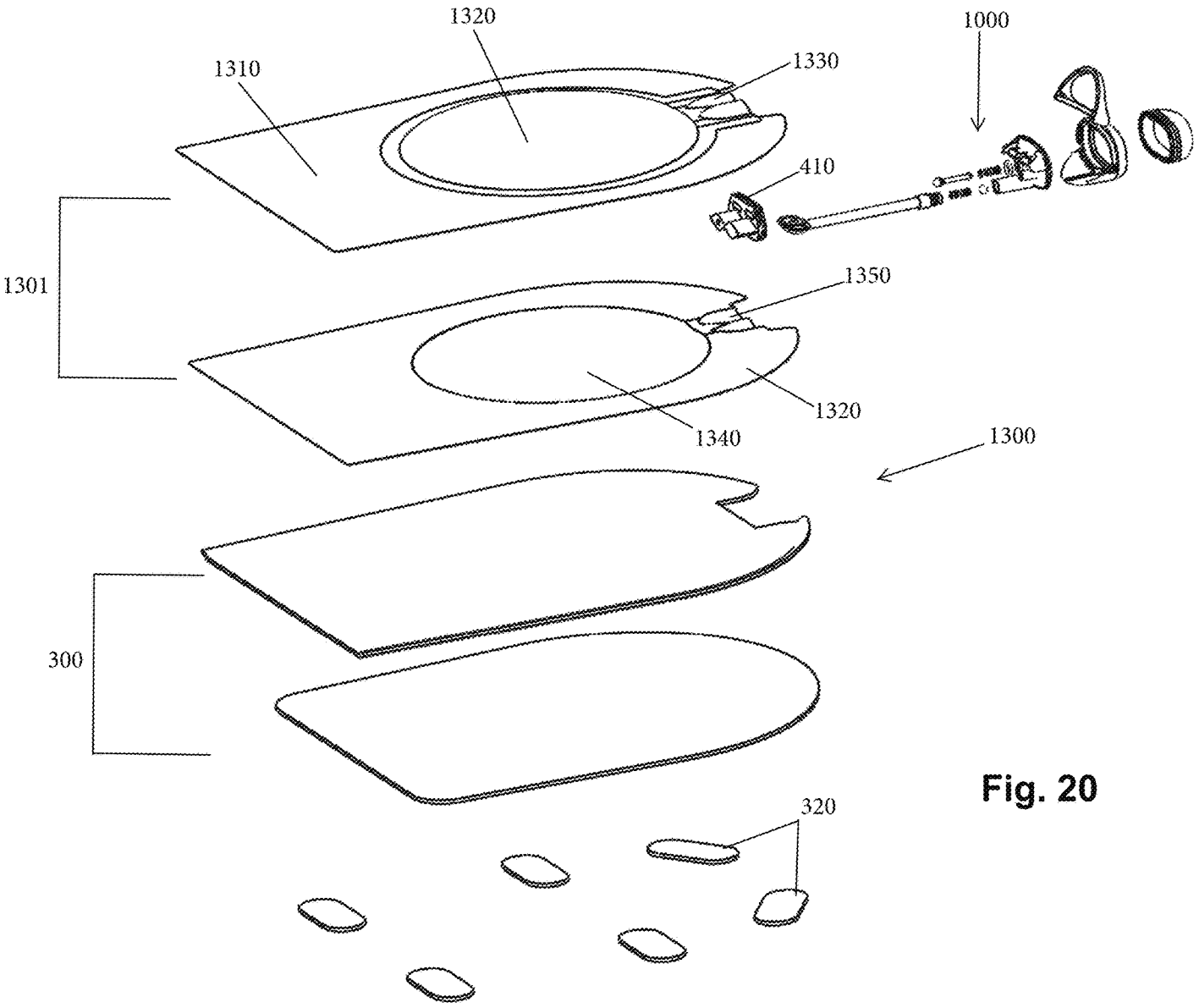
Figure 21:
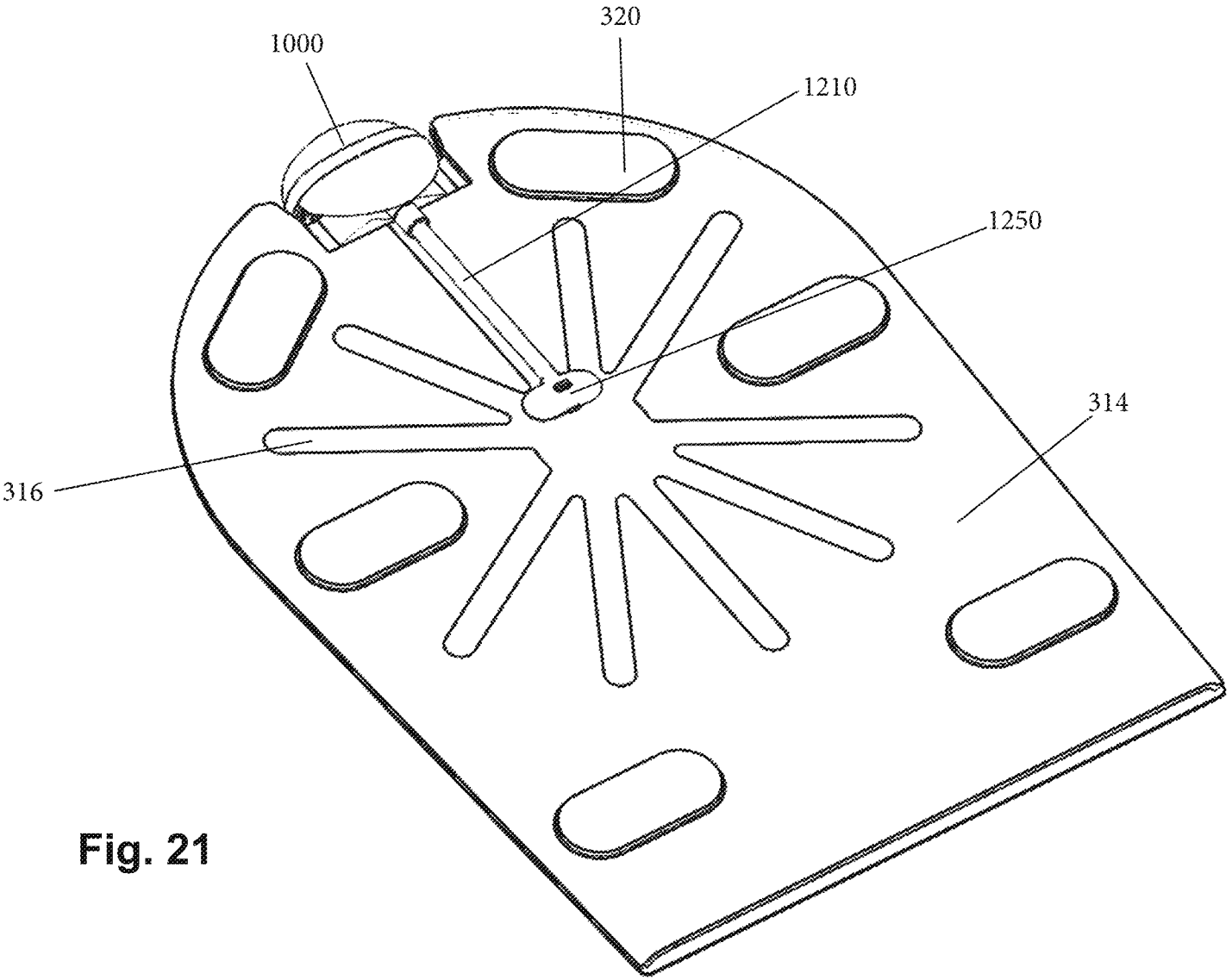
Figure 22:
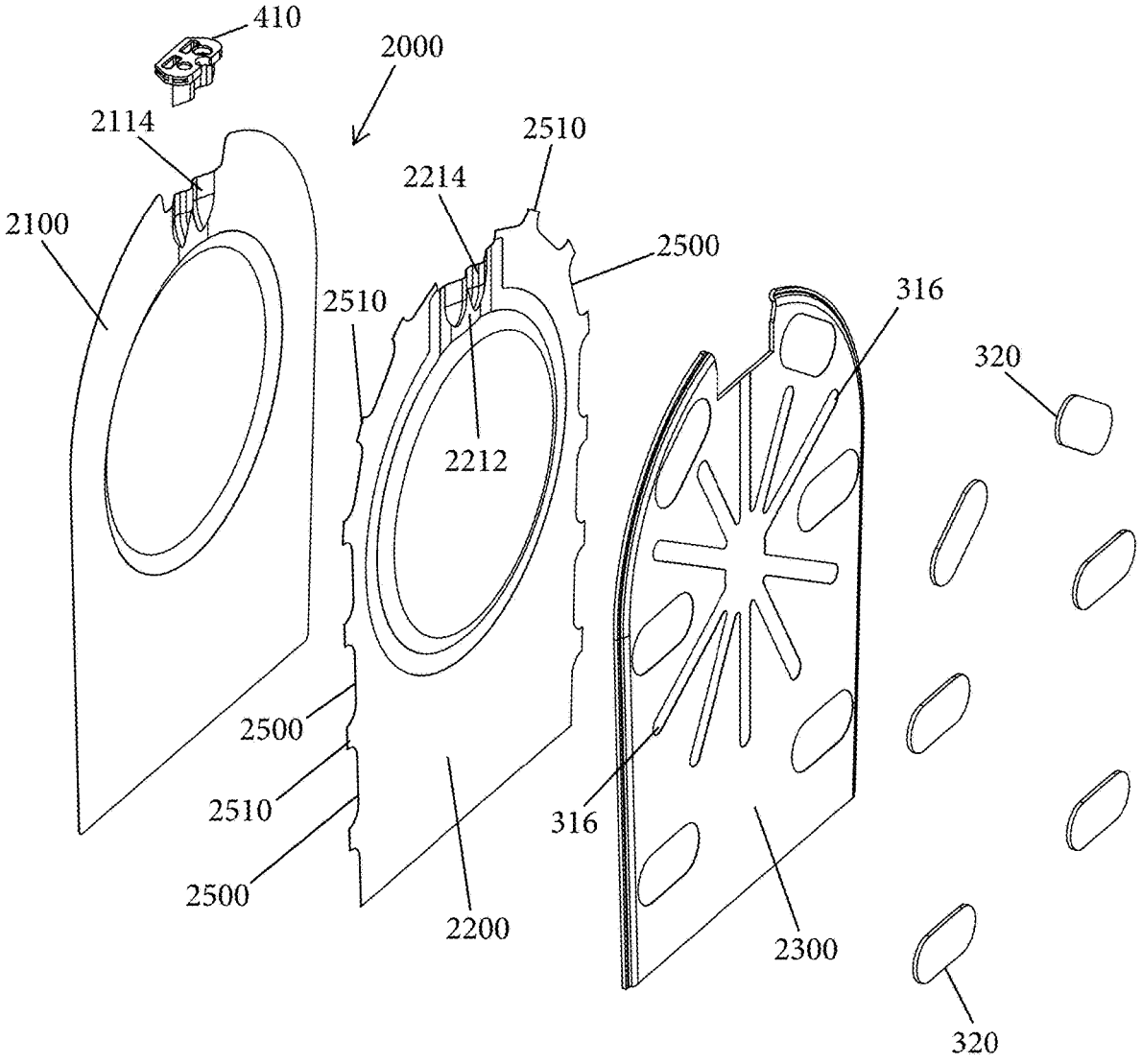
Figure 23:
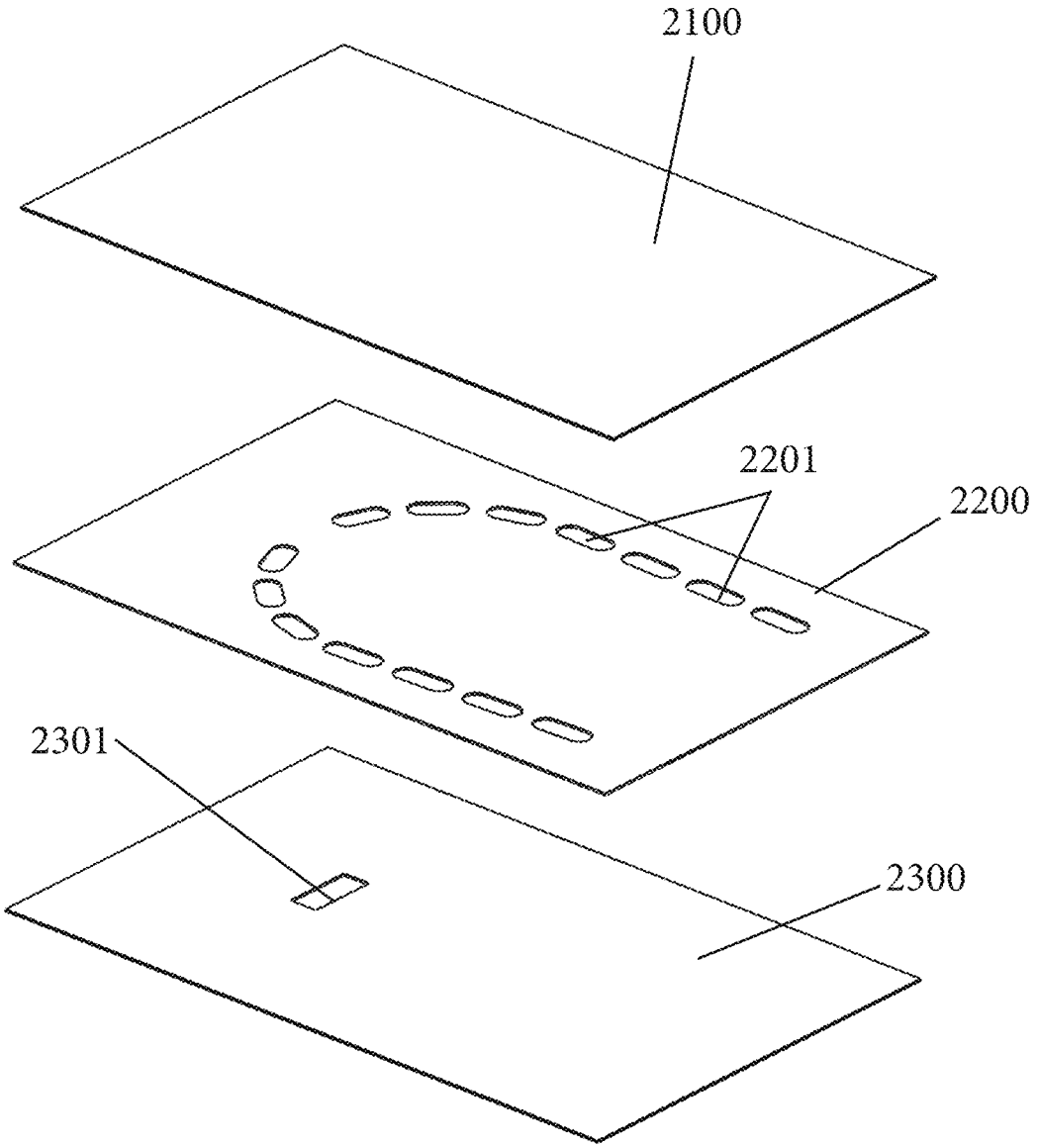
Figure 24:
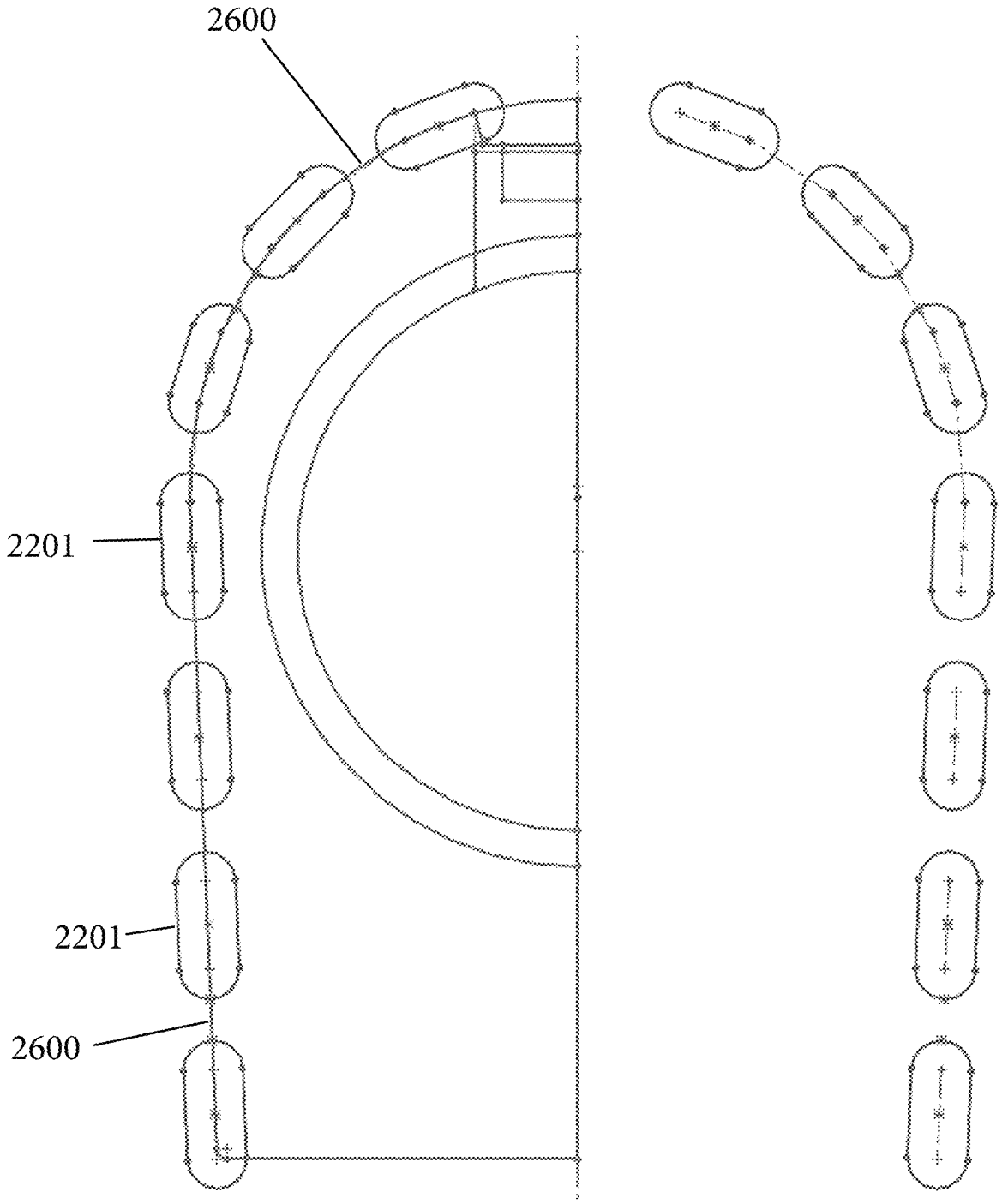
Figure 25:
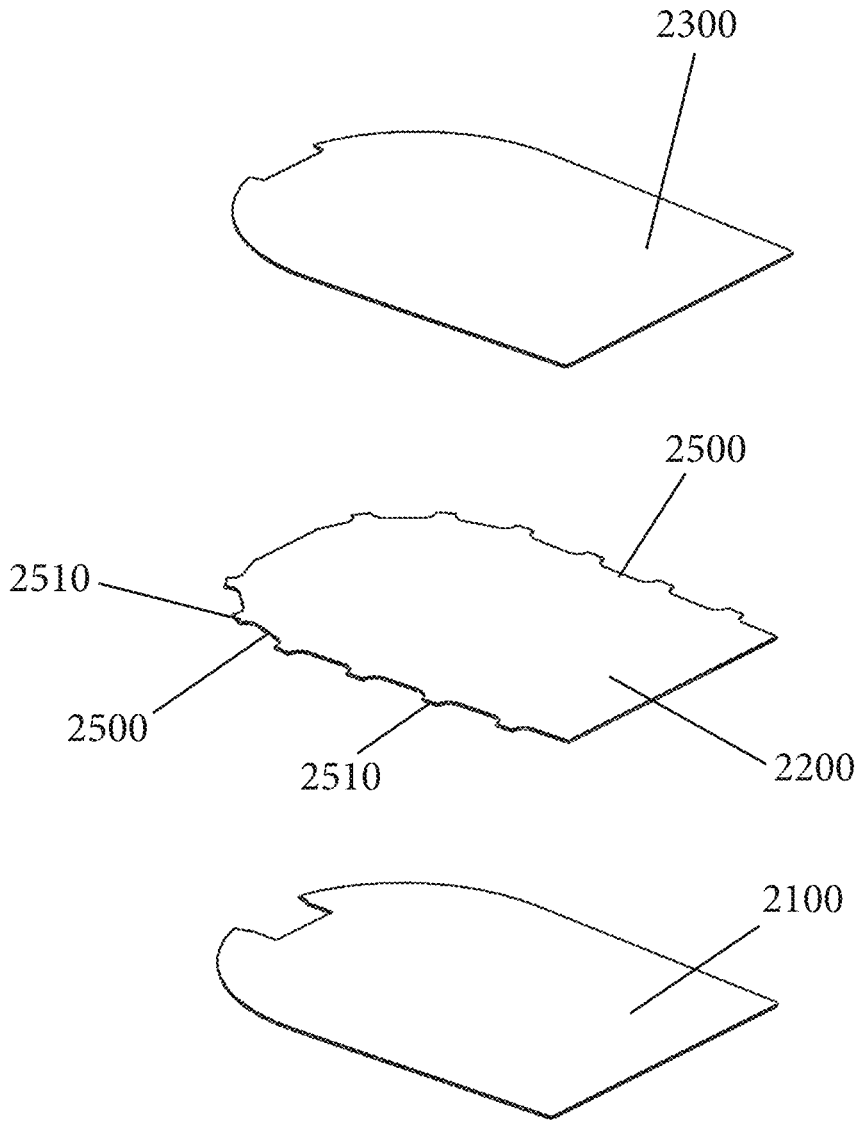
Figure 26:
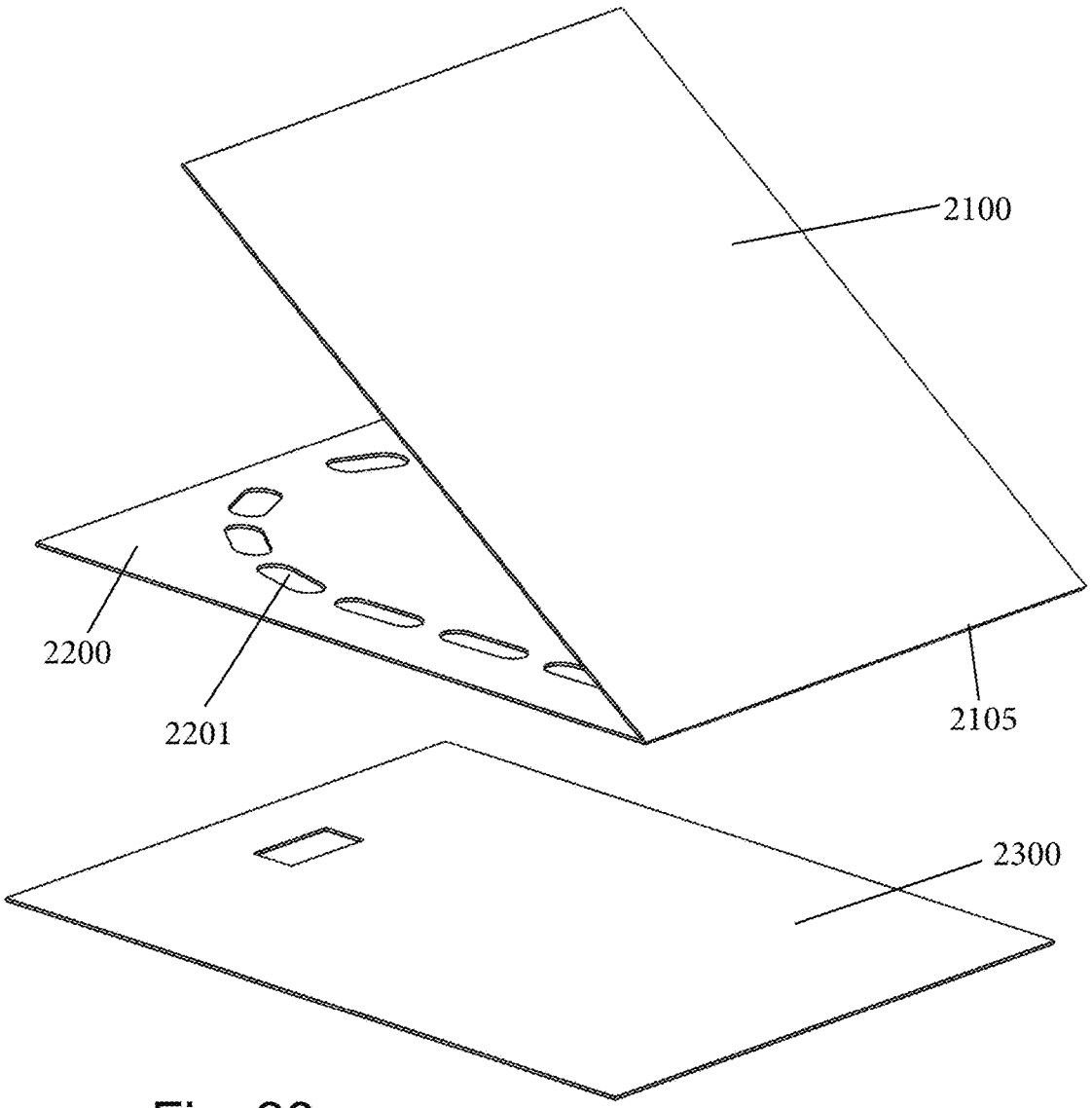
Figure 28:
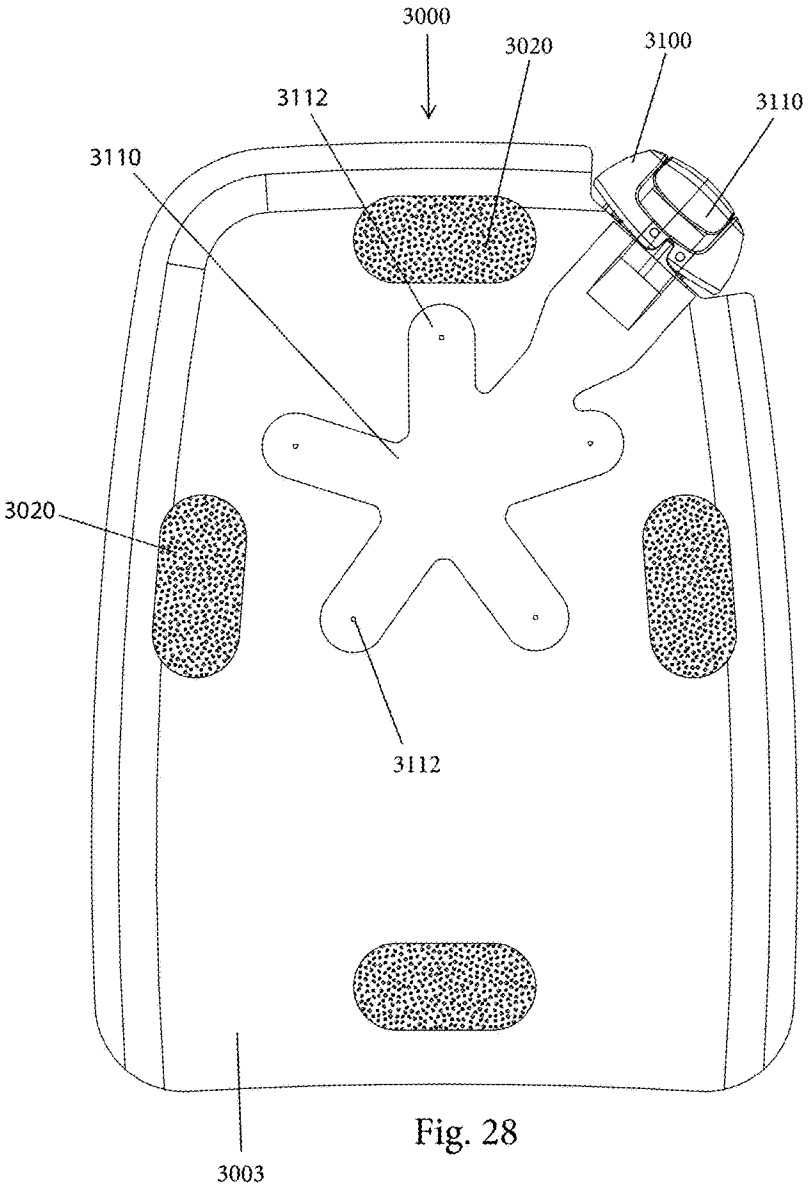
Figure 27:
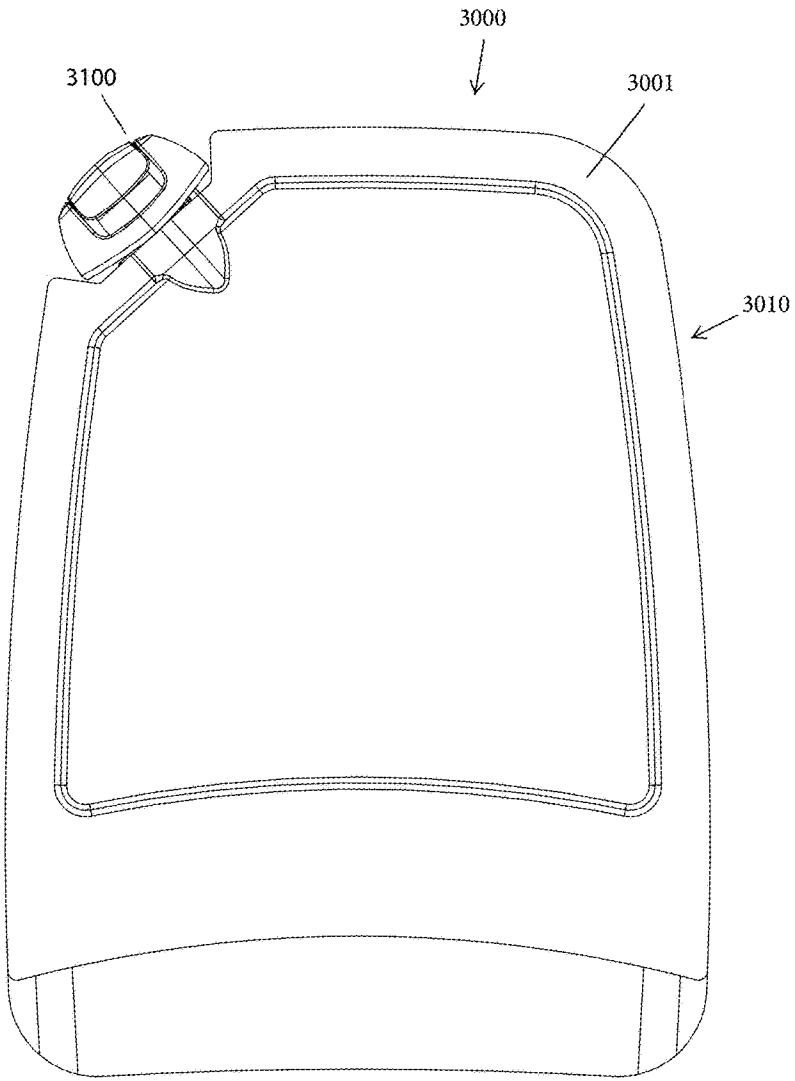
Figure 29:
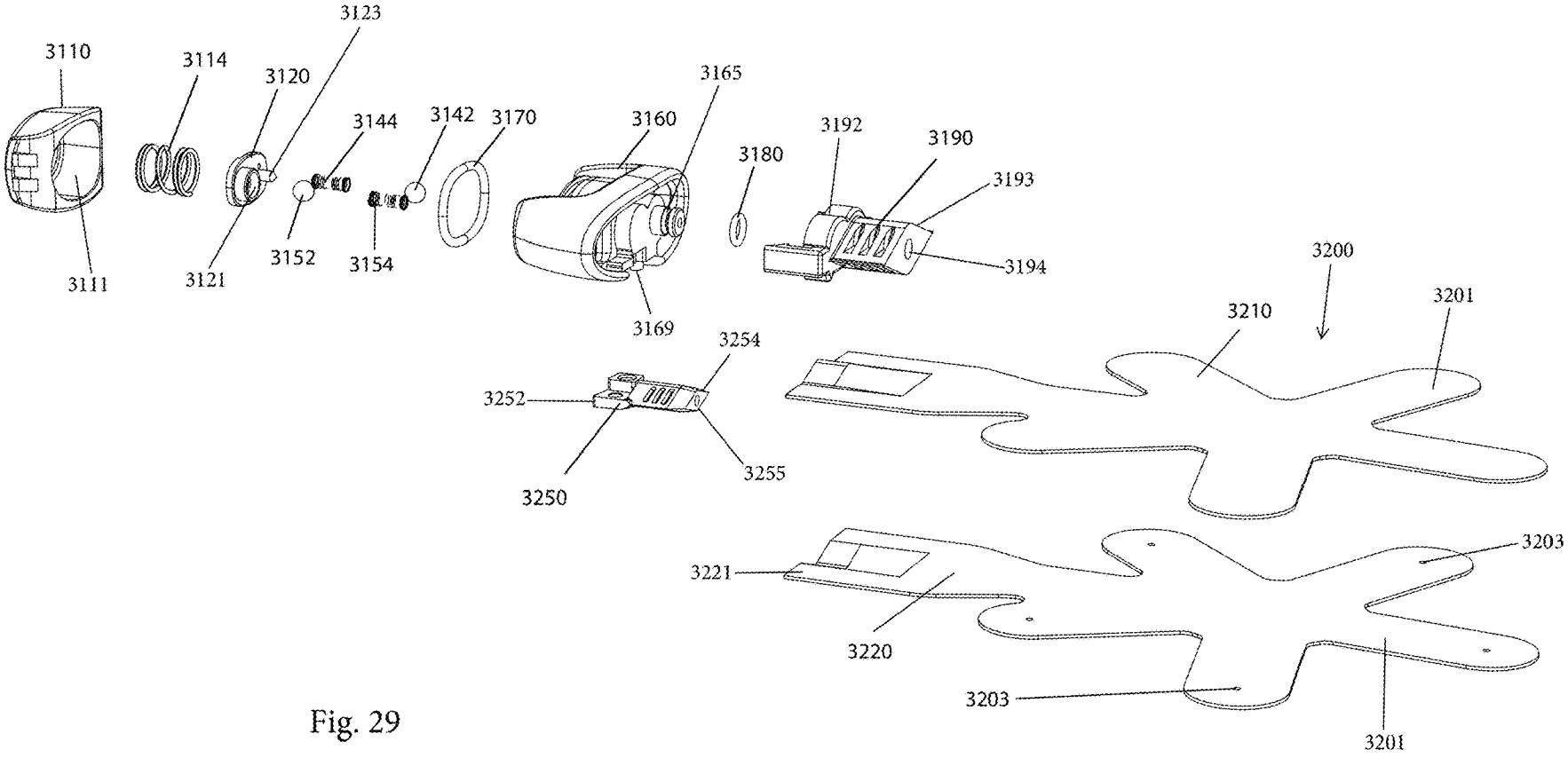
Figure 30:
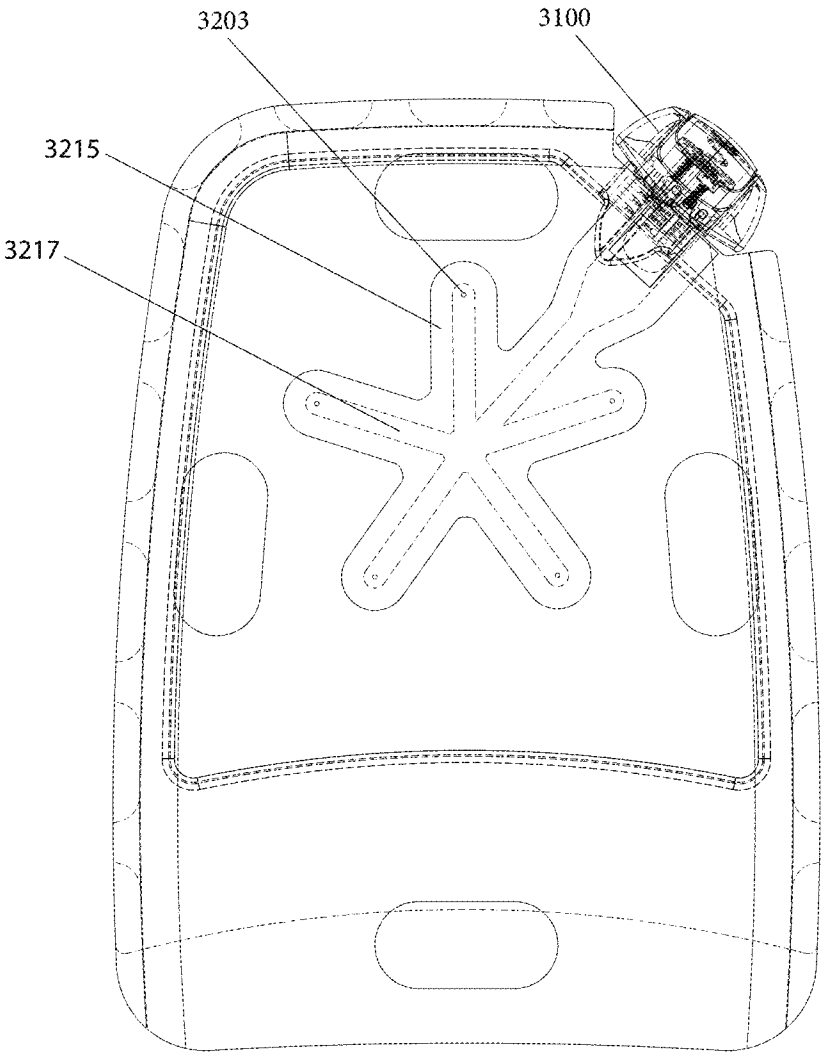
Figure 31:
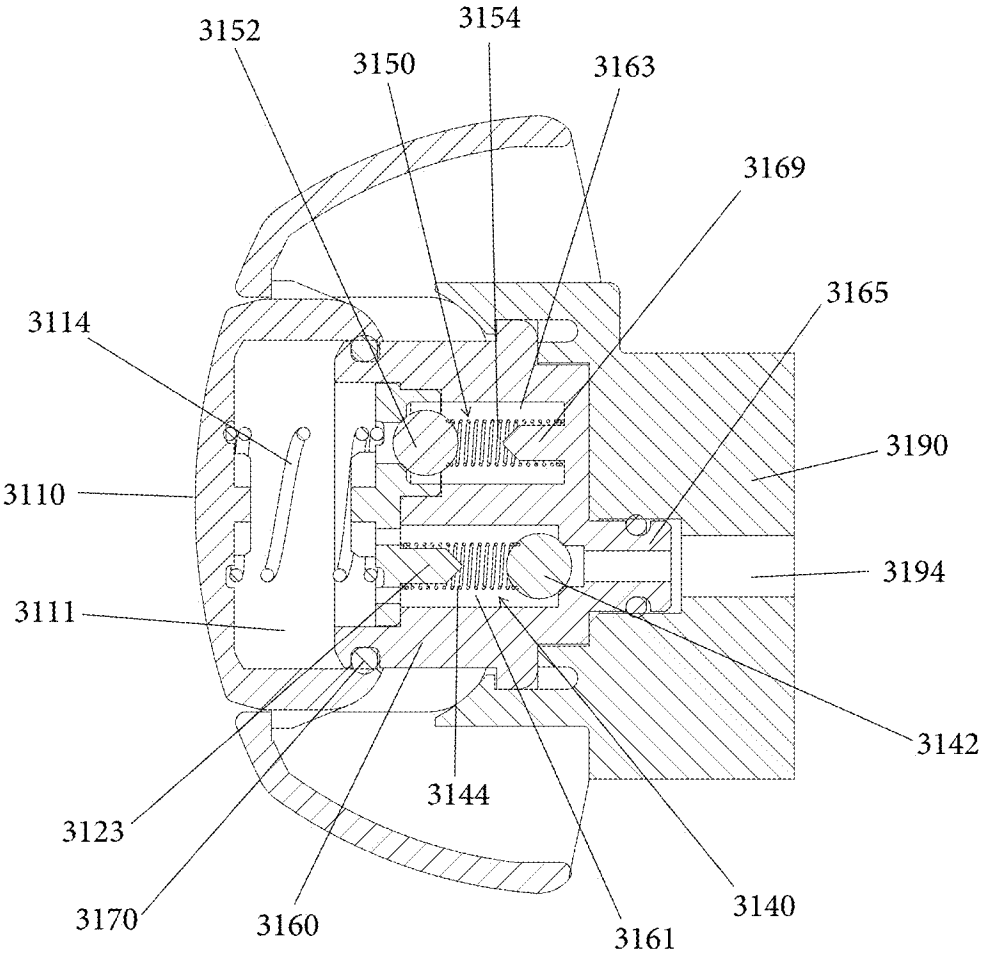
Figure 33:
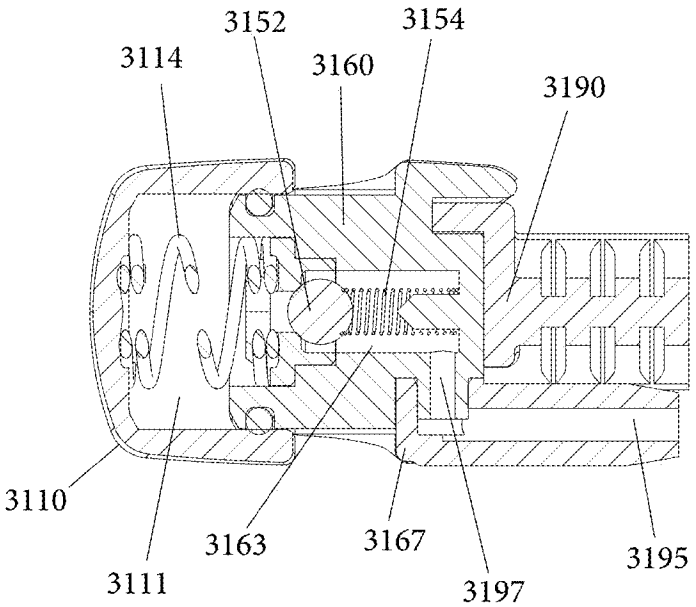
Figure 32:
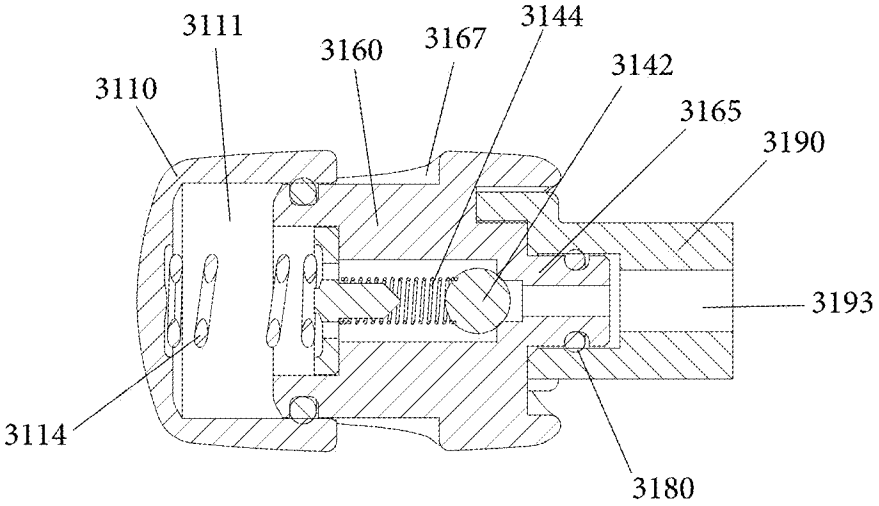
Figure 34:
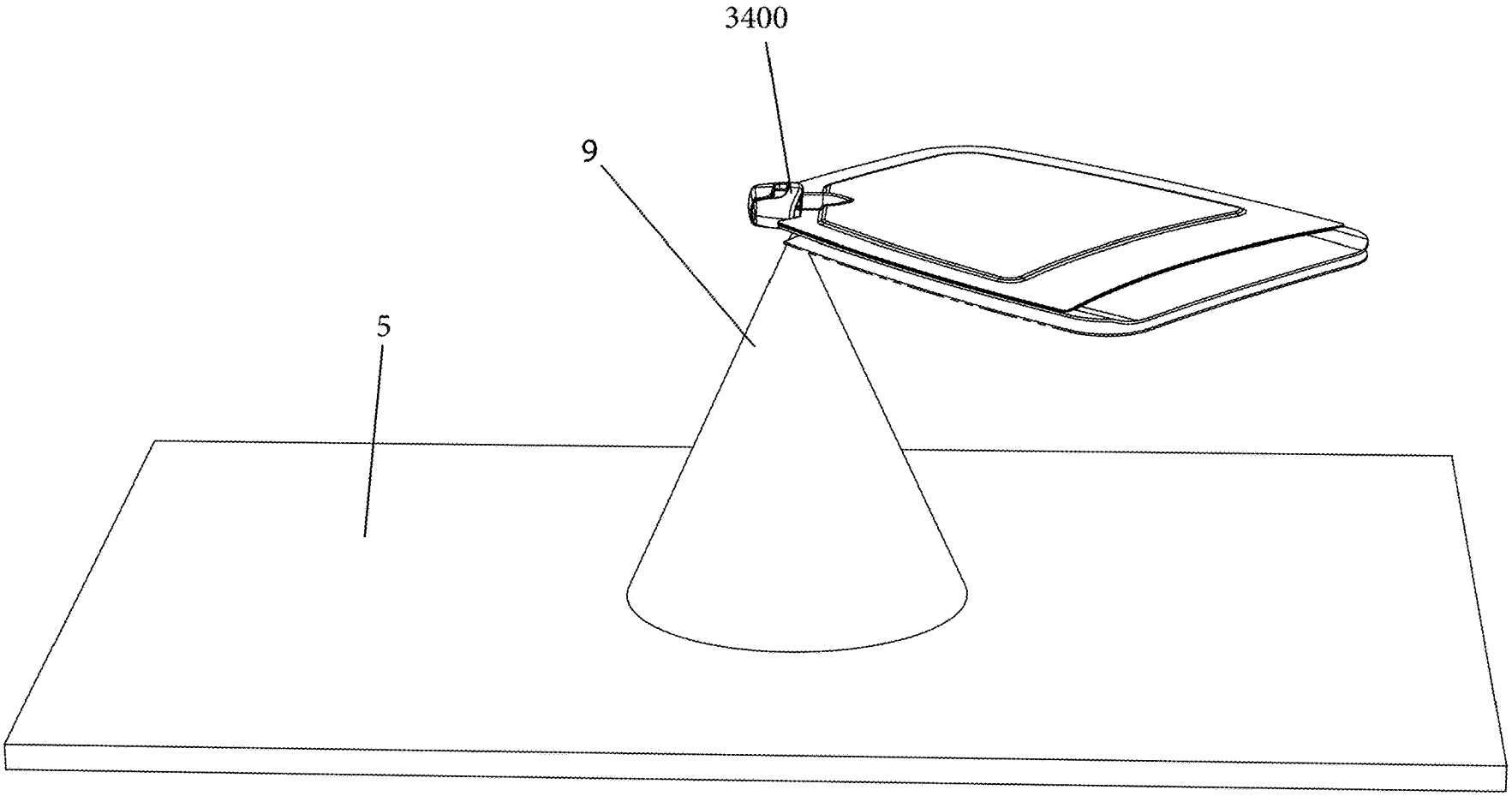
Figure 35:
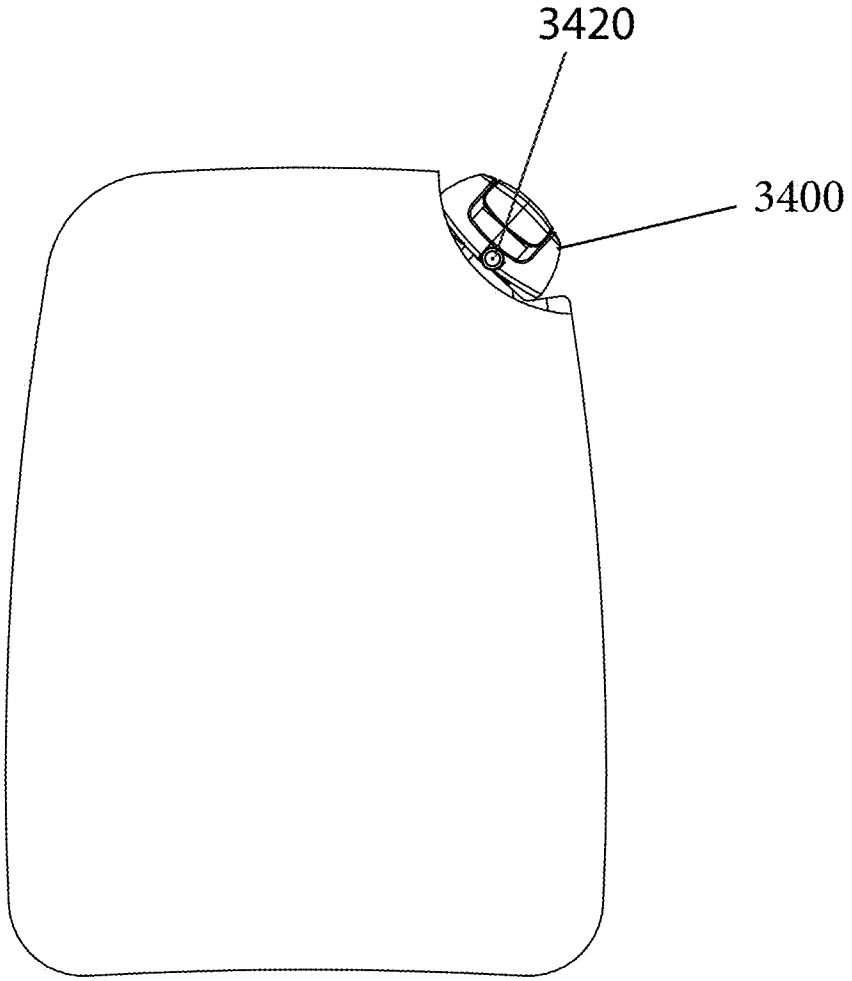
Figure 36:
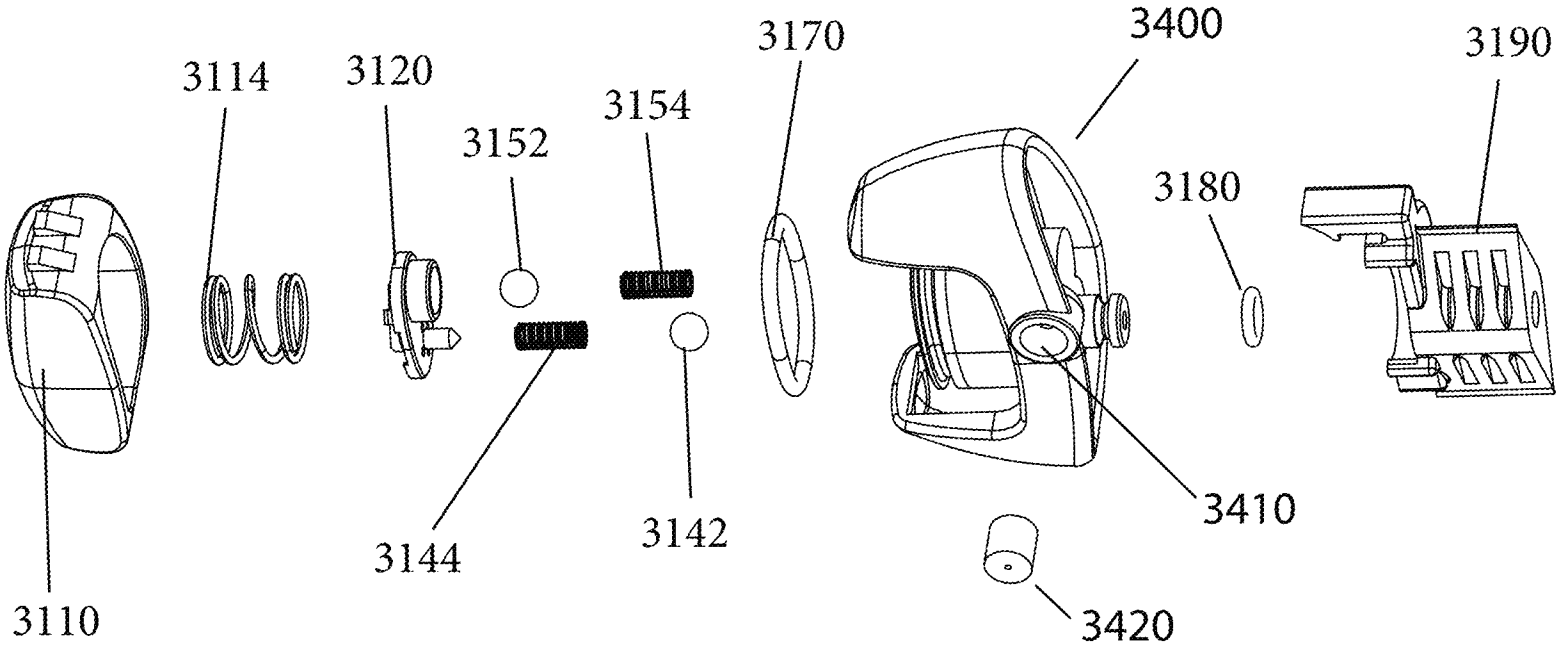

FIGS. 15A-C are views of a holder used as part of the fluid dispensing circuit;

FIG. 16 is an exploded perspective view of a pump mechanism according to yet another embodiment;

FIG. 17 is a top plan view of the pump mechanism of FIG. 16;

FIG. 18 is a cross-sectional view taken along the line 18-18 of FIG. 17;

FIG. 19 is a cross-sectional view taken along the line 19-19 of FIG. 17;

FIG. 20 is an exploded perspective view of the pump mechanism of FIG. 16 incorporated into a mitt assembly;

FIG. 21 is the completed mitt assembly of FIG. 20 showing the external face of the front panel;

FIG. 22 is an exploded perspective view of the three layers of a mitt assembly according to another embodiment and illustrating a method of manufacturing the mitt assembly;

FIG. 23 is an exploded perspective view of three blanks (three layers of material) that are processed to form the three layers of FIG. 22 that comprise the mitt;

FIG. 24 illustrates cutting lines that are used to guide a die cutting process to cut the three layers to form the mitt;

FIG. 25 is an exploded perspective view illustrating the three layers after the cutting operation is performed;

FIG. 26 is an exploded perspective view of another embodiment in which the second and third layers for formed of a single blank that has a fold line that defines the second and third layers;

FIG. 27 is a front elevation view of a fluid dispensing device in accordance with another embodiment;

FIG. 28 is a rear elevation view of the fluid dispensing device;

FIG. 29 is an exploded view of a pump assembly and dispensing (outlet) tube that forms part of the fluid dispensing device;

FIG. 30 is a rear elevation view in partial transparency to show the perimeter seal of the dispensing tube;

FIG. 31 is a cross-sectional view taken through the pump assembly;

FIG. 32 is a cross-sectional view taken through the pump assembly showing an inlet side of the pump assembly;

FIG. 33 is cross-sectional view taken through the pump assembly showing an outside side of the pump assembly;

FIG. 34 is a side perspective view of a fluid dispensing device in accordance with another embodiment showing a spray this is dispensed onto a target surface;

FIG. 35 is a rear elevation view showing a nozzle pump assembly with a nozzle; and FIG. 36 is an exploded perspective view of the nozzle pump assembly.

DETAILED DESCRIPTION OF CERTAIN EMBODIMENTS OF THE INVENTION

The present invention discloses a cleaning system which includes a mitt or glove into which the hand is inserted. The back side of the mitt structure includes a pouch comprising at least two layers of impermeable material so that a fluid reservoir may be provided at a location corresponding to the back of the hand. A pump subassembly, which is devised to momentarily capture a metered amount of fluid from the reservoir, is located in an unobtrusive location, such as the apex of the mitt. The apex is colloquially defined in this specification as the region just beyond the anticipated location of the middle finger when the hand is fully entered into the mitt.

A front panel, which can also be impermeable, is bonded to the pouch along the common perimeter of the two subassemblies. The bond does not encompass the entire perimeter, as an opening is necessarily left for the introduction of the user's hand. In the illustrated embodiment, the mitt component displays substantial bilateral symmetry along its medial axis, so that the mitt has an interior pocket shaped so that either hand may be comfortably inserted.

The pocket which receives the hand is therefore located between two constructions of sheet material that may be expected to differ in form and composition. The pouch and the front panel nevertheless have coincident contours about at least a part of their perimeters so that a bond may be formed along a suitable length of their shared outer edge profiles. The back-side pouch and the front panel are permanently joined, for example by thermal welding or other suitable techniques, to form the hand-receiving pocket of the mitt.

In its functional state, the back-side pouch, devised to be positioned over the back of the hand, comprises a substantially enclosed fluid-containing reservoir that remains functionally separate from the pocket into which the hand is inserted. The reservoir may occupy a region that is limited to an area inset from a large part of the outer perimeter of the pouch.

Laminated stock commonly used in the soft packaging of fluids often includes a heat-sealable polymer layer on one face. This allows the material to form a hygienic sealed enclosure when the stock is fused to itself, or to another compatible material.

The structural configuration described above, in which the reservoir is inset from much of the perimeter, allows the inner panel of the pouch to be fused to the outer panel, while leaving a margin of fusible surface to be left so that a further assembly may occur. In the illustrated embodiment of the invention, this margin is employed to bond the pouch to the front panel of the mitt.

These sealing operations may be performed locally in such a way that an opening is left in the enclosed pouch volume. This may occur at an elongate neck that has fluid access to the reservoir.

At the location of this opening, a sealable filling port may be provided to allow a temporary fluid inlet to the reservoir. The reservoir can be filled any time after the pouch has been formed, which may be either before or after the front panel of the mitt has been attached.

The front panel, devised to be located over the palm side of the hand, can be compatibly devised of a closed cell foam material that is substantially impermeable to the fluid held in the reservoir. The external face of the front panel is provided with reversible attachment means for the intermittent (selective) use of the disposable cleaning pads. The attachment means may include, for example, regions bearing arrays of hooked structures. These hooked structures can be carried upon a prefabricated tape or fabric that is permanently affixed to the external face of the front panel.

The disposable cleaning pads have an internal side and an external side. The internal side may compatibly include looped textures that engage with the hooked regions so that a secure but temporary connection may be made between the external side of the mitt face and the internal side of the cleaning pad. The looped property can be intrinsic to one face of a nonwoven sheet material used in the makeup of the pad. In other words, a hook and loop type mechanical coupling can be used to releasably secure the cleaning pad to the external face of the front panel.

A pump subassembly is disposed intermediate between the back-side reservoir and the external face of the mitt. The pump subassembly is attached to the pouch in such a way that selective fluid communication is allowed between the substantially enclosed reservoir of fluid within the pouch and at least one port accessing the face of the mitt. In the invention, the pump subassembly includes a displaceable interface, such as a deformable elastic membrane, so that a user may actively dispense fluid to the external face of the mitt, or, more comprehensively, between the external face of the mitt and a mounted disposable cleaning pad.

The system of the present invention can also encompass a cooperatively designed enclosure which can be used to carry a mitt and a set of pads. The enclosure can usefully include an internally concave conforming surface having an external wall only slightly greater in extent than the perimeter of the disposable pads. A wall of the enclosure can also include an indentation anticipating the placement of a user's wrist.

After use, the soiled pad can be removed and replaced with a fresh pad. The soiled pad may be immediately discarded. However, it is also envisioned that the soiled pad may be returned to the enclosure, but kept apart from the clean pads by an impermeable separator of a shape similar to that of the pad itself. This feature is advantageous, for example, when the user is in a remote environment where an appropriate disposal method may not be readily available.

Figure 1A:
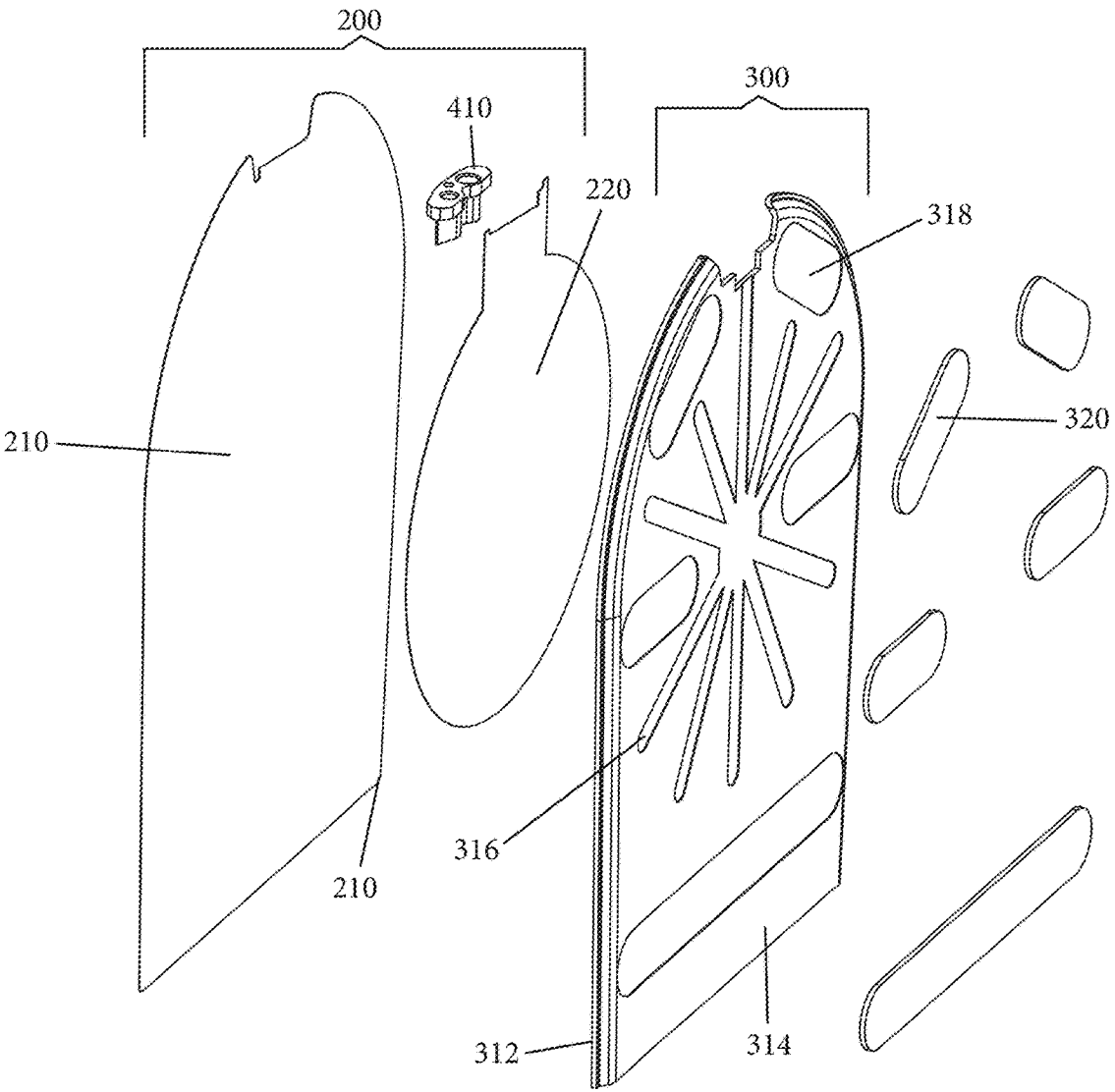
FIG. 1A is a front exploded perspective view of the pouch subassembly, and the front panel assembly of the mitt along with a portion of the pump subassembly.
Figure 1B:
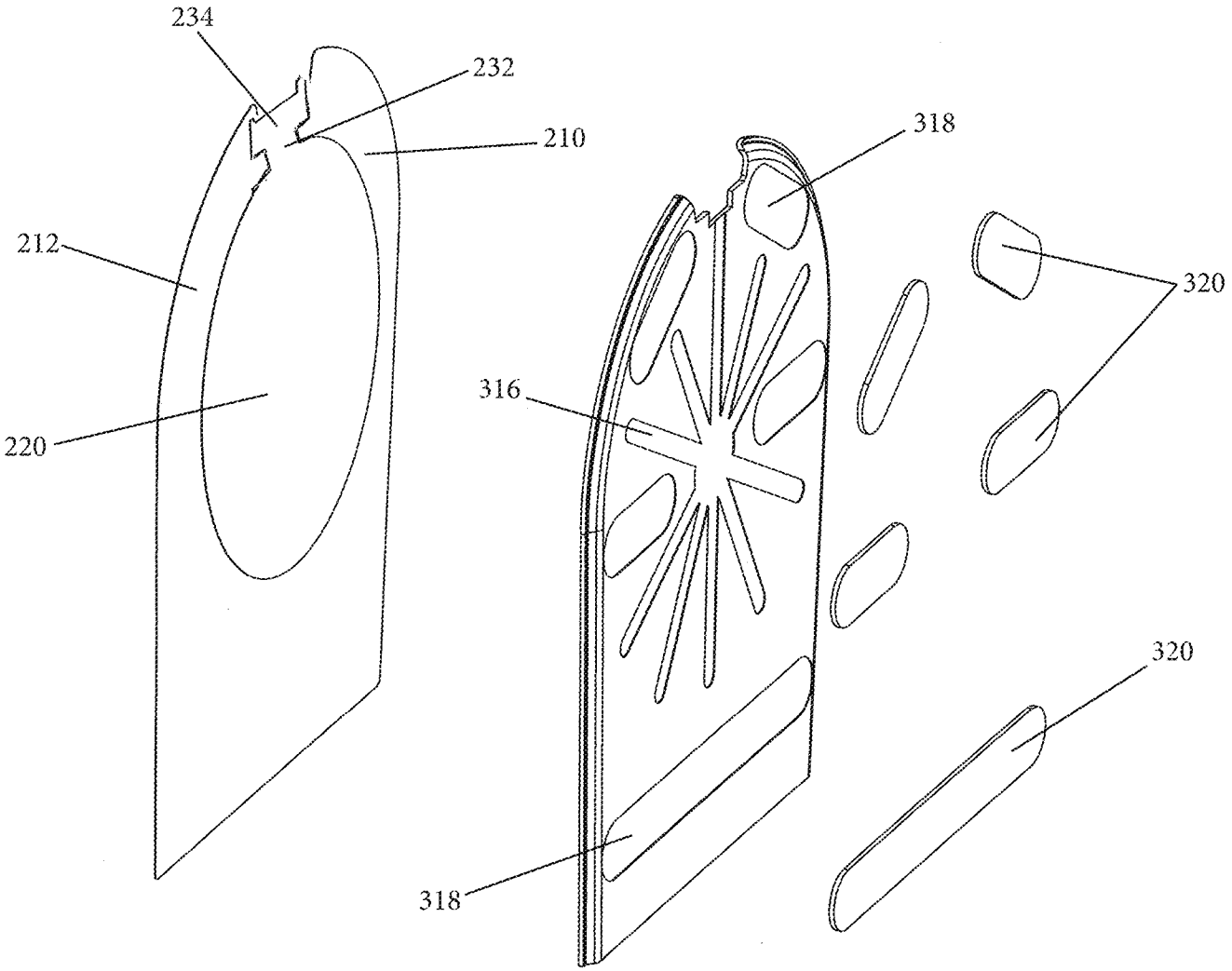
FIG. 1B is a front exploded perspective view of the pouch subassembly, showing the formation of the fluid reservoir.
Figure 2:
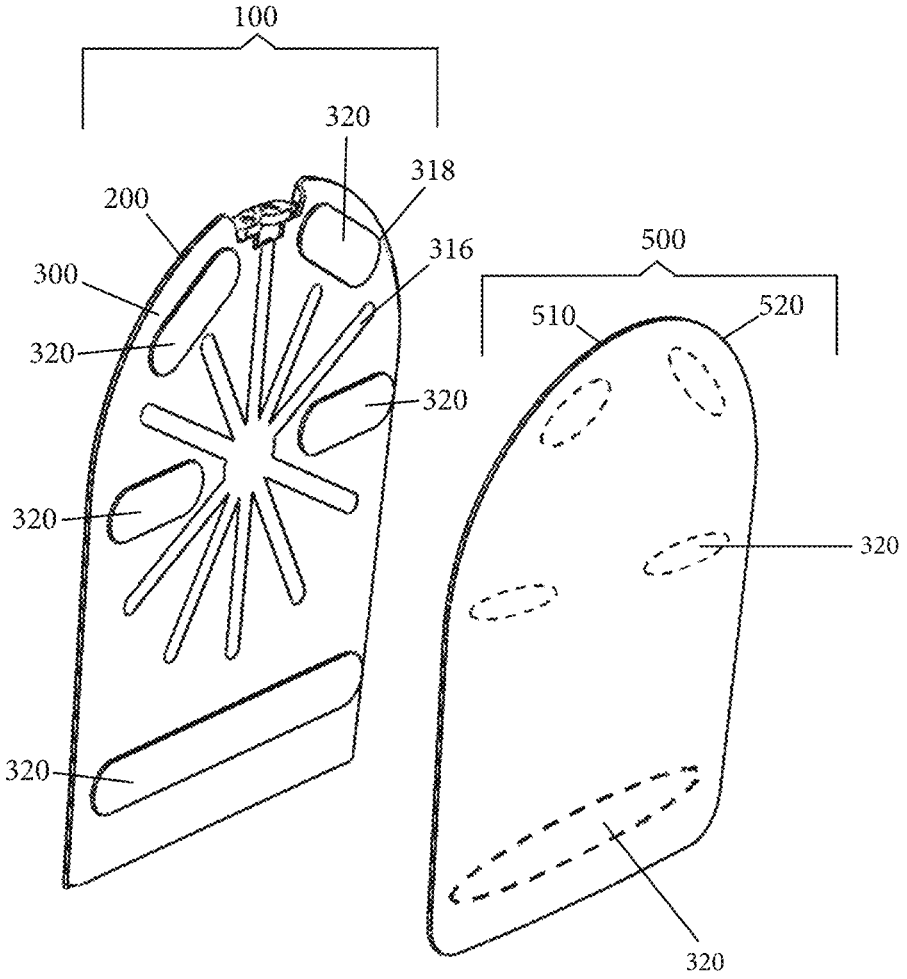
FIG. 2 is a front exploded perspective view of the pouch, front panel, and pump components joined to form the mitt assembly and showing the relative position of a pad.

The perspective views of FIGS. 1A, 1B, and 2 generally describe mitt assembly 100, which includes three subassemblies according to one embodiment. In the following discussion, further reference may be made to the plan views of the mitt in FIGS. 3, 4 and 5. Two subassemblies form a mitt between which the user's hand is ultimately inserted, and a third provides an intermediate pump for fluid. It will be understood that the construction of the system using the subassemblies disclosed herein is merely exemplary in nature and other constructions including other sub-assemblies and combinations thereof can be used.

More specifically, pouch subassembly 200 typically includes the elements that retain the cleaning fluid, while front panel subassembly 300 typically includes an impermeable, resilient face to which fluid may be dispensed, and onto which fluid-permeable pads may be attached. The third subassembly, pump subassembly 400, provides a means to covey (transport) fluid from the back reservoir to the front panel in a regulated manner. The details of the pump subassembly are best understood by reference to FIGS. 6, 7, and 8.

Figure 3:
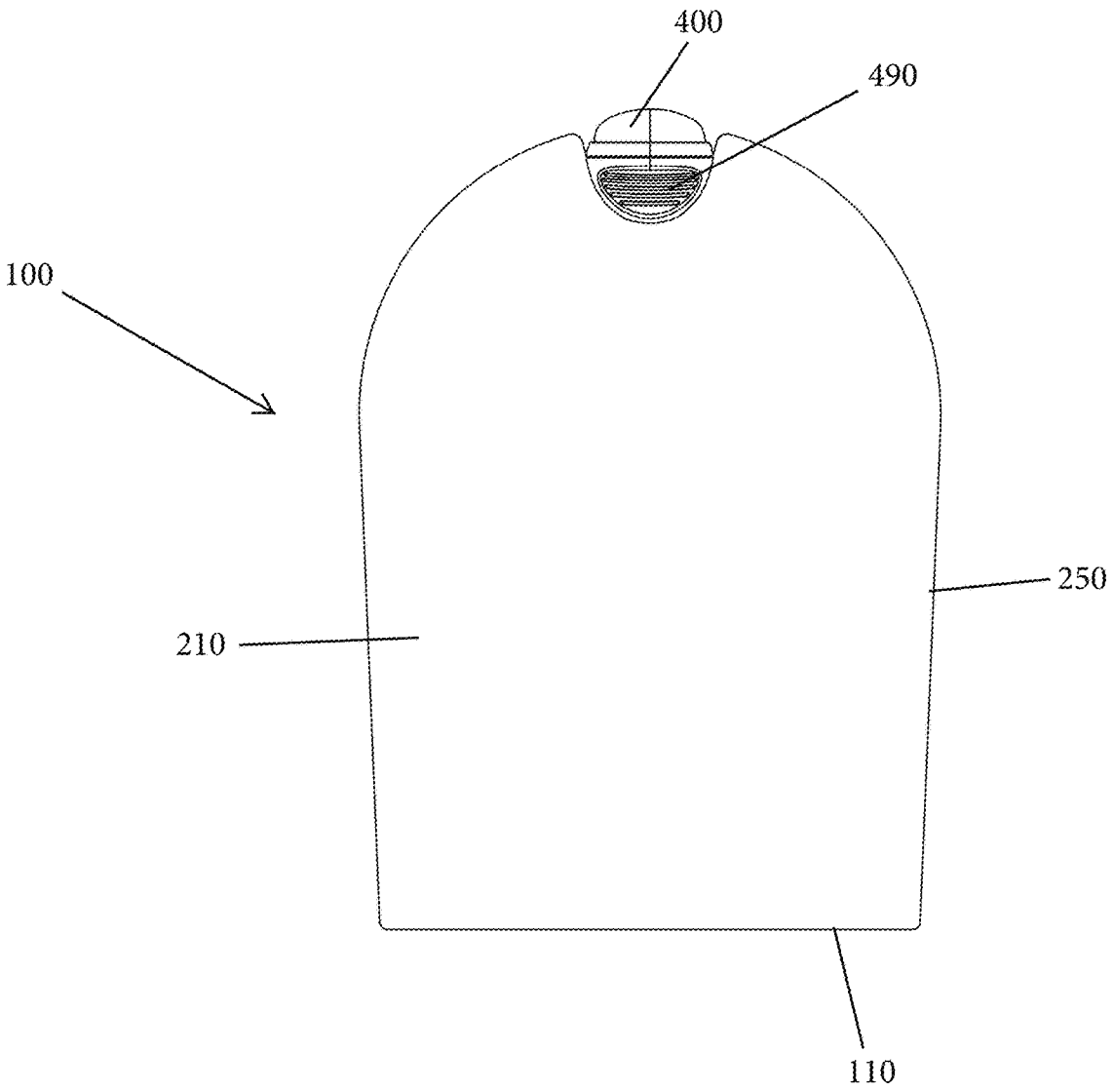
FIG. 3 is a plan view of the completed mitt assembly showing the back face of the back-side pouch, and showing the location of the fluid reservoir.
Figure 4:
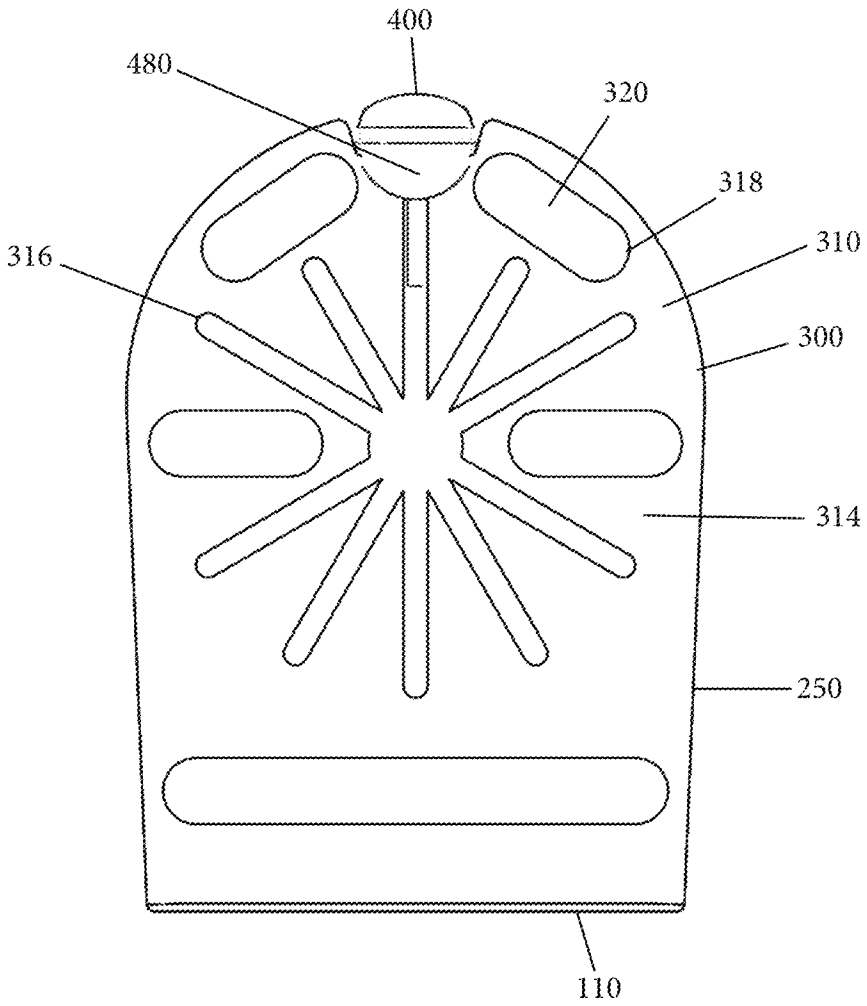
FIG. 4 is a plan view of the completed mitt assembly showing the external face of the front panel.

It will be understood by reference to FIGS. 1A, 1B, and 3 that the pouch is integrated into the structure of the mitt such that it may reliably retain a supply of fluid. The pouch is therefore typically made of materials selected to be substantially impermeable to the anticipated fluid supply. The selection of the pouch material may depend upon the elected fluid formulation. In any event, the pouch holds the fluid to be dispensed.

Materials for the fabrication of pouches, packs, bags, or other flexible, sealed fluid-carrying containers are widely available for the packaging of drinks, foodstuffs, condiments, cosmetics, pharmaceuticals, and medical supplies. These commonly include an outer polymer layer, and intermediate foil layer, and an inner polymer layer having a lower melting point than the polymer used in the outer layer. These layers can be laminated using an adhesive, or by heat and pressure.

Once laminated into a multi-ply film, such materials can be assembled into inexpensive, relatively unbreakable vessels by placing the inner surfaces in a facing relationship, and locally heating a perimeter while applying pressure.

Polyester (PET) is often used as an outer layer. PET provides strength and has a high melting point. Ink may electively be reverse-printed in one or more steps on the inside of this PET layer. Oriented polypropylene (OPP) may also be used. When printing is performed on internal surfaces prior to lamination, the printing is captured under a transparent film layer in such a way that condensation and handling do not mar the imagery.

Foil is often used as an internal barrier, either as discrete foil layer, or as a thin foil vacuum metallized onto an intermediate film layer such as polyester (MPET). Foil is an effective barrier to oxygen, evaporation, and light. Other intermediate-layer barrier materials include Saran coated Polyester (KPET), and ethylene vinyl alcohol copolymer (EVOH).

Linear low-density polyethylene (LLDPE) often constitutes the fusible inner layer. LLDPE provides an additional moisture barrier, and has a relatively low melting point. Amorphous poly-alpha-olefins (APAO) may also be suitable for the inner fusible layer. Regardless of its exact composition, it is this innermost layer that is locally melted in the process of forming a heat-welded seal, seam, or joint.

The pouch subassembly may be formed using such multi-ply packaging material, and may be variously decorated or provided with other visual information. Pouch subassembly 200 includes pouch outer blank 210 and pouch inner blank 220. The pouch is assembled from two facing plies of suitable laminated film material. As shown in FIG. 1A, in the initial pre-fabrication state, the outer blank 210 and the inner blank 220 are in the form of at least substantially flat structures (i.e., flat layers of film material).

In the illustrated example, pouch outer blank 210 is devised to have a greater extent than pouch inner blank 220, so that when they are positioned with their fusible surfaces in a facing relationship, an exposed margin of fusible surface is allowed around pouch inner blank 220. Pouch outer blank 210 may, for example, carry branding, imagery, descriptions, or instructions, and may exhibit an ornamental finish owing to a foil or metallized inner ply.

Pouch inner blank 220 has a perimeter that outlines the expected volume of the fluid reservoir, but has a significantly smaller area than outer blank 210 as will be appreciated by viewing FIGS. 1A and 1B. Outer margin 212 of pouch outer blank 210 may be subsequently joined to a further material, owing to the residual exposed surface of fusible polymer. Outer margin 212 is indicated as the area outside the perimeter bonding between the blanks 210, 220 and thus, corresponds to an area or space exterior to pouch inner blank 220.

Three distinct volumetric features are formed by the joining of pouch outer blank 210 and pouch inner blank 220. The joined blanks define anticipated fluid reservoir 230, shown in FIG. 3. In the illustrated application of the invention, the reservoir is circular and is devised to accept a filled volume of 65 ml.

Pouch reservoir neck 232 extends in one direction from the pouch reservoir. The neck provides narrow directional channel so that flow may be induced when, in the use of the completed system, the user imparts pressure to the filled reservoir.

Pouch mouth 234 expands from pouch reservoir neck 232 and provides an opening into which seal coupling 410 may be fitted with a degree of ease prior to the joining of the components by the application of heat (as shown in FIG. 1A, the top edge of the outer blank 210 includes a cutout to accommodate the seal coupling 410). These volumes may optionally be preformed to a three-dimensional shape, but they may also be simply and adequately formed into a volume by the internal pressure against the loose pouch material upon its filling with fluid.

Front panel subassembly 300 includes front panel 310 formed of resilient material. Closed-cell polyethylene foam stock having a thickness of about 1.5 mm has been found to yield a compact, comfortable, and impermeable surface. Front panel 310 is provided with a contour similar to that of pouch outer blank 210, and front panel inner face 312 and front panel outer face 314.

The front panel may carry a series of embossed irrigation channels 316 which ultimately promote the distribution of a dose of fluid over the surface of the front foam panel. In the exploded view in FIG. 1A, it may be seen that front panel outer face 314 also carries embossed fastener recesses 318 that anticipate the mounting strips of hooked, reversible fastening material. The recesses allow for less intrusive mounting of the fastening material.

The embossed irrigation panels may be conveniently formed in the same thermal operation in which front panel 310 and pouch subassembly 200 are welded together. A platen may be applied to melt the perimeter of fusible inner ply of pouch outer blank 210, while at the same time heating and partially and locally compressing the closed cell foam of panel 310. Pouch subassembly 200 and front panel 310 are joined at mitt edge weld 250 in a discontinuous manner such that an opening is left between the pouch and front panel along hand entry 110. Typically, this hand entry point is located along the bottom edge of the joined structure.

Hook fastener strips 320 are cut to length or die-cut to shape and attached to the outer face 314 in a range of locations. In the illustrated embodiment, five hook fastener strips 320 are attached in positions somewhat inset from the edge of front panel 310 and near the extremities of the anticipated disposable pads. The hook fastener strips may be attached, for example, using a pressure-sensitive adhesive or a hot melt adhesive. The assembled pouch and front panel subassemblies are shown in FIG. 2 (in FIG. 2, the complete pump subassembly 400 is not shown but instead, the seal coupling 410 is shown).

It will be appreciated that while, elements 320 are referred to herein as hook fasteners strips and the pad has complementary loop fastener features (generally indicated at 321) (either attached thereto or integral therewith as a result of the type of material the pad is made from), other fasteners can be used instead for elements 320, 321. In FIG. 2, the pad 500 is formed of a material that has loop features and therefore, the regions 321 merely indicate areas of the loop material that mate with hook strips 320. In the embodiment where the pad 500 has separate loop fasteners, such as strips or pads, then the legends 321 represent such strips or pads.

Alternatively, the fasteners 320 can be in the form of snaps or other mechanical fasteners. It being understood that the front panel 310 and the pad 500 have complementary fasteners (e.g., snap parts) to allow for the detachable connection between the two structures. In the present figures, the texture of pad 500 has not been shown for ease of illustration; however, it will be appreciated that pad 500 can be formed of a fabric and can have a loop structure (non-smooth) structure as described herein.

Figure 6:
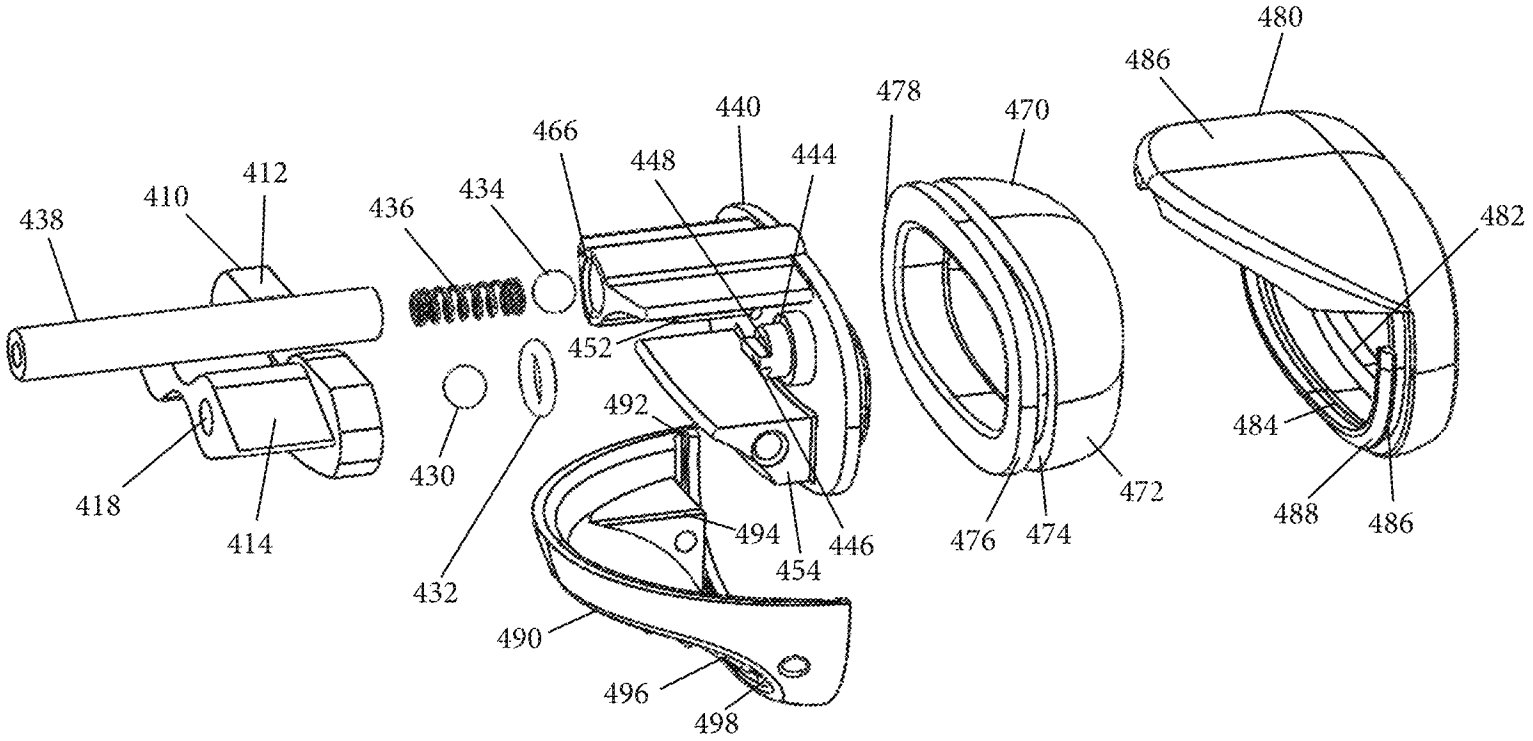
FIG. 6 is an exploded view of an exemplary pump subassembly.
Figure 7:
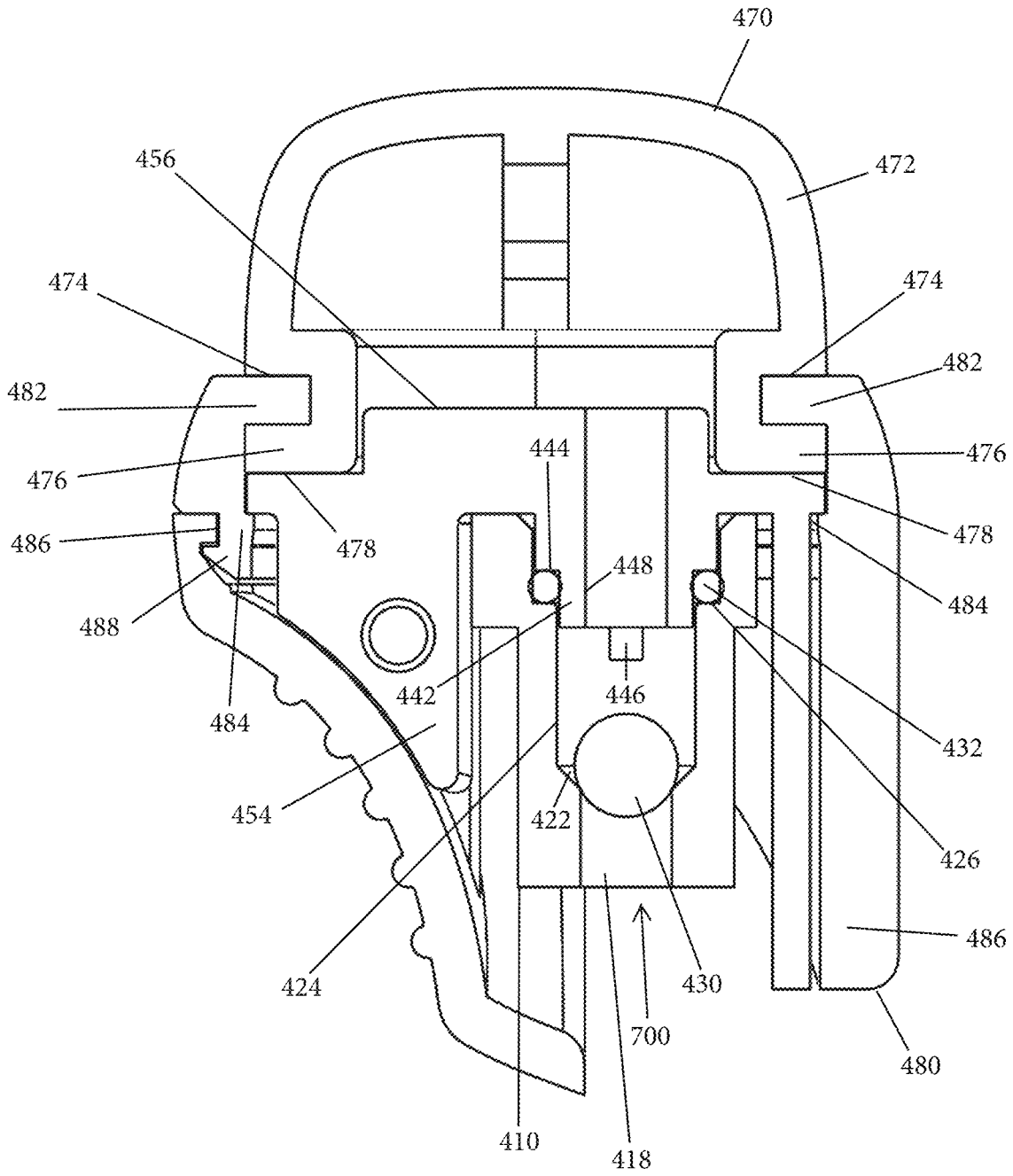
FIG. 7 is one cutaway sectional view of an exemplary pump subassembly, showing details of the inlet check valve.
Figure 8:
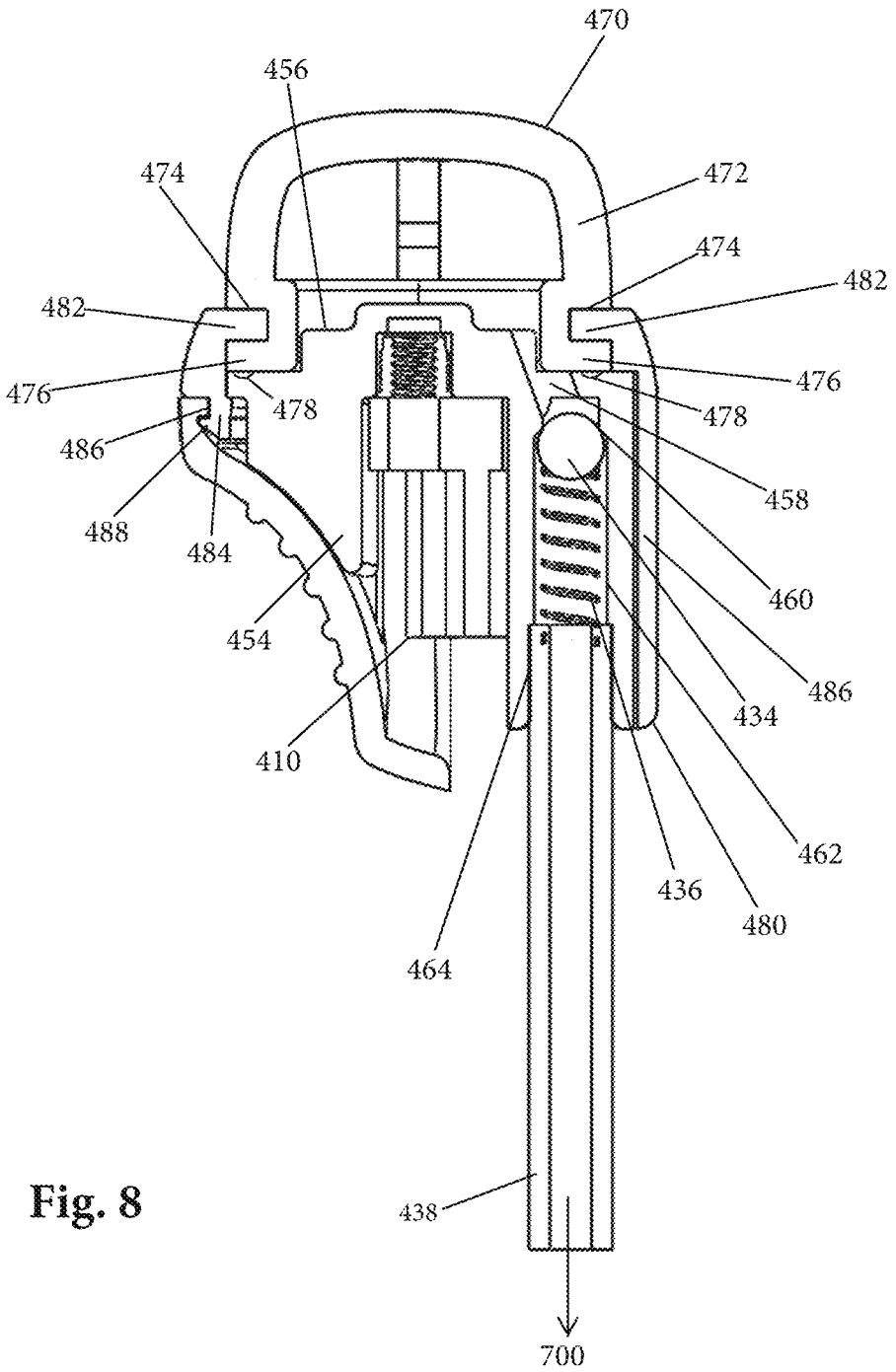
FIG. 8 is another cutaway sectional view of an exemplary pump subassembly, showing details of the discharge check valve.

Fluid is to be transported from the back of the mitt to the front by pump subassembly 400. The details of the pump subassembly are shown in FIGS. 6, 7, and 8. Owing to an integral set of valves, the pump subassembly is able to receive and temporarily trap a metered volume of fluid within an elastic bulb.

When the bulb is compressed by an external action, at least a portion of the trapped volume of fluid will be delivered to the front face of the mitt. In the configuration illustrated embodiment of the invention, fluid is ejected in a direction approximately opposite to that of the induced pumping action. In other words and as described herein, the pump is constructed such that fluid is drawn into the pump from the reservoir by flowing in a first direction and then is ejected from the pump by flowing in a second direction opposite the first direction; however, the first and second flows are at least substantially parallel to one another.

The exploded view of the pump in FIG. 6 illustrates the major components of the pump subassembly. The larger parts of pump subassembly 400, in addition to seal coupling, include pump manifold 440, pump bulb 470, pump housing 480, and pump back cover 490. These parts snap, clamp, or wedge together to form a substantially leak-proof pumping means.

The subassembly also includes a small set of functional elements that are entrapped or otherwise during assembly, including intake check ball 430, intake O-ring 432, discharge check ball 434, and outlet check spring 436. The fluid delivery path provided by the pump subassembly terminates at dispensing tube 438.

In the following description, it should be understood that the pump subassembly, except for seal coupling 410, may be preassembled into a working module that is then snapped into place over the seal coupling after the seal coupling has been welded to the pouch.

Seal coupling 410, pump manifold 440, pump housing 480, and pump back cover 490 may conveniently be injection-molded of suitable polymers. Pump bulb 470 and intake O-ring 432 may be formed of compressible elastic material such as rubber, silicone, or polymeric elastomer. In the current embodiment, a thermoplastic elastomer having a durometer of 60 on the Shore A scale has been found effective.

Outlet check spring 436 may be a metal compression spring made of a suitable ferrous or nonferrous alloy, but may also be variously devised of plastic.

Seal coupling 410 is fashioned so that it may be readily and securely bonded to the outlet of pouch reservoir neck 232 (in other words, the seal coupling is disposed between the two blanks 210, 220 that are bonded to one another). It has been demonstrated that reliable, leak-proof joint may be achieved by thermally sealing pouch material to a compatibly devised coupling. Subsequently, the attached coupling can serve to form a rigid base to which other molded parts may be attached. FIGS. 1A and 1B show this arrangement.

It will be appreciated that the joined blanks 210, 220 (see FIG. 1B) define the reservoir and when the reservoir is filled, the blanks 210, 220 will naturally pucker (expand/protrude)

in this region. Thus, from the rear of the assembled product, the outline of the reservoir may be visible. It will be understood that the shape of the reservoir can vary and the generally circular shape that is shown is not limiting.

Molded pouch couplings often exhibit a wedged or tapered edge at either end, so that the pouch layers are gradually parted by the coupling, and so that the parted layers can wrap with sufficient conformity over the coupling ends that no leakage occurs at the location where the two pouch layers are parted. Such couplings are therefore often most commonly widest at their center.

In the invention, such a design was found to be suboptimal, since, within the requirements of the anticipated application, the conventional design inherently results in a relatively thick and intrusive section. During personal cleaning, it is essential that pump subassembly remain clear of the body surface, both for comfort and continuity of operation.

In the invention, the outer aspect of the pump must therefore both optimally have an unobtrusive shape, and ideally outer should have surfaces that readily deflect in the case of inadvertent contact with the user's body. These considerations have been incorporated in the design of the present invention.

For example, the seal coupling is designed to provide a secure connection surface for the pouch, while maintaining a minimal thickness in the dimension perpendicular to the major plane of the mitt. As a uniform design principle in systems where a connector is joined to such a pouch, the length of each side of the sealed pouch connection must correlate with the measured length of the curve along each side of the molded connector.

If the pouch is made to rest in an intermediate flat state, without folds or buckling, the length of the two sides of the neck opening must be substantially the same. For conceptual simplicity, the portion of the connector that extends into the neck of the pouch therefore is generally made to be bilaterally symmetrical about the major plane of the unfilled pouch.

The seal coupling may be fabricated of any effective polymer, however, it may be appreciated that low-density polyethylene has an inherent affinity with materials commonly used for the fusible inner layer of the laminated pouch film stock. The remaining rigid pump components may be formed of polyethylene or other moldable thermoplastic polymer.

Seal coupling 410 includes seal coupling collar 412 from which bilobate coupling extension 414 extends. In view of the foregoing discussion, it may be appreciated that the bilobate sectional profile of seal coupling extension 414 provides the inserted part an especially low profile, owing to the waist at its center, while still conforming to the design constraints cited above.

Furthermore, while the relevant section of the part is shown as being bilaterally symmetrical in two perpendicular axes, it may be appreciated that the two curves that converge at the tapered edges of coupling extension 414 may be freely and electively varied in curvature to optimize the overall compactness, convenience, or comfort of all the elements of the fluid transport system.

It may be appreciated that, in order to conform to the requirement of forming a seal without buckling or folding of the pouch, the two sides of the seal coupling extension must only be equal in total length. The contours of the two sides may therefore depart from one another in local concavity or convexity of curvature, so long as their total length is substantially equal.

The structure and function of the intake components of the pump may be best understood by concurrent reference to FIGS. 6 and 7. The inward direction of fluid flow is indicated by the arrow suggesting motion of fluid 700. In the illustrated example, one lobe of the bilobate coupling extension 414 includes blind alignment hole 416. The second lobe encompasses seal coupling intake port 418. Intake port 418 is a through-hole which allows fluid to exit the neck of pump and enter the pump subassembly. Intake port 418 widens in diameter at intake ball seat bevel 422 to the meet the internal cylindrical surface wider intake ball trap 424, and widens again at coupling O-ring shoulder 426.

Intake check ball 430 has a diameter greater than that of intake port 418 but less than that of intake ball trap 424. During assembly of the pump subassembly, the intake check ball is captured within intake ball trap 424 which is integrally formed in seal coupling 410 and pump manifold intake collar 442 which is integrally formed in pump manifold 440. Pump manifold crossbar 446 divides one open end of pump manifold intake port 448.

The check ball is trapped within the cylindrical intake ball trap 424, but remains loose within it. Manifold intake O-ring 432 is made of elastic material and is held in compression by the assembly of the end face of ball trap 424 against pump manifold intake shoulder 444. This O-ring prevents fluid from escaping at the annular juncture where the intake ball trap joins the manifold intake port.

Movement is stopped at the respective ends of ball trap by ball seat bevel 422 at one end and pump manifold intake crossbar 446 at the other. The crossbar prevents the seating of intake check ball 430 at the end of intake ball trap 424 that is farther from the reservoir.

These assembled elements therefore act to promote biased unidirectional fluid flow, since backflow to the reservoir is checked by the seating of the intake check ball 430 against intake ball seat bevel 422, while fluid flow away from the reservoir is always permitted.

More specifically, forward flow at the intake to the pump bulb volume is always allowed because the diameter of the cylindrical ball trap is larger than the entrapped ball, and because the two, chord-shaped openings that constitute the divided end of pump manifold port 448 are always open, owning to the intentional interference of the crossbar. Fluid in this location is therefore always free to flow around the ball and out through the divided port.

The seal coupling and the pump manifold are also joined where blind alignment hole 416 in the seal coupling receives pump manifold alignment pin 452. The alignment pin and the alignment hole may be devised to form a temporary or effectively permanent frictional fit depending upon the elected materials and elected cooperative draft angles. A pair of flat pump manifold cover catches 454 extends integrally from the body of the manifold.

The structure and function of the pump and discharge elements of the pump may be best understood by concurrent reference to the exploded view in FIG. 6 and the sectional view of FIG. 8. The outward direction of fluid flow is indicated by the arrow suggesting motion of fluid 700. It has been shown that he side of pump manifold 440 nearer to the reservoir includes the features described above. The side of the manifold farther from the fluid reservoir includes additional structures relating to the pumping means of the fluid supply system, and which operate cooperatively with flexible pump bulb 470. The pump bulb may be made of rubber, elastomers, polymers, or any other material that is sufficiently elastic that it may be manually deformed to displace an enclosed volume of fluid.

In inset perimeter region of pump manifold platform 456 provides a bearing surface for elastic pump bulb 470. Pump manifold discharge channel 458 angles out through the manifold platform to join beveled pump manifold discharge ball seat 460, which becomes geometrically contiguous with cylindrical discharge ball trap 462. A coaxial, annular step is formed at pump manifold tube receptacle 464.

The discharge ball trap is braced by pump manifold fairing 466. In the assembly of the pump parts, discharge check ball 434 is installed in discharge ball trap 462. Discharge check spring 436 is brought to bear against discharge check ball 434. Dispensing tube 438 is then inserted into the full depth of pump manifold tube receptacle 464, in such a way that at the spring is held in a fixed state of partial compression against the discharge check ball. Discharge check ball 434 thereby bears against discharge ball seat 460 and maintains a fluid gate in a normally closed state.

Pump bulb 470 includes pump bulb body 472, which is designed to enclose a predetermined volume of fluid drawn from the reservoir. Pump bulb rim channel 474 and pump bulb rim flange 476 are formed about the perimeter of the elastic bulb. Pump bulb rim gasket 478 promotes sealing of the relatively elastic bulb against the relatively rigid pump manifold. The gasket can be located along the bottom of the body 472 and have an annular shape. It can occupy the entire bottom edge surface or a part thereof.

Pump manifold platform 456 has planar, parallel stepped surfaces so to accommodate the mating of the manifold with the pump bulb. As may be understood from the drawings, the elastic pump bulb is intimately secured against pump manifold platform 456 through the compressive clamping action of pump housing 480. During assembly, the elastic pump bulb is momentarily deformed so that pump housing rim 482 is fitted inside conformally dimensioned bulb rim channel 474.

The seating of the pump manifold to the pump housing by the holding action of housing internal snap rim 484 compresses bulb rim flange 476 and the smaller-scale pump bulb rim gasket 478 against pump manifold platform 456 to collectively form a leak-proof seal. The enclosed volume between pump manifold platform 456 and the inner surface of pump bulb 470 in the completed pump subassembly is 2.2 ml.

Pump housing cowl 486 forms an integral cover section on one side of the pump housing, while pump housing external rim groove 486 and external snap rim 488 follow the remainder of the perimeter of pump housing rim 482.

Pump housing external rim 486 fits into pump back cover rim groove 492 formed on one edge of pump back cover 490. Pump back cover snap fittings 494 engage with flat pump manifold catches 454. Pump back over finger rest 496 is externally concave and may electively include pump cover grip surface 498. Pump cover grip surface 498 may include parallel ribbing or other surface relief.

When the pump is assembled as described about the completed mitt assembly 100, dispensing tube 438 inherently rests within a region of embossed irrigation channel 316. This conscientious design recesses the tube relative to the more elevated face regions of front panel outer face 314.

The foregoing description details the structure and mode of assembly of the pump subassembly. It may be seen that the pump design as formed according to the depicted embodiment invention provides a highly compact, enclosed fluid dispensing system that is free of sharp edges and free of any sort of abrupt surface obstructions.

More comprehensively, the completed mitt assembly includes a fluid reservoir, a dosing pump, and an impermeable, resilient front panel. The foam front panel, with its attached hook fasteners, is devised to receive a succession of disposable fibrous pads.

Figure 5:
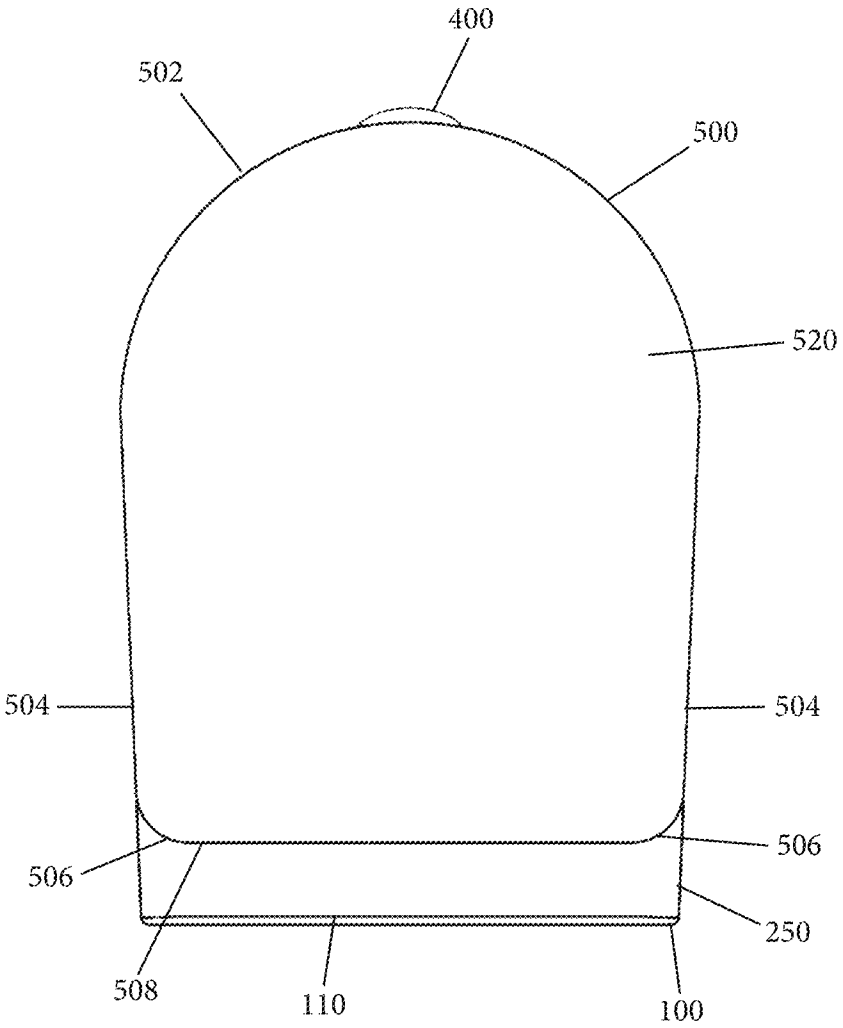
FIG. 5 is a plan view of the completed mitt assembly with a pad applied.
Figure 11:
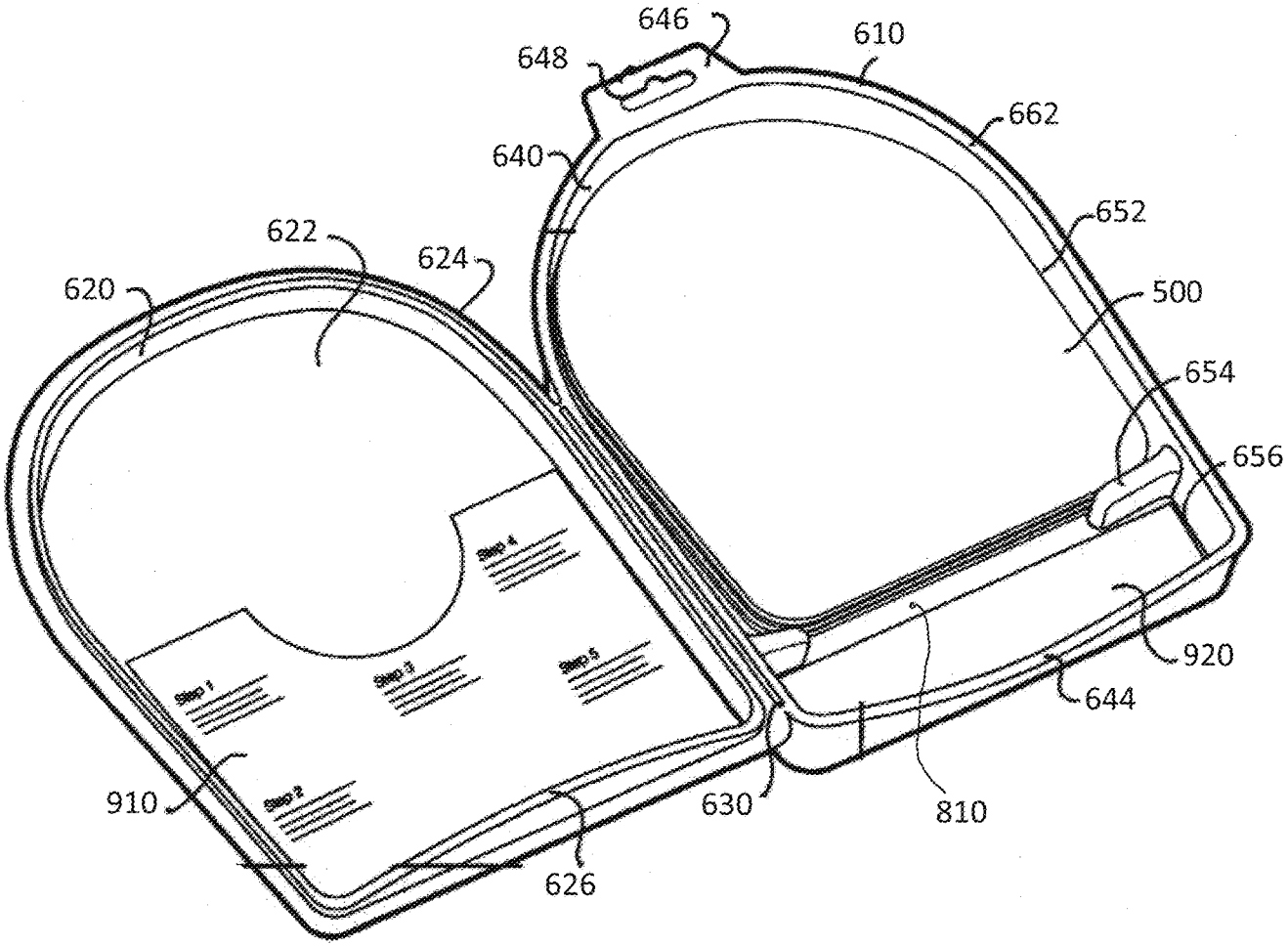
FIG. 11 is a second perspective view of the hinged enclosure formed according to the invention, showing a stack of pads in place to demonstrate the storage and alignment features of the enclosure.

The pad subassembly is expressly shown in FIG. 2, FIG. 5, and FIG. 11. Exemplary pad subassembly 500 includes a two-ply composition of nonwoven material. In the illustrated embodiments, the pads are dimensioned to substantially coincide with the outermost margin of the mitt assembly over most of its perimeter. A wider inset is provided along the straight edge near hand entry 110, so that the pads can be fitted to the mitt such that part of the mitt is left exposed in the wrist area. The difference in length and resulting exposed area may have a dimension of about 25 mm. The pad outer contour includes large radius 502, side edges 504, corner radii 506, and straight hand entry edge 508.

Suitable layered pad fabrics may be purchased from converters as webs in which two or more plies have been previously combined by the converter. For example, pad inner ply 510 may usefully be a non-apertured spunlace having a basis weight of 135 474 gsm. Such a spunlace may be a blend of rayon and PET fibers composed of 50% Rayon and 50% PET. This spunlace material has been found to inherently act as the loop component in a hook-and-loop reversible fastening system. In the present application, the looped spunlace fabric can be made to securely engage with the hook structures on hook fastener strips 320.

Pad outer ply 520 is the fibrous surface ultimately applied to the surface being cleaned, such as the surface of the user's body. A suitable material for outer ply may be described as a finished apertured spunlace. Such an apertured spunlace material may accordingly be a blend of PET and cellulosic fibers composed of 50% PET and 50% cellulose.

It may be appreciated that a diversity of nonwoven materials and blends is available in a range of combinations, according, for example, to the cost, to the fluid used, or to the anticipated cleaning task. For example, pad inner ply 510 may alternately be made of a spun lace nonwoven composed of 80% Tencel (Lenzing Fibers Inc., NY, N.Y., USA) and 20% polyester.

Pad outer ply 520 can alternately be made of polyethylene needlepunch. The outer layer of the pad may include materials outside the range of those cited above, including non-fibrous material such as fluid permeable open-cell foams, or woven fabric.

Figure 9:
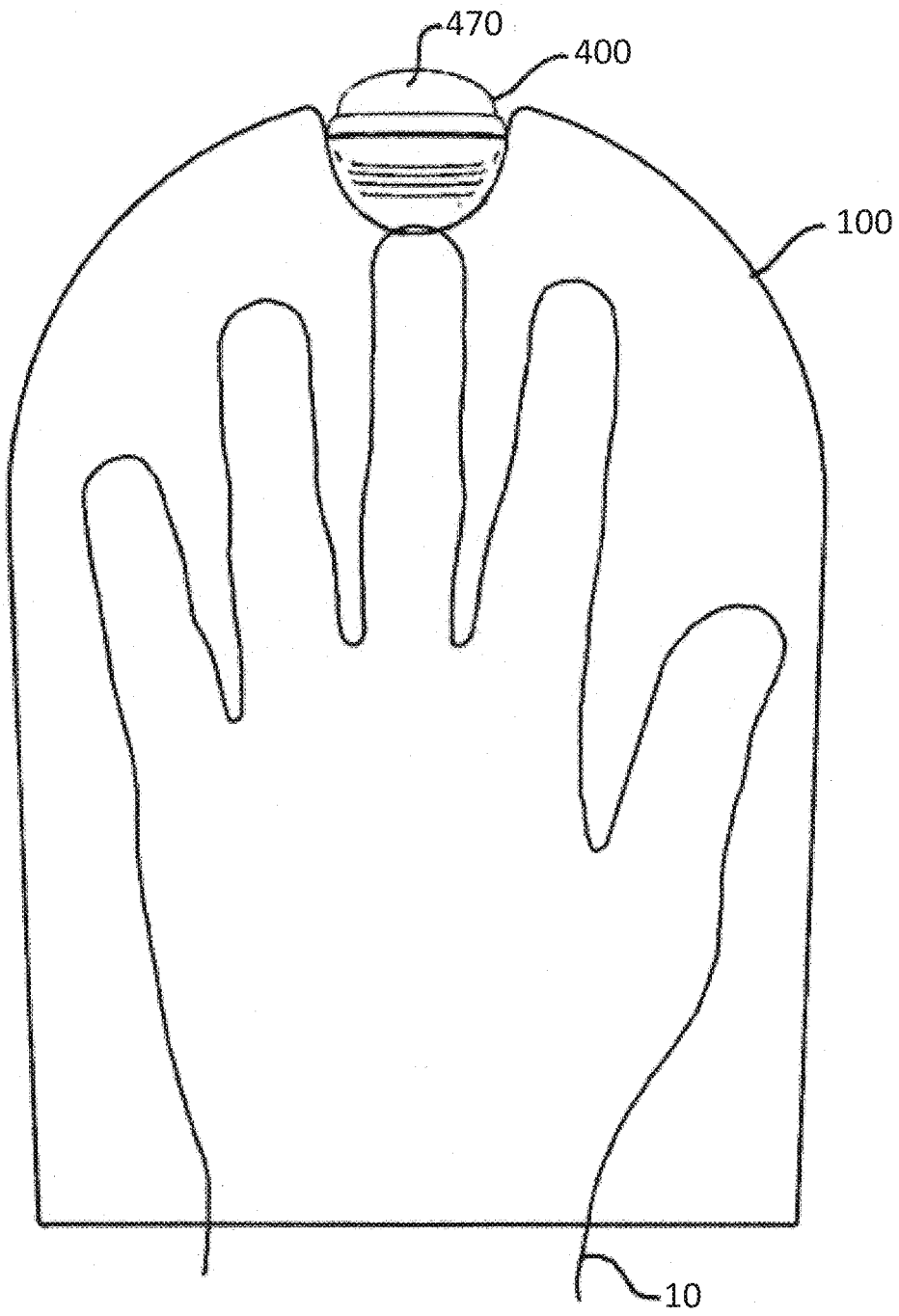
FIG. 9 shows the position of the hand during use of the cleaning mitt.

FIG. 9 shows the position of the hand during use of the cleaning mitt. It may be appreciated by reference to this figure the ease with which displacement may be introduced by the hand to pump bulb 410 by any opposing physical resistance.

Figure 10:
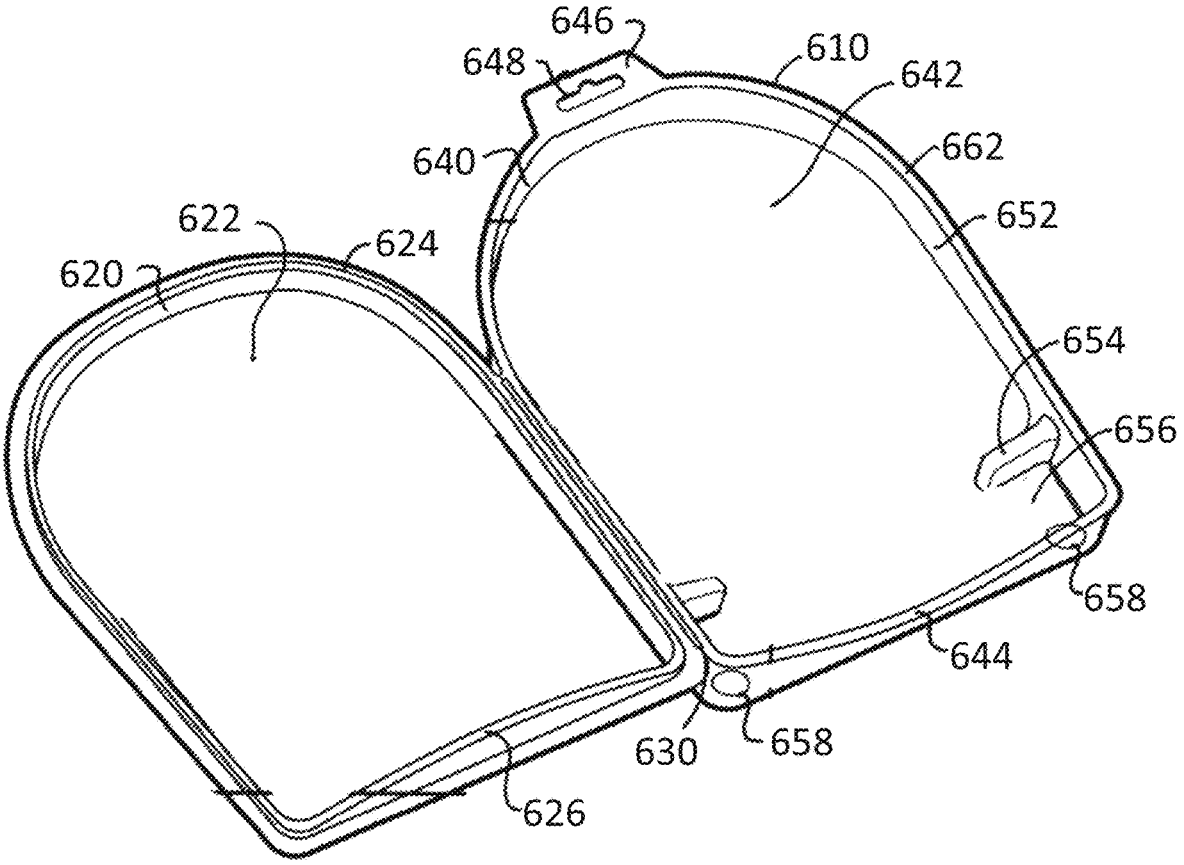
FIG. 10 is a first perspective view of the hinged enclosure formed according to the invention, showing the empty enclosure.
Figure 12:
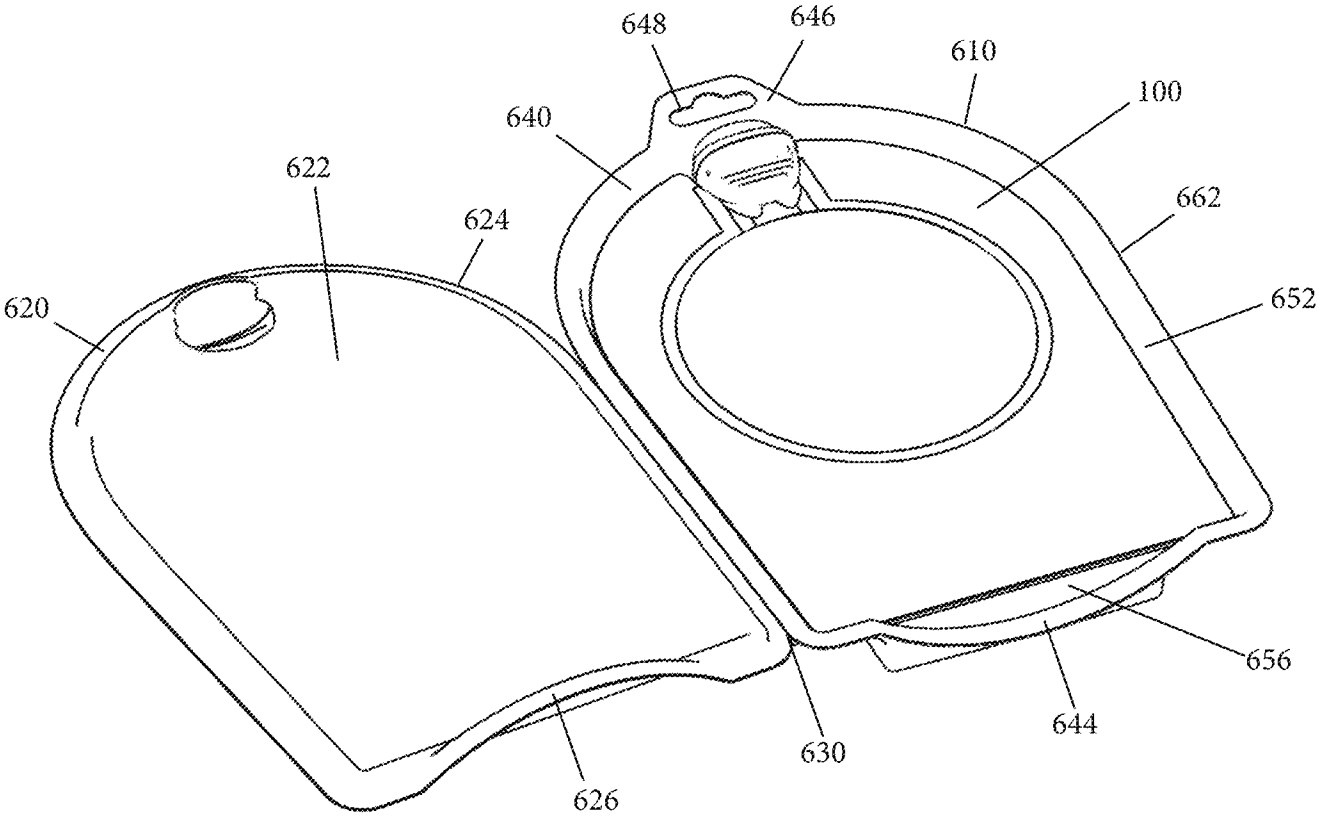
FIG. 12 is a third perspective view of an empty, hinged enclosure formed according to the invention, showing how the mitt is placed in the container when the user is mounting a pad onto the face of the mitt.

The details of a compatibly designed enclosure and mounting system are shown in FIGS. 10, 11, and 12. Kit enclosure subassembly 600 provides a convenient container for a plurality of pads, but is also conscientiously devised to aid in the mounting of a fresh pad when the mitt remains mounted on a hand. The enclosure also serves to discourage accidental deformation of the pump bulb, and thereby precludes premature release of the enclosed fluid.

Accordingly, the enclosure is of a slightly greater dimension that that of the mitt, and includes a more limited interior well that corresponds to the size of a stack of disposable pads. The illustrated embodiment of the enclosure is dimensioned to hold sixteen pads. A layer of interleaving may be included in the stack so that it may intermittently be repositioned as impermeable separator 810 between clean and soiled pads.

Referring particularly to the general properties of the empty enclosure shown in FIG. 10, kit enclosed shell 610 may be made of thermoformable transparent PET having a thickness of approximately 0.5 mm. Kit enclosure hinged shell 610 includes front shell 620 which is connected along one edge via live hinge 630 to rear shell 640.

Front shell 620 includes convex display window 622, front shell snap flange 624, and convex cover protrusion 626. Convex cover protrusion 626 extends from one edge of the container, and geometrically correlates with the wrist entry side of the correspondingly shaped mitt.

The rear shell includes internally concave pad conforming surface 642, concave wrist recess 644. The rear shell also includes hang tab 646 having elongate sombrero perforation 648 for mounting on a merchandising display. Rear shell 640 also includes pad tray wall 652, which may be devised to partially surround and contain the assembled mitt and a predetermined number of disposable pads. Pad alignment guides 654 prevent undesirable movement of the pads during storage, transport, or mounting. Secondary well 656 reflects the difference in longitudinal dimension between the pads and the mitt.

Pad conforming surface 642 is internally concave and therefore externally convex. Stabilization feet 658 may be made to extend from the back of the enclosure so that at least two feet occupy a geometrically coplanar surface. The stabilization feet may be geometrically continuous or geometrically discontinuous with pad conforming surface 642, and still be coplanar. When so formed, the stabilization feet will prevent the enclosure from rocking when placed on a flat surface, for example, during mounting of a pad on the mitt.

Rear shell snap flange 662 and front shell snap flange 624 are designed to have complementary tapered structures about a meaningful proportion of their perimeters so that they may secure engagement with one another, so that they may be pressed together to make a reversible closure.

The case can be fitted with diverse labels inserts, and instructional devices.

The edge joints where the flanges meet when the hinge is closed may electively be sealed using a perforated tear-off perimeter strip, or with a breakaway shrink-wrapped seal. In a packaged state, the enclosure may include welds or seams that deter or indicate tampering, but are not necessary for reliable closures subsequent to the first use of the product.

Fluid 700 may be introduced via intake port 418 in seal coupling 410 after the coupling is welded to the pouch, and the balance of the pump parts assembled around it to form a leak-proof seal. Alternately, an area of the perimeter of the reservoir may be left unsealed, forming a secondary channel having fluid access to the as yet unfilled reservoir. This secondary channel may be permanently sealed after filling.

In any case, the system of the invention can optionally include a frangible sanitary seal that is breached upon the first use of the system. For example, a foil seal may be formed to cover the end of the tube receptacle 464 on the molded pump manifold, and the seal breached by the insertion of dispensing tube 438.

A temporary seal may also be located over the undivided end pump manifold intake port 448 where it exits onto pump manifold platform 456, and may be breached by external pressure upon the filled reservoir upon first use. Such a temporary seal may be devised to be deliberately frangible by making a foil seal sufficiently thin, by applying the seal with relatively a weak adhesive bond, or by scoring or partially perforating an otherwise sound physical barrier. Other locations for analogous features and equivalent operations may be readily envisioned.

Once the pouch is filled with a suitable fluid and the pump assembly completed, the other components may be collected for packaging. The sequence of packaging and use of the system of the invention may be understood by particular reference to FIGS. 10, 11, and 12. The loading of the enclosure may begin with impermeable separator 810 being placed directly upon concave pad conforming surface 642. Impermeable separator 810 may compatibly correspond to the shape of the anticipated pads. When set in this initial location, the impermeable separator may usefully carry graphics which are visible from the back of the container.

As indicated in FIG. 11, a stack of pads is then placed upon impermeable separator 810 and within pad tray wall 652. Pad alignment guides 654 assist in seating these materials. The mitt assembly carrying the filled pouch is then placed on top of the stack of pads, as shown in FIG. 12. In FIG. 12, the reservoir is shown for illustration purposes and to indicate its location in the mitt; however, as discussed, from the rear, the reservoir outline is only visible in the form of a protruding portion (puckered)) of the outer blank. Primary printed insert 910 may be applied to the inside of convex display window 622 of front shell 620, and may cover part or all of the window. Secondary printed insert 920 may be located in secondary well 656. As long as a transparent material is used for the enclosure, both inserts may practically carry printing on each side. For purpose of illustration, the insert 910 has been removed from FIG. 12 but is seen in FIG. 11 and it will be understood it can be present in FIG. 12.

In a proposed original packing state, an aligned stack of pads is held within the walls surrounding the concave conforming surface 642. This arrangement allows the mitt to be readily aligned with a stored pad of similar profile, while also encouraging the pad to acquire a somewhat convex shape as it is mounted. Once all the required components are in place, front shell snap flange 624 may be engaged with.

In the following exemplary operation of the completed embodiment of the invention, any factory seal on the enclosure is first removed. The case is set on a flat surface so that stabilization feet 658 and the apex of the enclosure near the hang tab 646 rest stably on the flat surface. A user then opens the enclosure and removes the mitt that carries the sealed fluid reservoir.

As indicated by the illustration in FIG. 9, user's hand 10 is first placed intuitively via hand entry 110 into the pocket of the mitt. The external face of the front panel is pressed against the stack of pads lying over concave conforming surface 642 inside the enclosure. Concave wrist recess 644 and the space between pad alignment guides 654 collectively provide relief for the user's wrist.

The face of the mitt is placed within the structural perimeter of the enclosure and against the top pad so that the hooked features on the face of the mitt naturally align and engage with the loop features on the topmost side of the top pad. Pressure applied by the user in this circumstance causes a reversible coupling (lamination) to occur between the mitt and a pad while their layers are being conformed against a curved surface. The relatively rigid concave conforming surface inherently imparts a corresponding convexity to the layers of the relatively flexible cleaning mitt and pad as the complementary hook and loop elements engage.

The kit enclosed shell 610 can include a protruding portion at the top edge thereof that receives the protruding displaceable interface (bulb) of the mitt. In this manner, this protruding portion or arcuate formed cavity of the shell 610 can serve as a locating feature and serve to locate and retain the mitt in place within the shell 610 since the rounded bulb 470 seats within this rounded cavity.

The completed assembly comprising the mitt and pad will therefore retain a degree of convexity after the cleaning mitt assembly is removed from the enclosure. Because the pads are free to move against one another, this convexity will occur even when a full stack of pads is stored in the well.

Once the pad is mounted in this manner, the fluid dispensing system will have an outlet at a location between the mitt face and the attached replaceable pad. The user may pump a metered amount of fluid 700 from the reservoir to the pad by successively depressing and releasing the resilient pump bulb. The specific operation of the pump bulb will be understood based on the foregoing description of the components and functionality of the pump mechanism and the accompanying figures.

The bulb may be compressed using the hand opposite to that in the mitt, or the pump bulb may be pressed directly against any surface having sufficient mechanical resistance. The outer face of the dampened pad may then be used to clean the user's body, or any other suitable surface.

A soiled pad can be removed from the mitt, and either discarded or returned to the container. The separator may be located between the used pad or pads and any remaining unused pads, so that the clean, unused pads are shielded from soiling or contamination. The soiled pads may thus be reserved within the container for later disposal, for example, in remote and protected geographical areas where appropriate trash receptacles are unavailable.

It may be appreciated that, for readiness and for the convenience of the user, that the kit may be provided with a pad already mounted upon the mitt face. In this case, the above procedure would be followed only as the first pad is removed and replaced.

Diverse implementations of the invention are anticipated beyond the range of the embodiments herein illustrated and described. For example, the fluid contained in the reservoir need not be a cleansing, nor include only cleansing agents.

Exemplary fluid formulations may therefore be derived from diverse materials commonly used for cleansing, cosmetic, or medicinal purposes, and may include component materials such as water, soaps, detergents, surfactants, solvents, aromatics, oils, waxes, emollients, lotions, lubricants, salves, creams, balms, liniments, ointments, disinfectants, antibiotics, treatments, coatings, emulsions, stabilizers, thickeners, abrasives, foaming agents, reagents, insect repellents, insecticides, indicators, stains or colorants. Thus, different types of fluids can be stored in the reservoir of the present dispenser (applicator) and these fluids can have different viscosities and other different fluid properties. In addition, the fluid can include other additives/agents, such as perfumes/fragrances, disinfectants, anti-microbial agents, etc.

A fluid formulation suitable for use within the invention may also include macroscopically or microscopically encapsulated formulations carried within or along with such components, so that the encapsulated material or materials are only released by the subsequent actions of the user. It may be understood that the diversity of the potential range of fluid materials that may be made available to a user is a convenient and versatile aspect of the invention.

Although the preceding description describes system in which the pads are described as disposable, it should be understood that this is only intended to describe the convenience and utility of a particular embodiment. It is expected that pads may be designed in anticipation of repeated use so that they can be rinsed, washed, sterilized, or autoclaved.

In general, any visible surface may be provided with graphics, and such graphics may be provided by diverse methods, including printing, molding, coating, embossing, labeling, or any other perceptible means. Graphics may include branding, images, ornamentations, descriptions of use, instructions, ingredients, pricing, promotions, or any other functional or decorative content.

In yet another embodiment, the present invention can be implemented to include a refillable reservoir. The mitt described herein can be thought of as being an applicator for applying fluid to a target surface, such as the skin. As described herein, the applicator (mitt) can be constructed so as to be disposable after a number of uses and more particularly, the applicator can be used until the reservoir runs dry. Alternatively, in a refillable version, the applicator is constructed such that it includes a refill port that is in fluid communication with the reservoir. A user can refill the reservoir following certain steps. For example, the refill port can include a one way valve and a fluid delivery conduit (e.g., a fluid tube) can be inserted into the refill port to deliver fluid into the reservoir for refilling thereof.

A sanitizing fluid can be used between refills to ensure a clean reservoir.

For a number of fluids, the present product is preferably constructed as a non-refillable product as described herein with reference to the figures.

It will also be understood that one or more of the parts can include indicia, such as a brand name or logo or other printed indicia. More specifically, the pads can be formed in different colors and include logos, such as a sports logo or the like. In this case, the user can personalize the product. Alternatively, the rear blank 210 can include indicia as mentioned above and thus, a sports logo or corporate brand name can be provided along this surface.

Figure 13:
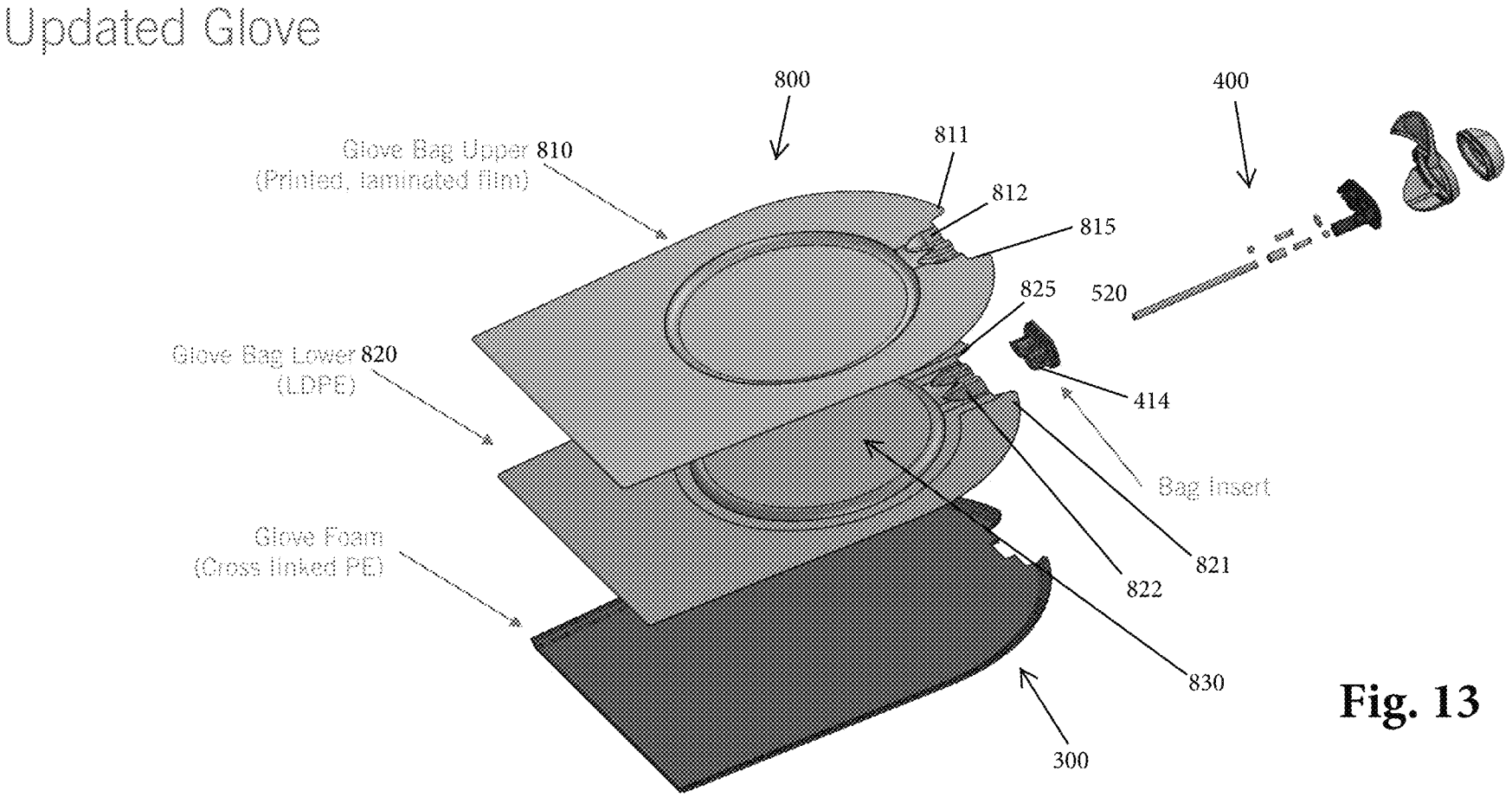
FIG. 13 is an exploded perspective view of a pouch subassembly according to one embodiment.

FIG. 13 shows another pouch subassembly 800 in relation to the pump subassembly 400. The pouch subassembly 800 includes a rear panel 810 and an opposing front panel 820. The rear panel 810 is similar to the pouch outer blank 210 and the front panel 820 is similar to the pouch inner blank 220. Unlike the previous embodiment, the footprint of the rear panel 810 and the front panel 820 can be the same or substantially similar. As with the previous embedment, rear panel 810 and front panel 820 are formed so as to define a reservoir 830 that receives the fluid to be dispersed. The reservoir 830 can be formed in the panels 810, 820 using conventional techniques, such as stamping or the like or any other suitable process. While the reservoir 830 is illustrated as having a circular shape, it will be appreciated that the reservoir 830 can have any number of different shapes.

In addition, the rear panel 810 can include a top edge 811 that has first recessed area 812 that is configured to receive the seal coupling 410 and a cutout or notch 815 formed along a top edge of the rear panel 810. The recessed area 812 can thus include a bilobate form for receiving the bilobate coupling extension 414. As with the reservoir, the first recessed area 812 can be formed using any number of suitable techniques.

The front panel 820 is complementary to the rear panel 810 and in particular, can be a mirror image of the rear panel 810. The front panel 820 can include a top edge 821 that has second recessed area 822 that is configured to receive the seal coupling 410 and a cutout or notch 825 formed along a top edge of the front panel 820. The second recessed area 822 can thus include a bilobate form for receiving the bilobate coupling extension 414. As with the reservoir, the second recessed area 822 can be formed using any number of suitable techniques.

When the rear panel 810 and front panel 820 are mated together (e.g., sealed to one another), the first recessed area 812 and the second recessed area 822 define a hollow interior space that is configured to receive the seal coupling 410.

In one embodiment, each of the rear panel 810 and front panel 820 is in the form of a printed laminated film, such as an LDPE film.

Figure 14:
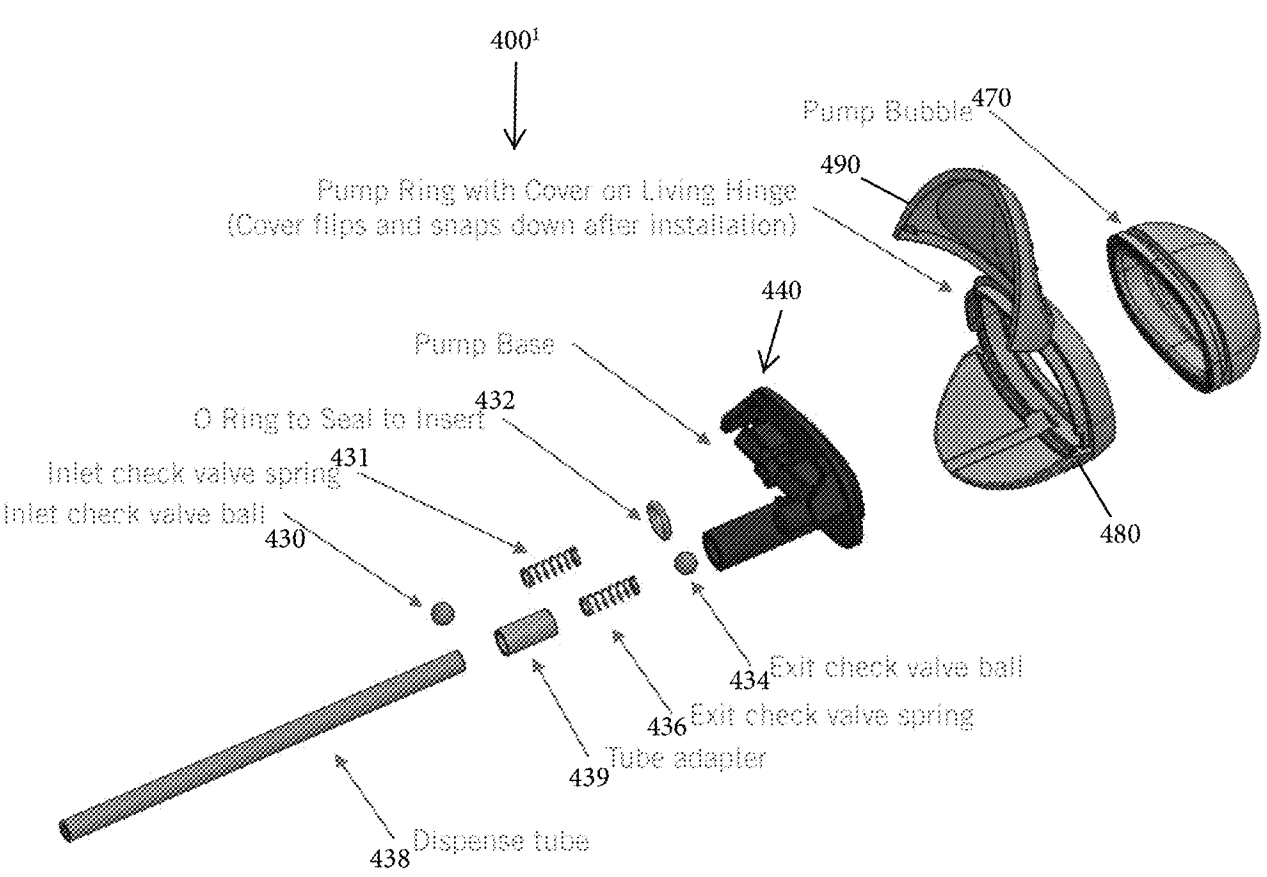
FIG. 14 is an exploded perspective view of a pump assembly according to another embodiment.

FIG. 14 shows a pump subassembly 400' that is very similar to the one previously described herein and therefore, like elements are numbered alike. In particular, in this embodiment, both valve structures of the pump are biased. Thus, the inlet check valve also includes a valve spring 431 similar to how the outlet check valve includes valve spring 436. Each of these springs 431, 436 acts on the respective valve member 430, 434 (which in this case is a ball valve for each valve structure). The inclusion of a spring (biasing member) as part of the inlet flow path (inlet valve) facilitates the initial priming of the unit and can improve other performance. In addition, a tube adapter 439 can be used between the dispensing tube 438 and the spring 436. In this pump subassembly 400', both the inlet and outlet valves are thus biased to closed positions in a rest position (no pump operation occurring).

FIGS. 15A-C also show an accessory 900 that is used to position and maintain (hold) the dispensing tube 438 in a prescribed location. The accessory 900 has a body 910 having a first face (surface) 912 and an opposing second face (surface) 914. The second face 914 is a flat surface and is intended for placement on the front panel outer face 314 of the front panel 310. The first face 912 has a plurality of ribs 915 that extend outwardly therefrom and define a center slot 920. The ribs 915 are preferably oriented parallel to one another. The center slot 920 is defined between the pairs of ribs 915 and is configured to receive the dispensing tube 438.

The illustrated body 910 has a circular shape and thus represents a disk; however, other shapes are equally possible.

The width of the slot 920 is selected in view of the dimensions of the dispensing tube 438 so as to create a friction fit between the dispensing tube 438 and the accessory 900.

In this embodiment, when the mitt is assembled, dispensing tube 438 can lie along the front panel outer face 314 of the front panel 310. The dispensing tube 428 can lie within a recessed area, such as within a region of embossed irrigation channel 316 or can lay along another region.

The accessory 900 can be mounted to the front panel outer face 314 using any number of suitable techniques, including the use of a fastener or bonding agent, such as an adhesive, etc. The accessory 900 is oriented on the front panel outer face 314 so that the slot 920 is open toward the top of the mitt where the pump is located. The accessory 900 is mounted such that it does not interfere with any of the irrigation channels 316 and thus, does not occlude fluid flow within the channels 316. The accessory 900 is located such that the open distal end of the irrigation channel 316 is centrally located and as described hereinbefore, is located in a region or hub from which the plurality of irrigation channels 316 extend from. Thus, pumped fluid exiting the distal end of the tube 438 flows into a central region (hub) and then flows outwardly in the irrigation channels 316 for efficient wetting of the pad.

The accessory 900 is thus designed to secure the distal end region of the dispensing tube 438 to prevent any inadvertent movement that is not desired during assembly and operation of the device.

FIGS. 16-19 illustrate a pump subassembly 1000 according to yet another embodiment which is similar to the other previously described pump mechanisms and FIGS. 20 and 21 show the pump subassembly 1000 incorporated into a mitt 1200 that is similar to the one described hereinbefore and therefore, like elements are numbered alike. The pump subassembly 1000 includes the pump bulb 470 that is coupled to a pump ring 1010. The pump ring 1010 is a hollow structure having a top ring portion 1012 (e.g., oval shaped ring portion) from which a pivotable first cover portion 1020 and an opposing second cover portion 1030. The second cover portion 1030 can be a fixed part that does not pivot like the first cover portion 1020. In one embodiment, each of the first and second cover portions 1020, 1030 have arcuate shapes and the first cover portion 1020 can represent one half of the cover, while the second cover portion 1030 can represent the other half of the cover. The first cover portion 1020 can be pivotably attached to the top ring portion 1012 as by a hinge 1040. FIG. 16 shows the first cover portion 1020 in the open position.

The hollow opening 1013 of the top ring portion 1012 is generally oval shaped and is configured to receive a pump base 1050. The pump base 1050 is intended to be sealingly coupled to the top ring portion 1012 and therefore, the illustrated pump base 1050 is generally oval shaped. However, it will be appreciated that both the top ring portion 1012 and the base 1050 can be formed to have other shapes.

The base 1050 is defined by a substrate 1052 that is configured to sealingly mate with the top ring portion 1012 by being inserted into the central opening thereof. In the illustrated embodiment, the substrate 1052 has an oval shape. An outer surface 1053 of the substrate 1052 includes a number of features (structures) that protrude outwardly therefrom. More specifically, the substrate 1052 includes a first protruding member 1060 in the form of a first hollow boss extending outwardly from the outer surface 1053 and a second protruding member 1070 in the form of a second hollow boss extending outwardly from the outer surface 1053. The first and second protruding members 1060, 1070 are spaced from one another. In the illustrated embodiment, the first and second protruding members 1060, 1070 are in the form of hollow cylindrical shaped structures (i.e., cylindrical tubes). The first and second protruding members 1060, 1070 pass through the substrate 1052 so as to be in fluid communication with the pump bulb 470. As shown, the second protruding member 1070 can have a length that is greater than the first protruding member 1060.

The substrate 1052 can also include other protruding features, such as locking structures 1080. Each locking structure 1080 is in the form of a protruding structure that has a cam surface at a free end and an undercut surface that is configured to snap-fittingly mate with a complementary structure, such as the seal coupling 410 (FIG. 20). In particular, the seal coupling defines the bottom portion of the pump assembly and can include complementary structures that mate with the locking structures 1080. In the illustrated embodiment, the locking structures 1080 represent male locking members and thus, the complementary structures in the seal coupling 410 are female locking members.

The pump subassembly 1000 also includes an inlet assembly 1100 that is defined by a retained ball member 1110 and a spring 1120. The retained ball member 1110 is an elongated member having a first end and an opposing second end. At the first end of the elongated retained ball member 1110, a ball 1114 is formed. At the second end, one or more barb 1116 is formed. Each barb 1116 is a protrusion that extends radially outward from the elongated shaft of the retained ball member 1110. As shown, the barb(s) 1116 serve to couple the retained ball member 1110 within the base 1050 and restrict movement of the retained ball member 1110 in a direction away from the base 1050. The barbs 1116 do not impede movement of the retained ball member 1110 in a direction toward the base 1050 and in particular, the pump bulb since movement of the retained ball member 1110 in this direction unseats the inlet valve and permits fluid to flow into the bulb during select conditions (e.g., generation of negative pressure in the bulb).

The spring 1120 is a compression spring. The elongated retained ball member 1110 and in particular, the second end thereof, passes through the center opening of the spring 1120. The spring 1120 applies a biasing force to the retained ball member 1110 so as to close the inlet under first operating conditions of the apparatus. For example, the first operating conditions can be when fluid is being discharged from the hollow pump bulb 470. Conversely, when a force is applied to the hollow pump bulb 470 to draw fluid into the hollow pump bulb 470, second operating conditions result resulting in the elongated retained ball member 1110 being drawn in a direction toward the hollow bulb 470 which results in compression of the spring 1120.

The inlet assembly 1100 is inserted into the first protruding member 1060 and more particularly, the second end of the retained ball member 1110 and spring 1120 is inserted into the first protruding member 1060.

The pump subassembly 1000 also includes an outlet assembly 1200 that is defined by an integrated tube 1210, a spring 1220, and a ball 1230. The integrated tube 1210 is an elongated structure that includes a first end 1212 and a second end 1214. The first end 1212 includes outer threads 1215, while the second end 1214 includes a deflector (dispenser) 1250. As shown in FIG. 19, the spring 1220 biases the ball 1230 against a valve seat formed in the pump base (at one end of the second protruding member 1070). The ball 1230 seats against the valve seat in the normal rest position and once pressure is applied to the pump bulb, the force of the fluid being discharged applies a force to the ball 1230 causing it to lift away from the valve seat, thereby providing a flow path for the discharged fluid into the dispensing tube.

The deflector 1250 acts to receive fluid flowing internally within a lumen of the elongated structure and then direct the fluid outwardly along desired, defined flow paths. As shown in the figures, the deflector 1250 has an outer peripheral wall 1252 that has a flat outer surface. In the illustrated embodiment, the outer peripheral wall 1252 has an oval shape; however, other shapes are possible. The flat outer surface permits the deflector 1250 to lie flush against adjacent components.

As shown best in FIG. 19, the lumen of the elongated structure is a longitudinal lumen. The deflector 1250 is disposed at one end of the longitudinal lumen and more specifically, the deflector 1250 has a hollow portion in that the dispenser receives the expelled fluid from the longitudinal lumen and redirects it. The hollow space in the deflector 1250 includes an end wall 1255 that is formed and is disposed perpendicular to the longitudinal lumen formed in the elongated structure. An aperture 1260 is in fluid communication with the hollow space and defines an outlet for the fluid. A central axis passing through the aperture 1260 is perpendicular to the longitudinal axis of the longitudinal lumen. The aperture 1260 is thus formed at a 90 degree angle relative to the longitudinal lumen and this causes the fluid to be directed 90 degree so as to exit the deflector 1250 at a 90 degree angle relative to the longitudinal lumen. The deflector 1250 is thus constructed to change the flow direction of the fluid that is discharged through the outlet.

Unlike the previous embodiment, the inlet and outlet valves in the embodiment of FIGS. 16-19 are encapsulated within the upper pump subassembly shown in FIGS. 16-19 as opposed to the prior embodiment in which the inlet valve ball is sandwich between the upper pump subassembly and the bottom pump subassembly (seal coupling 410). More specifically, the retained ball member 1110 is securely coupled to the pump base by means of the barbs engaging the pump base and thus, the components that make up the inlet valve are coupled to the pump base. Moreover, the outlet valve is also coupled to the pump base and thus, the subassembly shown in FIG. 16 which can be referred to as the pump subassembly which then mates with the seal coupling 410 that is secured to the mitt components.

As shown in the figures, the seal coupling 410 defines a valve seat on which the valve component (e.g., the ball valve) of the inlet component rests in a closed position. However, as shown and described above, in this embodiment, the ball is formed at a free end of the retained ball member with the opposite end being a stem with the barbs that allow coupling to the pump base.

The pump subassembly shown in FIGS. 16-19 thus is mated to the seal coupling 410 in the assembly of the mitt assembly, thereby connecting the pump to the reservoir and also allowing discharged fluid to flow to the front portion for wetting the removable pad.

It will be understood that the pump subassembly shown in FIGS. 16-19 mates with the other components that form the mitt assembly 100 and which are described in great detail herein.

The parts of pump subassembly, e.g., seal coupling 410 and the components shown in FIGS. 16-19 snap, clamp, or wedge together to form a substantially leak-proof pumping means.

FIGS. 20 and 21 show a mitt assembly 1300 that incorporates the pump subassembly 1000. The mitt assembly 1300 is similar to mitt assembly 100 and includes a pouch subassembly 1301 that includes the elements that retain the cleaning fluid, while front panel subassembly 300 includes an impermeable, resilient face to which fluid may be dispensed, and onto which fluid-permeable pads may be attached. The pouch subassembly 1301 is similar to subassembly 200 and includes the seal coupling 410 as well as pouch outer blank 1310 and pouch inner blank 1320. The pouch outer blank 1310 can have the same construction as blank 810 and the pouch inner blank 1320 can have the same construction as blank 820.

The pouch outer blank 1310 can be formed, as shown, to include a first recessed portion 1320 for holding fluid and includes a second recessed portion 1330 for receiving the seal coupling 410. The pouch inner blank 1320 is complementary to the pouch outer blank 1310 and can be a mirror image thereof. The inner outer blank 1320 can be formed, as shown, to include a first recessed portion 1340 for holding fluid and includes a second recessed portion 1350 for receiving the seal coupling 410. When the blanks 1310, 1320 are combined, the first recessed portions 1320, 1340 define a fluid reservoir for holding a fluid, such as water. This combined reservoir communicates with the recessed portion 1330, 1350 so as to allow fluid to flow from the reservoir to the seal coupling 410 contained in the preformed recessed portions 1330, 1350.

As shown in FIG. 21, the integrated tube 1210 and the deflector (dispenser) 1250 lie along the exposed surface of the front panel outer face 314 and the deflector 1250 serves to deflect fluid along the face 314 as discussed herein.

FIG. 22 illustrates a mitt assembly 2000 that is similar to some of the other mitt assemblies disclosed herein. The mitt assembly 2000 can generally thought of as being a three-ply structure in that it is formed of a first (outer) layer 2100, a second (intermediate) layer 2200, and a third (inner) layer 2300. The layers 2100, 2200, 2300 are formed with precision using any number of suitable techniques, including but not limited to a die cutting process in which the individual layers are cut from a blank as described below.

As described below, the combined layers 2100, 2200 define a reservoir 2400 that contains the fluid (e.g., liquid) that is to be dispensed. The fluid can be any of the fluids described herein.

The first layer 2100 can be thought of as being a rear layer, while the third layer 2300 can be similar or identical to the front panels described herein including front panel 300 and therefore like elements are numbered alike. Hook fasteners strips 320 are also used as described with respect to the earlier embodiments.

The pouch subassembly, defined by layers 2100, 2200, typically includes the elements that retain the fluid, while front panel subassembly, defined by layer 2300 typically includes an impermeable, resilient face to which fluid may be dispensed, and onto which fluid-permeable pads may be attached. Another subassembly, pump subassembly 400, provides a means to covey (transport) fluid from the back reservoir to the front panel in a regulated manner. The details of the pump subassembly are best understood by reference to FIGS. 6, 7, and 8.

It will be understood that the pouch is integrated into the structure of the mitt 2000 such that it may reliably retain a supply of fluid. The pouch is therefore typically made of materials selected to be substantially impermeable to the anticipated fluid supply. The selection of the pouch material may depend upon the elected fluid formulation. In any event, the pouch holds the fluid to be dispensed.

Materials for the fabrication of pouches, packs, bags, or other flexible, sealed fluid-carrying containers are widely available for the packaging of drinks, foodstuffs, condiments, cosmetics, pharmaceuticals, and medical supplies. These commonly include an outer polymer layer, and intermediate foil layer, and an inner polymer layer having a lower melting point than the polymer used in the outer layer. These layers can be laminated using an adhesive, or by heat and pressure.

Once laminated into a multi-ply film, such materials can be assembled into inexpensive, relatively unbreakable vessels by placing the inner surfaces in a facing relationship, and locally heating a perimeter while applying pressure.

Polyester (PET) is often used as an outer layer. PET provides strength and has a high melting point. Ink may electively be reverse-printed in one or more steps on the inside of this PET layer. Oriented polypropylene (OPP) may also be used. When printing is performed on internal surfaces prior to lamination, the printing is captured under a transparent film layer in such a way that condensation and handling do not mar the imagery.

Foil is often used as an internal barrier, either as discrete foil layer, or as a thin foil vacuum metallized onto an intermediate film layer such as polyester (MPET). Foil is an effective barrier to oxygen, evaporation, and light. Other intermediate-layer barrier materials include Saran coated Polyester (KPET), and ethylene vinyl alcohol copolymer (EVOH).

Linear low-density polyethylene (LLDPE) often constitutes the fusible inner layer. LLDPE provides an additional moisture barrier, and has a relatively low melting point. Amorphous poly-alpha-olefins (APAO) may also be suitable for the inner fusible layer. Regardless of its exact composition, it is this innermost layer that is locally melted in the process of forming a heat-welded seal, seam, or joint.

The pouch subassembly may be formed using such multi-ply packaging material, and may be variously decorated or provided with other visual information. Pouch subassembly includes pouch outer blank (layer 2100) and pouch inner blank (layer 2200). The pouch is assembled from two facing plies of suitable laminated film material. As shown in FIG. 22, in the initial pre-fabrication state, the outer blank 2100 and the inner blank 2200 are in the form of at least substantially flat structures (i.e., flat layers of film material).

In the illustrated example, pouch outer blank 2100 is devised to have a greater extent than pouch inner blank 2200, so that when they are positioned with their fusible surfaces in a facing relationship, an exposed margin of fusible surface is allowed around pouch inner blank 2200. Pouch outer blank 2100 may, for example, carry branding, imagery, descriptions, or instructions, and may exhibit an ornamental finish owing to a foil or metallized inner ply.

As shown in FIG. 22, the pouch outer blank 2100 has a defined reservoir region 2110 which can take any number of different forms and in the case of the illustrated embodiment, has a circular shape and this region is spaced internal to the peripheral edge of the pouch outer blank 2100.

Pouch inner blank 2200 also has a defined reservoir region that has a perimeter that outlines the expected volume of the fluid reservoir.

Three distinct volumetric features are formed by the joining of pouch outer blank 2100 and pouch inner blank 2200. The joined blanks define anticipated fluid reservoir 2400, shown in FIG. 22. In the illustrated application of the invention, the reservoir is circular and is devised to accept a predefined volume of fluid, such as a filled volume of 65 ml.

Outer pouch reservoir neck 2112 extends in one direction from the pouch reservoir. The neck 2112 provides narrow directional channel so that flow may be induced when, in the use of the completed system, the user imparts pressure to the filled reservoir.

Pouch mouth 2114 expands from pouch reservoir neck 2112 and provides an opening and section into which seal coupling 410 may be fitted with a degree of ease prior to the joining of the components by the application of heat. These volumes may optionally be preformed to a three-dimensional shape, but they may also be simply and adequately formed into a volume by the internal pressure against the loose pouch material upon its filling with fluid.

Similarly, the pouch inner blank 2200 includes a pouch reservoir neck 2212 extends in one direction from the pouch reservoir. The neck 2212 provides narrow directional channel so that flow may be induced when, in the use of the completed system, the user imparts pressure to the filled reservoir.

Pouch mouth 2214 expands from pouch reservoir neck 2212 and provides an opening and section into which seal coupling 410 may be fitted with a degree of ease prior to the joining of the components by the application of heat. These volumes may optionally be preformed to a three-dimensional shape, but they may also be simply and adequately formed into a volume by the internal pressure against the loose pouch material upon its filling with fluid.

As shown in FIG. 22, as part of the formation of the pouch inner blank 2200, the outer peripheral edge thereof is formed to include a series of cutouts or notches 2500. Between a pair of adjacent notches 2500 is a peak portion 2510. The notches 2500 can be formed to have any number of different shapes including the illustrated shape which is defined by a flat floor and a pair of curved sides that partially define the peak portion 2510. As shown, the sizes of the notches 2500 and peak portions 2510 can be the same or in some embodiments, the sizes can vary along the outer peripheral edge of the pouch inner blank 2200.

As illustrated, the notches 2500 and peaks 2510 are formed along the two side edges and the top edge but are absent along the bottom edge of the inner pouch blank 2200.

It will also be understood that an inner surface of the pouch outer blank 2100 includes a first adhesive layer. Similarly, the outer surface of the pouch inner blank 220 that faces the inner surface of the pouch inner blank 2100 includes a second adhesive layer.

The front panel subassembly includes a front panel which comprises third layer 2300 and is formed of a resilient material. Closed-cell polyethylene foam stock having a thickness of about 1.5 mm has been found to yield a compact, comfortable, and impermeable surface; however, other materials can equally be used. Front panel 2300 is provided with a contour similar to that of pouch outer blank 2100.

The front panel 2300 may carry a series of embossed irrigation channels 316 which ultimately promote the distribution of a dose of fluid over the surface of the front foam panel as described herein with respect to earlier embodiments.

The assembly of the three layers 2100, 2200, 2300 is now described.

As shown in FIG. 23, the three layers 2100, 2200, 2300 are in the form of blanks that are designed to be arranged relative to one another and undergo additional processing steps to form the completed mitt shown in FIG. 22. The third layer 2300 can be in the form of a continuous intact blank formed of a suitable material as described herein (e.g., a foam material). The second layer 2200 has a plurality of openings or holes 2201 that are shaped according to a pattern that generally outlines the peripheral edge of the post-cut second layer 2200. The shapes and sizes of the holes 2201 can vary; however, the spacing of the holes 2201 defines the size of the peaks 2510 and therefore, the holes 2201 are not spaced a distance that would allow a finger to be inserted therein since the peak 2510 represents an open space between the bonding points of the layers 2100, 2300. The holes 2201 can be oval or oblong shaped as shown and generally are formed according to a U-shaped pattern since the mitt has a curved end with parallel sides. The third layer (e.g., foam layer) 2300 can have an opening 2301 which permits space for the pumping mechanism. Other cutouts and openings can be formed in the layers.

First, the first and second layers (pouch outer and inner blanks) 2100, 2200 are aligned with respect to one another such that peripheral edges thereof overlap and the reservoir regions thereof also overlap. The reservoir itself is formed by heat sealing the first and second layers 2100, 2200 in discrete location(s) and more particularly, the heat seal is formed along the outer peripheral edge of the reservoir. The application of heat to the combined first and second layers 2100, 2200 results in the localized melting of the adhesive layers of the first and second layers 2100, 2200, thereby bonding the first and second layers 2100, 2200 to one another in discrete locations, whereby the reservoir is formed.

It will be appreciated that in its bonded state, the reservoir is located internal to the openings 2201 and the openings 2201 are superimposed over the first layer 2100.

After the formation of the reservoir by heat sealing the two layers 2100, 2200 to one another, the third layer 2300 is then secured to the bonded first and second layers 2100, 2200. First, the third layer 2300 is laid over the combined (bonded) first and second layers 2100, 2200 such that the uninterrupted peripheral edge of the third layer 2300 is superimposed over the uninterrupted peripheral edge of the first layer 2100 (and the second layer 2200). When the three layers are superimposed, the third layer 2300 covers the openings 2201 of the second layer 2200.

The inner surface of the second layer (pouch inner blank) 2200 does not include any adhesive and similarly, the outer surface of the third layer 2300 that faces the second layer 2200 also does not include an adhesive layer. Thus, the second and third layers 2200, 2300 are not directly bonded to one another.

When all three layers 2100, 2200, 2300 are overlapped in this manner, the openings 2201 act as windows or voids whereby the first layer 2100 and the third layer 2300 can be placed into direct contact with one another. Since the inner surface of the first layer 2100 includes an adhesive layer, this adhesive layer is placed into contact with the outer surface of the third layer 2300 only at the locations of the openings 2201.

After the proper alignment between the three layers 2100, 2200, 2300, heat is applied to the third layer 2300 and in particular, heat is applied to locations of the third layer 2300 and/or first layer 2100 that are contained within the openings 2201. Since the adhesive layer of the first layer 2100 is in direct contact with the third layer 2300 through the openings 2201, the application of heat to these regions (areas within the openings 2201) causes melting of the adhesive and bonding between the first layer 2100 and the third layer 2300 at the discrete points within the openings 2201. It will also be appreciated that the pouch inner layer (the second layer) 2200 and the third layer 2300 are not directly bonded to one another. It will also be appreciated that the ultimately formed peak portions 2510 (i.e., the regions between the openings 2201) are not directly attached to either the first layer 2100 or third layer 2300.

After the bonding occurs between the first and third layers 2100, 2300, the resulting joined three-ply structure is then cut to form to create the final product. In particular, as shown in FIG. 24, the cut line 2600 extends through the center of each opening 2201 so as to form the resulting mitt product that has parallel sides and a curved end opposite a straight end (which contains the entrance to the pocket). FIG. 24 also shows formation of the reservoir. As one can see in FIG. 25, the result of this cutting process (e.g., a die cutting process) is that the notches 2500 and peaks 2510 are formed in the second layer 2200. Other cuts can likewise be formed to create shaped openings for the pump dispensing mechanism, etc. One will understand that the area within the border of each opening 2201 is a bonded interface between the first and third layers 2100, 2300 and thus, the cut line 2600 extends centrally through this bonded interface.

As mentioned herein, the peak portions 2510 formed after the die cutting process are sized such that a finger of the user cannot be inserted therethrough.

The above described process is thus an effective manner of joining the three layers 2100, 2200, 2300 in select, discrete locations to form an assembled three-ply mitt construction. The provision of the notches 2500 along the periphery of the second layer 2200 is an improved technique for limiting the number of bonding steps that are needed for bonding the three layers 2100, 2200, 2300 together and also limits the amount of adhesive that is needed to achieve such bonding.

After the three layers 2100, 2200, 2300 are bonded in the manner described above, a filament or insert (i.e., the seal coupling 410) is inserted into the space between the pouch mouth 2114 and the pouch mouth 2214 and then a heat sealing operation is performed (e.g., as by using heated jaws) to securely capture the insert (seal coupling 410) within this space in a sealed manner. The insert (seal coupling 410) is thus sealed to and between the first and second layers 2100, 2200. Once the insert is in this sealed location and is therefore captured between the layers 2100, 2200, the reservoir is filled with a fluid and then the pump assembly itself is sealingly coupled to the seal coupling 410.

The use of materials and implements formed according to the invention should not be limited by the foregoing description, but rather by the extent of the appended claims.

It will also be understood that the die cut holes or slots 2201 that form the peaks 2510 should be designed to permit the sheet (second layer 2200) to stay together and handle well after the openings 2201 are die cut, but not be so big as to permit a finger to protrude into the peak area 2510 after heat sealing and final cutting step is performed. Therefore, the peak areas 2510 are preferably between 0.250" and 0.500", with 0.350" being found to be one exemplary size for the openings 2201. The width of the gaps between the peaks 2510 can be bigger than the peaks 2510, anything from 0.500" to 1.500" with 1.25" being found to be one exemplary size. As explained, the die cut holes 2201 are cut as slots or holes. During final die cut of the glove construction, these slots or holes are cut through to form the peak geometry. It will be understood that the foregoing values are merely exemplary and not limiting of the present invention.

FIG. 26 shows another embodiment in which the first and second layers 2100, 2200 are formed from a single sheet (blank) that has a fold line 2105. When the single blank is folded about the fold line 2105, the single blank defines the first and second layers 2100, 2200. In performing the steps described above, the first layer 2100 is folded over second layer 2200 about fold 2105 to position the first layer 2100 against the perforated second layer 2200 and permit third layer 2300 to be placed adjacent the second layer 2200, thereby positioning the first and third layers 2100, 2300 and permit bonding therebetween in the manner described herein. Since the pocket is not formed between the first and second layers 2100, 2200, the first and second layers 2100, 2200 remain sealed along fold line 2105 in the assembled product.

FIGS. 27-36 illustrated a fluid dispensing device according to other embodiments of the present invention and in particular, FIGS. 27-33 illustrate a mitt assembly 3000 according to one embodiment. The mitt assembly 3000 is similar to those described hereinbefore. The mitt assembly 3000 includes a mitt body portion 3010 (pouch sub-assembly) which can be formed of at least a top layer 3001 (FIG. 27) and a bottom layer 3003 (FIG. 28) with the open interior compartment for the hand is defined between these two layers.

FIG. 28 illustrates the rear face of the mitt assembly 3000 and in particular shows the dispensing surface of the mitt assembly 3000. As shown, the pump 3100 is disposed in one corner of the mitt assembly 3000. The rear face of the mitt assembly 3000 can include a fluid dispensing tube 3110 that carries fluid from the pump 3100 to one or more and preferably a plurality of outlet holes 3112 through which the pumped fluid is dispensed. In the illustrated embodiment, there are five (5) outlet holes 3112 that are evenly spaced from the center of the mitt; however, the number of outlet holes 3112 can be less or more than five depending upon the desired fluid distribution shape (i.e., the spray pattern that is desired). The fluid dispensing tube 3110 can thus have define a flow path architecture and in particular, can include individual flow paths, illustrated as fingers in the present embodiment that extend radially outward from the center of the mitt. The outlet hole 3112 is located within a respective individual flow path (finger) and while the present embodiment shows one outlet hole 3112 per flow path, more than one outlet hole 3112 can be provided for each flow path.

The fluid dispensing tube 3110 can be a laminated tube which can be a separate part or it can be attached or integral to the bottom layer 3003 of the mitt assembly 3000. Coupling pads 3020, formed of hook and loop material, can be provided along the bottom layer 3003 and configured to grip and hold onto a wipe or pad (both of which are intended to be disposable).

FIG. 29 is an exploded perspective view of the pump assembly 3100 including the dispensing tube arrangement. Like the other pumps described herein, the pump assembly 3100 is a manually operated system and includes an actuator 3110 which can be in the form of a button as shown in the figure. To initiate a pumping action, the user presses down on the button 3110, which as described relative to other embodiments causes the fluid to be drawn into the pump and dispensed from the pump. The button 3110 has a hollow interior 3111 that acts to hold fluid that is then dispensed from the pump and conversely when the depressed button 3110 is released and is biased to return to a rest position by a biasing element (spring) 3114, the fluid is then drawn into the hollow interior 3111. As shown, the hollow interior 3111 of the button 3110 can be a circular shaped hollow interior and the spring 3114 can be a circular shaped spring one end of which is received within the hollow interior 3111 of the button 3110.

The spring 3114 thus serves to apply a return force to the button 3110 to cause it to return to the rest position and this return from a depressed position to the at rest position serves to generate negative force and refill the pump assembly 3100 by causing flow of fluid into the hollow interior 3111. The other end of the spring 3114 contacts a cap 3120 that is also configured so as to define a valve seat for a valve mechanism. The valve mechanism is disposed between the button 3110 and a main pump body 3160.

The main pump body 3160 has first and second compartments 3161, 3163, respectively, that are separated from one another and define flow paths and more particularly, the first compartment 3161 is associated and forms part of the fluid intake pathway in which fluid is flowing from the main fluid storage compartment in the mitt assembly to the hollow interior 3111 and the second compartment 3163 is associated and forms part of the fluid dispensing pathway in which fluid exits the hollow interior 3111 and is delivered to the dispensing tube. In one embodiment, each of the first and second compartments 3161, 3163 can have a cylindrical shape and are separated by a center wall. The compartments 3161, 3163 can have similar or the same volumes or they can have different volumes. The main pump body 3160 has a first end 3162 that faces the button 3110 and a second end 3163 that faces away from the button 3110. The first compartment 3161 has a nipple (inlet) 3165 at the second end 3163 that receives fluid from the main fluid storage compartment.

The valve mechanism 3130 can be any number of types of suitable valve mechanisms that control the flow of fluid through the pump assembly 3100. In particular, similar to the other pump assemblies described herein, the valve mechanism is designed to permit the controlled withdrawing of fluid from the fluid reservoir into the pump assembly (i.e., into the hollow interior of the button 3110) and then the controlled dispensing of this stored fluid through the dispensing tube, etc. In the illustrated embodiment, the valve mechanism 3130 is in the form a check valve and more particularly, there is a first check valve 3140 to control fluid flowing from the fluid reservoir within the mitt assembly to the fluid storage compartment (hollow interior 3111) inside the button 3110 and a second check valve 3150 to control fluid flowing from the button 3110 to the dispensing tube for discharging the fluid. It will be appreciated that during a fluid dispensing action when the button 3110 is pressed down, the first check valve 3140 is closed (fluid intake valve), while the second check valve 3150 is open to allow the fluid to be dispensed and conversely, when fluid is drawn into the hollow interior 3111, the first check valve 3140 is open, while the second check valve 3150 is closed.

The first check valve 3140 comprises a first ball 3142 that is biased by a first spring 3144. The underside of the cap 3120 can include a post 3123 on which one end of the first spring 3144 seats. The first ball 3142 is received within an opening (valve seat) formed in the one side of the main pump body 3160. Thus when the first ball 3142 is closed, it seats against the valve seat in the main pump body 3160 as when fluid is being discharged from the button 3110 and conversely, when the button 3110 is biased back to its rest position from a depressed position, negative pressure lifts the first ball 3142 from the valve seat in the main pump body 3160 to allow fluid to flow from the main fluid storage compartment through the first compartment 3161 to the hollow interior 3111.

The second check valve 3150 (fluid dispensing valve) comprises a second ball 3152 that is biased by a second spring 3154. The underside of the cap 3120 can have an annular shaped wall 3121 that defined a holding space in which the second ball 3152 seats when the second check valve 3150 is in the closed position. When the second check valve 3150 is in the closed position, the fluid dispensing pathway is closed off and fluid is permitted to flow along the fluid intake pathway into the hollow interior 3111 and be stored therein until the button 3111 is pressed.

The second spring 3154 applies a force to the second ball 3152 in this direction and therefore, in the at rest position, the second ball 3152 is received in the holding space of the cap 3120 and the fluid dispensing pathway is closed. The other end of the first spring 3142 seats against the main pump body 3160. The fluid dispensing pathway is defined through the main pump body 3160 and as shown, one side (e.g., one half) of the main pump body 3160 can include and define the fluid dispensing pathway as described herein.

A seal member 3170, such as an O-ring, seals the button 3110 to the main pump body 3160; however, it will be appreciated that the seal can be achieved in any number of other ways including molding the seal member into the main pump body 3160 itself. A second seal member 3180, such as a second O-ring, seals the assembled pump to a first fitment (intake conduit member) 3190 which is configured to mate to the second end of the main pump body 3160. The first fitment 3190 can also be considered to be a first fluid connector that serves to not only close off the second end of the main pump body 3160 and also serves to provide a conduit through which the fluid flows from the main storage compartment in the mitt assembly to the main pump body 3160 and in particular, the first compartment thereof. The first fitment 3190 include a base portion 3192 that includes at least one finger 3191 that provides a means for engaging and coupling the first fitment 3190 to the main pump body 3160. The first fitment 3190 includes an end protrusion or extension 3193 that includes a center bore 3194 that is placed in fluid communication with the main storage compartment of the mitt assembly. The first fitment 3190 is thus the means by which the fluid from the main storage compartment of the mitt assembly to the main pump body 3160. The first fitment 3190 is thus in fluid communication with the first compartment 3161 of the main pump body 3160 and the main storage compartment of the mitt assembly. The distal end of the first fitment 3190 is thus placed in direct fluid communication with the main storage compartment formed in the mitt assembly.

Instead of using the second seal member 3180, the seal member can be incorporated and made integral with the main pump body 3160.

In accordance with one aspect of the present invention and as shown in FIG. 29, a laminated outlet (dispensing) tube 3200 can be provided and be configured to mate with the pump assembly so that fluid that is discharged from the pump assembly is delivered into the dispensing tube 3200. The laminated outlet tube 3200 is thus the means for dispersing the fluid along the rear surface of the mitt assembly and it will be appreciated that the laminated outlet tube 3200 can therefore come in many different shapes with different fluid architectures for dispersing the fluid along different channels to discharge locations. The laminated outlet tube 3200 is thus formed of a first layer 3210 and a second layer 3220 that are attached to one another as by a lamination process. More particularly, the first and second layers 3210, 3220 are joined along their peripheral edges with the rest of the first and second layers 3210, 3220 being free of attachment and therefore, an open space is formed which permits the fluid to flow within this space to discharge points.

The first layer 3210 includes a proximal end 3211 and similarly, the second layer 3220 includes a proximal end 3221 which is superimposed with the proximal end 3211 when the two layers are attached to one another. The proximal ends 3211, 3221 define a fluid intake end of the outlet tube and as shown, these proximal ends 3211, 3221 can be contoured, such as each having a recessed portion, for receiving a second fitment 3250 which can be considered to be a dispensing tube fitment (outflow conduit member).

The second fitment 3250 is configured to be mated to the main pump body 3160 and as shown, can mate to a bottom face of the main pump body 3160. For example, the main pump body 3160 can have a keyed slot or track 3169 that receives the second fitment 3250. The second fitment 3250 has a first end 3252 and a second end 3254 with the first end 3252 being the end that is received within the keyed slot 3169. The first end 3252 is thus the end that receives the dispensed fluid and channels the fluid to the second end 3254 where it is discharged into the dispensing tube. Thus, the second fitment 3250 include a bore 3255 that extends from the first end 3252 to the second end 3254 and in one aspect of the present invention, this bore has a 90 degree bend in that the fluid enters into the first end 3252 at a first leg of the bore and then flows into a second longer leg that terminates at an opening at the second end 3254 and is oriented 90 degrees relative to the first leg.

The second fitment 3250 is received within the recessed portions of the first and second layers 3210, 3220 and therefore, the second fitment 3250 is disposed between the two layers 3210, 3220. When the second fitment 3250 is in this location, the opening at the second end 3254 can be positioned outside of the recessed portions so as to allow fluid to be directly dispensed into the fluid channel architecture formed between the two layers 3210, 3220. In the illustrated embodiment, the second end 3254 that is configured to be received within the recessed portions can have a diamond shape.

In one aspect of the present invention, the first fitment 3190 and the second fitment 3250 are configured to be spatially offset in their assembled state and in particular, can be configured to nest together. This orientation creates a smaller profile for the assembled product in that it has reduced thickness relative to the prior embodiments described herein. This creates a more compact design that can easily be stored, etc.

The laminated dispensing tube 3200, as illustrated, as a plurality of fingers or spokes 3201 that extend radially outward for carrying dispensed fluid outwardly, with each finger 3201 having at least one discharge opening (pin hole) 3203 for dispensing fluid that flows into the respective finger. The opening 3203 can be located near the end of the finger 3201 or can be at another location. The openings 3203 are formed in the lower layer of the laminated structure to provide an outlet for the fluid that is being pumped.

As mentioned herein, the laminated dispensing tube 3200 can be formed of any number of different materials and in one embodiment, the layers can be formed of polyethylene terephthalate, and they can be ultrasonically welded, radio frequency welded, or heat welded to each other and to the outlet tube fitment. Alternatively, an adhesive can be used to attach the two layers 3210, 3220. These parts can also be molded and then bonded together after molding. They may also be formed by blow molding or any other process that can produce hollow section parts.

In one embodiment, the first and second layers 3210, 3220 comprise 0.007" bi-axially oriented PET film sealed on the perimeter using a cut perimeter of acrylic adhesive, such as 3M product 7945 MP. This laminated structure (dispensing tube) can then be connected to the outlet tube fitment using UV cured adhesive product Locite 3105.

FIG. 30 shows the perimeter seal with a border area 3215 sealed between the top and bottom layers 3210, 3220 (FIG. 29) of the laminated dispensing tube 3200. An interior area 3217 provides a fluid passageway to connect the pump to the outlets (openings) 3203 of the tube 3200.

FIGS. 31-33 show cross-sectional views that depict the intake pathway and a discharge pathway. FIG. 31 shows a cross-section view of the pump assembly including the first and second check valves. The intake pathway formed in the first fitment 3190 (bore 3194) and through protrusion 3165 is shown with the first check valve being shown. The spring 3144 is held on the post 3123 and exerts a force against the ball 3142 against a valve seat formed in the body 3160. The second check valve has a similar arrangement in that the second spring 3154 is coupled to an integral post 3169 that is formed internally within the second compartment 3163 of the body 3160. The spring 3154 exerts a force against second ball 3152 in a direction opposite the direction that spring 3154 exerts a force against ball 3142. The valve seat for valve 3152 is formed internally within the body 3160. The two hollow compartments 3161, 3163 are positioned side-by-side as shown.

The degree of travel of the button 3110 is also shown in that the button 3110 slides along a wall of the body 3160. A shoulder 3167 is formed in the body 3160 and comprises a stop for the button 3110 (i.e., the shoulder 3167 defines the end of travel for the button 3110). FIG. 32 illustrates the intake flow path and the first check valve. Fluid is drawn from the internal storage location (pouch) within the mitt and flows through the bore 3193 of the first fitment 3190 and into the bore formed in the protrusion 3165. Seal member 3180 creates a seal between these protrusion 3165 and the first fitment 3190. When the button 3110 is released and spring 3114 restores the button 3110 to a fully extended (outward) position, negative force is generated within space 3111 and the ball 3142 is lifted off of the ball seat and spring 3144 compresses. The unseating of the ball 3142 allows fluid to flow directly into the space 3111 within the button 3110 where it is stored for the next dispensing action.

FIG. 33 shows a discharge pathway. Within the first fitment 3190 a discharge conduit 3195 is formed and can extend in the longitudinal direction. The body 3160 includes the second compartment 3163 which forms part of the discharge pathway along with a side channel 3197 that connects the second compartment 3163 to the discharge conduit 3195. When the button 3110 is depressed to force out the fluid stored in space 3111, the ball 3152 is driven off of its seat and spring 3154 compresses. This allows the fluid contained in space 3111 to flow into the second compartment 3163 through the side channel 3197 and into the discharge conduit 3195 where it flows into the dispensing tube 3200 (FIG. 29).

The cycle is repeated by pressing and releasing the button 3110 resulting in a quantity (e.g., volume of storage space 3111) be discharged through the dispensing tube 3200.

FIGS. 34-36 illustrate yet another embodiment of the present invention and in particular, the depicted pump is configured to spray on a surface instead of on a pad (or wipe) that is attached to the mitt assembly. FIG. 34 depicts the mitt assembly oriented relative to a surface 5. As described herein, the mitt assembly includes a pump assembly 3400 that is similar to the pump assembly 3100 and therefore, only the differences between the two pumps will be described in more detail. FIG. 34 shows an example of this application where the user puts the mitt assembly (or glove assembly) over their hand and holds the device above the surface 5 while pumping a spray onto the surface 5. The spray is projected as a spray cone 9 that emits from the pump assembly 3400 and is propelled onto the surface 5.

The pump assembly 3400 is similar to the pump assembly 3100 and includes many of the same parts with the exception being that the pump assembly 3400 having a nozzle 3410 that directs the fluid downward toward the surface 5 (FIG. 35).

FIG. 36 is an exploded view of the pump assembly 3400. It will be appreciated from FIG. 36 that the pump assembly 3400 is very similar to the pump assembly 3100 expect that the second fitment 3250 is eliminated and instead an underside of the main pump body 3160 includes a receptacle 3410 that points downward. A nozzle 3420 is received within the receptacle 3410. The nozzle 3420 is configured to direct and dispense the fluid from the main pump body 3160. Thus, while the second fitment 3250 is designed to bend the dispensed fluid at a 90 degree angle, the nozzle 3420 directs the fluid downward (90 degrees to the main pump body 3160). The nozzle 3420 is also designed to produce a desired spray pattern, such as the conical spray pattern shown in FIG. 34; however, it will be understood that the nozzle 3420 can spray or squirt fluid in a stream or any other pattern as well.

In this embodiment, the nozzle 3420 does not nest with the first fitment 3190 and therefore, the main pump body 3160 does not need to include the keyed bottom surface shown in FIG. 29 but instead includes the nozzle receptacle 3410. This results in the discharge fluid pathway having a 90 degree bend.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A portable fluid dispensing device for mounting upon a human hand comprising:

a hand-held applicator that includes a pocket that is configured to receive one hand of a user, the pocket partitioning the hand-held applicator into a rear portion and a front portion, wherein the rear portion includes a fluid reservoir for holding a fluid that is to be dispensed; the rear portion including a first layer and a second layer that are fluidly sealed to one another at select locations such that the fluid reservoir is formed between the first and second layers;

at least one fluid dispensing conduit that is in selective fluid communication with the fluid reservoir for selectively dispensing the fluid through the at least one fluid dispensing conduit, wherein the at least one fluid dispensing conduit comprises a laminated structure formed of a first laminated layer and a second laminated layer sealed along peripheral edges of the first and second laminated layers, with an inner unsealed area permitting fluid to flow to an outlet opening formed in one of the first laminated layer and the second laminated layer; and a pump for drawing fluid from the fluid reservoir and discharging the fluid through the at least one dispensing conduit, wherein a distal part of the pump is disposed and sealed between the proximal end portion of the first laminated layer and a proximal end portion of the second laminated layer;

wherein each of the first laminated layer and the second laminated layer comprises a film that is cut to define a proximal end portion that is in selective fluid communication with the fluid reservoir and a plurality of fingers that are distal to the proximal end portion, with each finger having at least one outlet opening.

2. The portable fluid dispensing device of claim 1, wherein the proximal end portion of each of the first laminated layer and the second laminated layer includes a recessed section in which the distal part is received.

3. A portable fluid dispensing device for mounting upon a human hand comprising:

a hand-held applicator that includes a pocket that is configured to receive one hand of a user, the pocket partitioning the hand-held applicator into a rear portion and a front portion, wherein the rear portion includes a fluid reservoir for holding a fluid that is to be dispensed; the rear portion including a first layer and a second layer that are fluidly sealed to one another at select locations such that the fluid reservoir is formed between the first and second layers;

at least one fluid dispensing conduit that is in selective fluid communication with the fluid reservoir for selectively dispensing the fluid through the at least one fluid dispensing conduit, wherein the at least one fluid dispensing conduit comprises a laminated structure formed of a first laminated layer and a second laminated layer sealed along peripheral edges of the first and second laminated layers, with an inner unsealed area permitting fluid to flow to an outlet opening formed in one of the first laminated layer and the second laminated layer; and a pump for drawing fluid from the fluid reservoir and discharging the fluid through the at least one fluid dispensing conduit, the pump having a movable button that has a hollow interior that defines a temporary storage space for the fluid drawn from the fluid reservoir but prior to discharge through the at least one fluid dispensing conduit.

4. The portable fluid dispensing device of claim 3, wherein the pump includes a pump body to which the button is spring biased, the pump body defining an intake pathway along which the fluid flows from the fluid reservoir to the hollow interior of the button and a fluid outflow pathway along which the fluid flows from the temporary storage space to the at least one fluid dispensing conduit, the intake pathway including a first valve and the outflow pathway including a second valve.

5. The portable fluid dispensing device of claim 4, further including: (1) an intake conduit member that is coupled to the pump body and has a protrusion that is placed in fluid communication with the fluid reservoir and has a bore through which the fluid flows along the intake pathway; and (2) an outflow conduit member that is coupled to the pump body and has an inner channel that is in fluid communication with the outflow pathway, the intake conduit member lying a separate horizontal plane relative to the outflow conduit member.

6. The portable fluid dispensing device of claim 5, wherein a bottom edge of the pump body has a keyed recess that mates with a keyed protrusion of the outflow conduit member.

7. The portable fluid dispensing device of claim 5, wherein the outflow conduit member is disposed below the intake conduit member to produce a compact configuration.

8. The portable fluid dispensing device of claim 5, wherein the outflow pathway within the pump body has a 90 degree bent section and one end of the 90 degree bent section opens into the inner channel of the outflow conduit member for directing fluid distally to the at least one fluid dispensing conduit.

9. The portable fluid dispensing device of claim 5, wherein the intake conduit member is sealed relative to the pump body via a first seal member.

10. The portable fluid dispensing device of claim 4, further including a cap member that is disposed between the pump body and the button, the cap member having an annular shaped protrusion with a thru hole formed therein and the annular shaped protrusion further defining a valve seat for the second valve, the cap member having a first post formed adjacent the annular shaped protrusion, the first post receiving an intake biasing element that biases the first valve in a direction away from the button.

11. The portable fluid dispensing device of claim 10, wherein the pump body has a first cavity in which the first valve is disposed and an adjacent second cavity in which the second valve is disposed, the second cavity including a second post for receiving a second biasing element that biases the second valve in a direction toward the button and onto the valve seat defined by the annular shaped protrusion.

12. A portable fluid dispensing device for mounting upon a human hand comprising:

a hand-held applicator that includes a pocket that is configured to receive one hand of a user, the pocket partitioning the hand-held applicator into a rear portion and a front portion, wherein the rear portion includes a fluid reservoir for holding a fluid that is to be dispensed; the rear portion including a first layer and a second layer that are fluidly sealed to one another at select locations such that the fluid reservoir is formed between the first and second layers;

a fluid dispensing conduit that is in selective fluid communication with the fluid reservoir at a first end thereof for selectively dispensing the fluid through the fluid dispensing conduit, wherein the fluid dispensing conduit comprises a laminated structure formed of a first laminated layer and a second laminated layer sealed along peripheral edges of the first and second laminated layers, with an inner unsealed area permitting fluid to flow to a plurality of outlet openings formed in one of the first laminated layer and the second laminated layer; and a pump for drawing fluid from the fluid reservoir and discharging the fluid through the fluid dispensing conduit, the pump being disposed at the first end of the fluid dispensing conduit such that a fitment of the pump is sealed between the first laminated layer and the second laminated layer and is configured to direct the fluid forward within the inner unsealed area;

wherein each of the first laminated layer and the second laminated layer comprises a film that is cut to define a plurality of fingers, with each finger defining a fluid flow path and each finger having at least one outlet opening.

* * * * *